US005619308A

United States Patent [19]

Kinoshita et al.

[11] Patent Number: 5,619,308

[45] Date of Patent: Apr. 8, 1997

[54] ELECTROPHOTOGRAPHIC IMAGE FORMING APPARATUS ADJUSTING IMAGE FORMING MEANS BASED ON SURFACE VOLTAGE OF PHOTOCONDUCTOR

[75] Inventors: Naoyoshi Kinoshita, Aichi-ken; Takeru Kinoshita, Toyokawa; Hideaki Kodama, Okazaki, all of Japan

[73] Assignee: Minolta Camera Kabushiki Kaisha, Osaka, Japan

[21] Appl. No.: 63,082

[22] Filed: May 18, 1993

[30] Foreign Application Priority Data

| | | | |
|---|---|---|---|
| May 19, 1992 | [JP] | Japan | 4-126480 |
| May 19, 1992 | [JP] | Japan | 4-126481 |
| May 19, 1992 | [JP] | Japan | 4-126485 |
| May 19, 1992 | [JP] | Japan | 4-126492 |
| May 19, 1992 | [JP] | Japan | 4-126493 |

[51] Int. Cl.[6] ..... G03G 21/00

[52] U.S. Cl. ..... 399/48; 399/130

[58] Field of Search ..... 355/203–209, 355/210–212, 233, 243, 219, 246, 274–277

[56] References Cited

U.S. PATENT DOCUMENTS

| | | | |
|---|---|---|---|
| 4,346,986 | 8/1982 | Kuge et al. | 355/210 X |
| 4,348,099 | 9/1982 | Fantozzi . | |
| 4,963,926 | 10/1990 | Onishi | 355/203 |
| 4,970,557 | 11/1990 | Masuda et al. | 355/246 |
| 4,982,232 | 1/1991 | Naito | 355/208 |
| 5,153,609 | 10/1992 | Ando et al. | 355/208 X |
| 5,162,821 | 11/1992 | Fukuchi et al. | 346/157 |
| 5,164,771 | 11/1992 | Suzuki et al. | 355/208 |
| 5,189,441 | 2/1993 | Fukui et al. | 346/160 |
| 5,287,149 | 2/1994 | Hoshika | 355/246 |

FOREIGN PATENT DOCUMENTS 62-251763 11/1987 Japan .

*Primary Examiner*—Thu Anh Dang

*Attorney, Agent, or Firm*—Burns, Doane, Swecker & Mathis, LLP

[57] ABSTRACT

In an electrophotographic image forming apparatus including a photoconductive drum, the photoconductive drum is electrically charged by a corona charger, and light corresponding to an image is projected onto the photoconductive drum by an exposure optical system, thereby forming an electrostatic latent image thereon. Thereafter, the formed electrostatic latent image is developed with toner by a developing unit to form a toner image thereon, and then the toner image is transferred onto a sheet of paper. There is further provided a voltage sensor for detecting a surface voltage at at least one position of the photoconductive drum. An operation value of at least one of the corona charger, the exposure optical system and the developing unit is adjusted by an adjustment controller based on the surface voltage detected by the voltage sensor at a timing between respective image forming processes when an image forming process is continuously repeated a plurality of times. Further, the operation value of at least one of the corona charger, the exposure optical system and the developing unit is further adjusted with a preciseness higher than that of the adjusting controller, based on the surface voltage detected by the voltage sensor, prior to a process of continuously repeating an image forming process a plurality of times.

19 Claims, 47 Drawing Sheets

Laser driver
263
Semiconductor laser
264
Driving I/O
261
Parallel I/O
262
Data ROM
203
201
Printer controller
101 20
Control ROM
202
Driving I/O
242
$V_B$ generator
244
Parallel I/O
241
$V_G$ generator
243
Voltage sensor
44
AIDC sensor
210
ATDC sensor
211
Temperature sensor
212
Humidity sensor
213
Parallel I/O
222
Operation panel
221
200
Copying controller
231
Display panel
232

$V_G$ correction process
S4
State?
S151
1
State=1
VCF=1?
S152
NO
YES
S153
Clean charge wire
S161
BVCF=1?
2
NO
YES
Cleaning completed?
S154
NO
YES
S162
Print SW ON?
NO
YES
S155
VCF←0
S156
BVCF←0
2
S157
AVCF←0
S163
AVCF=1?
NO
S158
Turn off before-transfer eraser
YES
S164
Copying of final page completed?
S159
Set detection permission timer T1
YES
NO
S160
State←1
Return

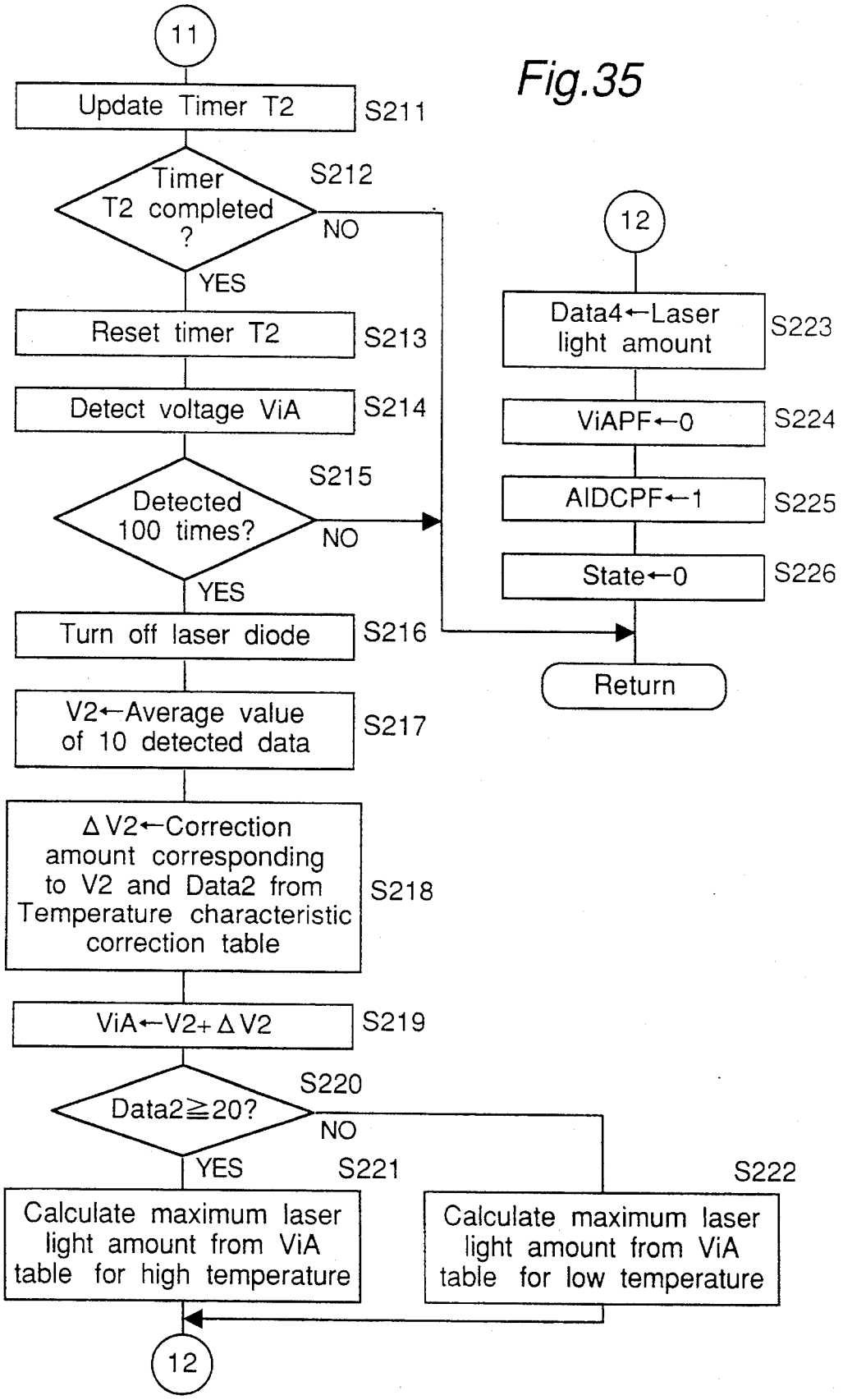
Fig.35
11
Update Timer T2
S211
Timer T2 completed ?
S212
NO
YES
Reset timer T2
S213
Detect voltage ViA
S214
Detected 100 times?
S215
NO
YES
Turn off laser diode
S216
V2←Average value of 10 detected data
S217
ΔV2←Correction amount corresponding to V2 and Data2 from Temperature characteristic correction table
S218
ViA←V2+ΔV2
S219
Data2≧20?
S220
NO
YES
S221
Calculate maximum laser light amount from ViA table for high temperature
S222
Calculate maximum laser light amount from ViA table for low temperature
12
12
Data4←Laser light amount
S223
ViAPF←0
S224
AIDCPF←1
S225
State←0
S226
Return

ELECTROPHOTOGRAPHIC IMAGE FORMING APPARATUS ADJUSTING IMAGE FORMING MEANS BASED ON SURFACE VOLTAGE OF PHOTOCONDUCTOR

BACKGROUND OF THE INVENTION

1. Field of the Invention

The present invention relates to an electrophotographic image forming apparatus, and more particularly, to an electrophotographic image forming apparatus, such as a digital color copying machine, comprising means for adjusting image forming means such as charging means, developing means and transfer means, based on a surface voltage of a photoconductor, to stably form an image on a piece of paper with a high precision.

2. Description of the Prior Art

Generally, photoconductive drums used in an electrophotographic process have a dispersion of electrostatic characteristics, and each photoconductive drum has an electrostatic characteristic changing due to change of the environments and/or changing when document images of many pages have been printed out. Moreover, the photoconductive drums may be electrically charged to ununiformly form surface voltages changing in their circumferential direction.

In particularly, in color copying machines, these changes in the electrostatic characteristics may remarkably influence reproducibility of colors, color balance, and reproducibility of a low-density part of an image.

For the purpose of more stably forming images, an automatic density control process is performed which detects electrostatic characteristics of a photoconductive drum and controls a surface voltage thereon, thereby more stably forming images.

The surface voltage of the photoconductive drum is detected by a voltage sensor, and the detection value would involve nonuniformity in the circumferential direction of the photoconductive drum. This nonuniformity may occur because of, for example, deflection due to decentering of the photoconductive drum. As a result, considerable errors may occur in detecting the surface voltage. Thus, attempts to more stably form images should be implemented, taking the voltage nonuniformity into consideration.

An image forming apparatus as described in Japanese Patent Laid-Open Publication No. Sho-62-251763/1987 is so arranged that dark-part and bright-part voltages are detected at predetermined positions of the photoconductive drum which correspond to the average value, the maximum value, and the minimum value of the detected voltages, in order to reduce the effect of nonuniformity in the circumferential voltage of the photoconductive drum.

SUMMARY OF THE INVENTION

An object of the present invention is therefore to provide an electrophotographic image forming apparatus capable of more stably forming images on a piece of paper with a higher precision.

Another object of the present invention is to provide an electrophotographic image forming apparatus capable of more stably forming images on a piece of paper at a higher speed.

A further object of the present invention is to provide an electrophotographic image forming apparatus capable of preventing the image density or color of a formed image from changing in a process of continuously forming the image such as a multi-copying process.

A still further object of the present invention is to provide an electrophotographic image forming apparatus comprising a plurality of light emitting control systems, said apparatus having gradation correction table of a smaller memory capacity.

In order to achieve the aforementioned objective, according to one aspect of the present invention, there is provided an electrophotographic image forming apparatus comprising:

a photoconductor;

charging means for electrically charging said photoconductor;

exposure means for projecting light corresponding to an image onto said photoconductor and forming an electrostatic latent image on said photoconductor;

developing means for developing the electrostatic latent image formed on said photoconductor with toner and forming a toner image on said photoconductor;

transfer means for transferring the toner image formed on said photoconductor onto a sheet of paper;

control means for controlling said charging means, said exposure means, said developing means and said transfer means to form the toner image on a sheet of paper;

detecting means for detecting a surface voltage at at least one position of said photoconductor;

first adjusting means for adjusting an operation value of at least one of said charging means, said exposure means and said developing means based on the surface voltage detected by said detecting means at a timing between respective image forming processes when an image forming process is continuously repeated a plurality of times; and second adjusting means for adjusting the operation value of at least one of said charging means, said exposure means and said developing means with a preciseness higher than that of said first adjusting means, based on the surface voltage detected by said detecting means, prior to a start timing when an image forming process is continuously repeated a plurality of times.

According to another aspect of the present invention, there is provided an electrophotographic image forming apparatus comprising:

a photoconductor;

charging means for electrically charging said photoconductor with a charging amount;

exposure means for projecting light corresponding to an image onto said photoconductor with an exposure amount and forming an electrostatic latent image on said photoconductor;

developing means for developing the electrostatic latent image formed on said photoconductor with toner with a development bias voltage and forming a toner image on said photoconductor;

transfer means for transferring the toner image formed on said photoconductor onto a sheet of paper;

control means for controlling said charging means, said exposure means, said developing means and said transfer means to form the toner image on a sheet of paper;

detecting means for detecting a surface voltage at least one position of said photoconductor;

storage means for controlling said detecting means to detect a surface voltage of a part of an electrostatic latent image formed on said photoconductor under predetermined image forming conditions and storing the detected surface voltage as a reference surface voltage; and correcting means for controlling said detecting means to detect a surface voltage of said part of an electrostatic latent image formed on said photoconductor under the same predetermined image forming conditions and correcting at least one of the exposure amount of said exposure means, the charging amount of said charging means and the development bias voltage of said developing means based on the detected surface voltage and the reference surface voltage stored in said storage means.

According to a further aspect of the present invention, there is provided an electrophotographic image forming apparatus for forming an image using a plurality of light emitting methods including a first light emitting method, comprising:

selecting means for selecting one of the plurality of light emitting methods;

emitting control means for projecting light corresponding to an image to be formed onto a photoconductor using the light emitting method selected by said selecting means;

first storage means for storing gradation correction table used when using said first light emitting method;

second storage means for storing differences between said gradation correction table stored in said first storage means and gradation correction tables used when using the light emitting method other than said first light emitting means; and gradation correcting means for performing a gradation correction process using said gradation correction table stored in said first storage means when said first light emitting method is selected, and for performing a gradation correction process using addition results of said gradation correction table stored in said first storage means and said differences stored in said second storage means.

According to a still further aspect of the present invention, there is provided an electrophotographic image forming apparatus for forming an image using a plurality of light emitting methods including a first light emitting method, comprising:

a photoconductor;

charging means for electrically charging said photoconductor;

exposure means for projecting light corresponding to an image onto said photoconductor and forming an electrostatic latent image on said photoconductor;

developing means for developing the electrostatic latent image formed on said photoconductor with toner and forming a toner image on said photoconductor;

detecting means for detecting a surface voltage of said photoconductor;

condition determining means for determining an image forming condition using the electrostatic latent image formed using said first light emitting method prior to forming an image;

selecting for selecting one of the plurality of light emitting methods; and exposure control means for controlling said exposure means to project light using the light emitting method selected by said selecting means, upon forming an image.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which:

FIG. 35 is a flowchart of a second part of the ViA detection process shown in FIG. 30;

DETAILED DESCRIPTION OF THE PREFERRED EMBODIMENTS

A digital color copying machine of a preferred embodiment according to the present invention will be described hereinafter with reference to the accompanying drawings in an order of the following items:

(a) Construction of Digital color copying machine;

(b) Image signal processing;

(c) Gradation correction;

(d) Automatic image density control (AIDC);

(e) Accuracy enhancement of AIDC (detections of dark-part voltage Vo and bright-part voltage Vi prior to AIDC operation, and correction of grid voltage $V_G$ and maximum light amount);

(f) Distance characteristic of voltage sensor and its correction;

(g) Corrections of maximum density variation and gradation variation in multi-copying;

(g-1) ViC detection and correction of maximum light amount;

(g-2) Light amount correction table for multi-copying;

(g-3) Modification examples;

(h) Limitation of Correction amount for Multi-copying;

(i) Prevention of Overcorrection in Malfunction;

(j) Switching of Light emitting control mode;

(k) Flow of Printer control:

(k-1) Explanation of Main routine;

(k-2) Main switch turn-ON process;

(k-3) $V_G$ correction process;

(k-4) ViA detection process;

(k-5) AIDC operation process;

(k-6) ViB detection process;
(k-7) Time control process;
(k-8) Environmental control process;
(k-9) Light emitting control process;
(k-10) Copying process;
(k-11) Trouble process such as process for paper jam;
(k-12) $V_G$ correction process during multi-copying; and
(k-13) Overcorrection prevention process.

Sections particularly pertinent to the present invention are sections (e), (g), and (k-1) as listed above.

(a) Construction of Digital color copying machine

Figure 1:
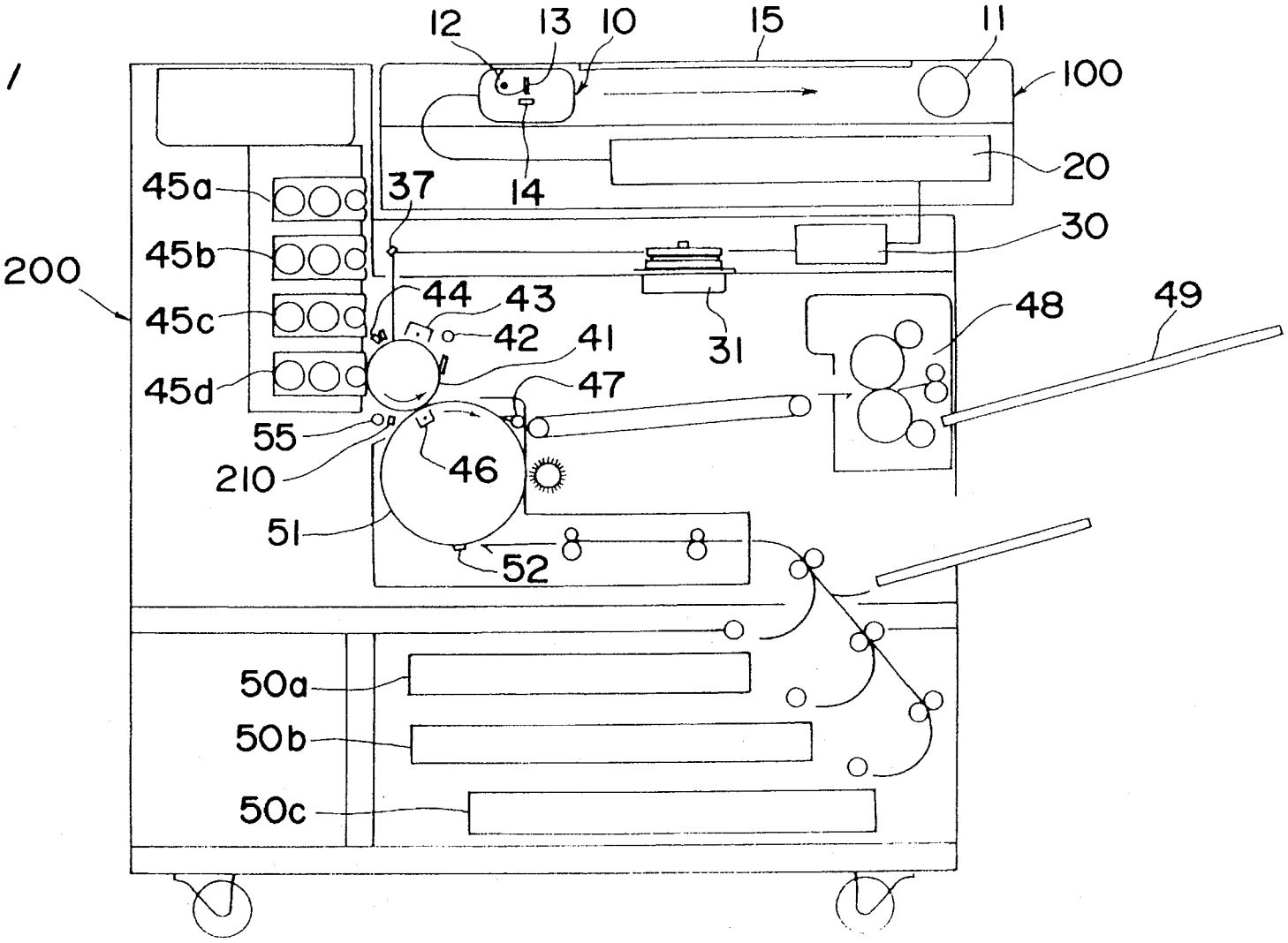
FIG. 1 is a schematic sectional view showing an overall construction of a digital color copying machine of a preferred embodiment according to the present invention.

FIG. 1 is a sectional view showing the overall construction of the digital color copying machine of the preferred embodiment according to the present invention.

The digital color copying machine of the present preferred embodiment is divided roughly into an image reader 100 for reading an image of a document (referred to as a document image hereinafter) and converting the read image into image data, and a copying section 200 for reproducing the document image of the image data converted by the image reader 100, on a piece of paper.

In the image reader 100, a scanner 10 comprises an exposure lamp 12 for illuminating an original document, a rod-lens array 13 for converging reflected light from the document, and a close-contact type CCD color image sensor 14 for converting the converged light into electrical image signals. In reading the document image, the scanner 10 is driven by a motor 11 so as to be moved in a direction (subscan direction) as indicated by an arrow, thereby scanning the document image placed on a platen 15. The document image on the document surface of the document illuminated by the exposure lamp 12 is read and is converted into multi-value electrical image signals of three colors of Red (R), Green (G) and Blue (S) by the CCD color image sensor 14. The multi-value electrical image signals of three colors of R, G and B outputted from the CCD color image sensor 14 are converted into 8-bit gradation image digital data of either one color of Yellow (Y), Magenta (M), Cyan (C) or Black (B) by an image signal processor 20, and then, the gradation image digital data are stored in a buffer memory 30 which is provided for making the operation of the copying section 200 be synchronous with that of the image reader 100.

Figure 8:
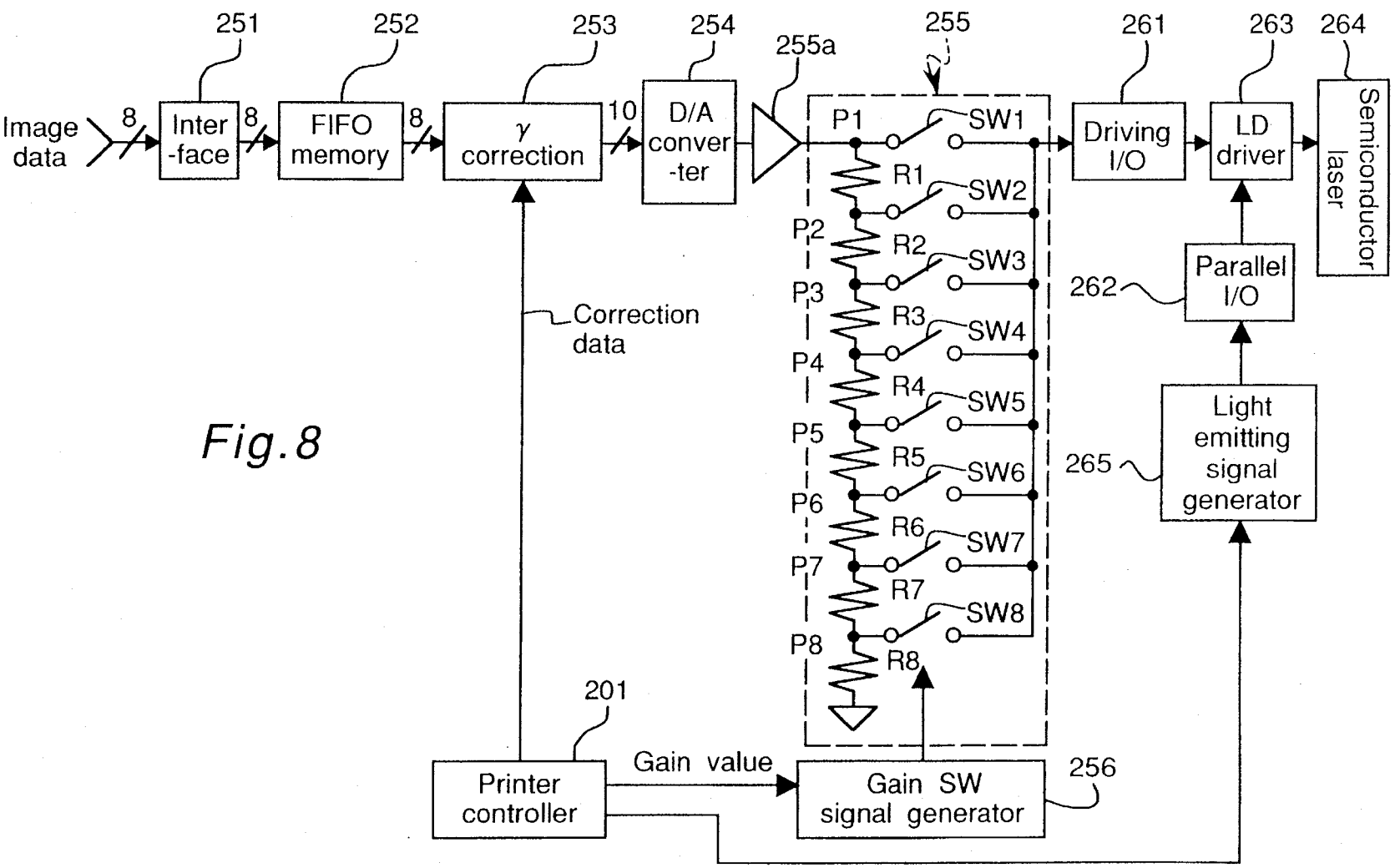
FIG. 8 is a block diagram of a printer controller shown in FIGS. 5 and 6 showing a process for processing image data.

Further, in the copying section 200, a print head 31 performs gradation correction or so-called $\gamma$ correction process for the gradation image digital data stored in the buffer memory 30 depending on the gradation characteristics of a photoconductive drum 41. Thereafter, the print head 31 further converts the corrected image digital data into an analog signal, and then outputs it as a driving signal for driving a semiconductor laser diode 264 (shown in FIG. 6) provided within the print head 31, so that the laser diode 264 emits a beam of laser light as shown in FIG. 8 according to the gradation image data.

A beam of laser light emitted from the print head 31 according to the gradation image data is projected through a reflection mirror 37 onto the photoconductive drum 41, which is rotated as indicated by an arrow. The photoconductive drum 41 is illuminated by an eraser lamp 42 prior to an exposure of a beam of laser light of each copying process, and then, is electrically charged uniformly by a corona charger 43. When the photoconductive drum 41 is exposed to a beam of laser light in such a state, an electrostatic latent image corresponding to the above document image is formed on the photoconductive drum 41. Either only one of toner developing units 45*a* to 45*d* of cyan, magenta, yellow and black toners is selected, and the selected developing unit (one of 45*a* to 45*d*) develops the electrostatic latent image with toner so as to form a toner image on the photoconductive drum 41. The resulting toner image is transferred by a transfer charger 46 onto a piece of plain copying paper wound around a transfer drum 51.

Figure 2:
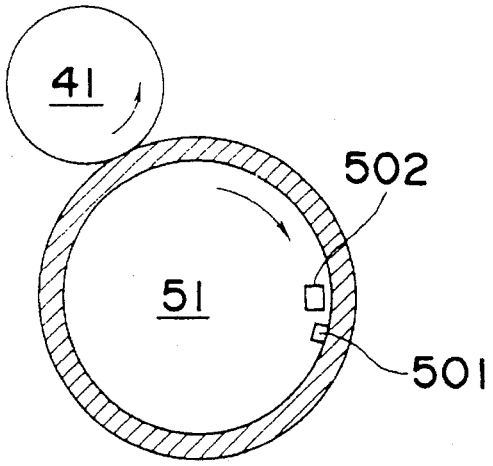
FIG. 2 is a schematic cross-sectional view illustrating a process of detecting a rotational position of a photoconductive drum shown in FIG. 1.

As shown in FIG. 2, the transfer drum 51 is provided with a position detector 501 of a light-shielding plate. When the position detector 501 passes through the position of a detecting photosensor 502, the detecting photosensor 502 detects a predetermined rotational position of the photoconductive drum 41, and then the detected timing is used as a control starting timing for controlling the copying process.

Further, the photoconductive drum 41 and the transfer drum 51 are arranged so that the ratio of the drum diameter of the photoconductive drum 41 to that of the transfer drum becomes 2:1, and they are driven in synchronous with each other so that an predetermined outer peripheral position of the photoconductive drum 41 is always in contact with the corresponding outer peripheral position of the transfer drum 51. This arrangement prevents any occurrence of any misalignment in toner image superposition. Moreover, it becomes possible to accomplish both detections of a toner adhesion amount by an AIDC sensor 210 and a surface voltage of the photoconductive drum 41 (referred to as a surface voltage hereinafter) by a voltage sensor 44 at a predetermined position on the photoconductive drum 41, and then allowing the effect caused due to decentering of the photoconductive drum 41 to be neglected in the above detections.

The printing process as described above is repeated for four colors of yellow (Y), magenta (M), cyan (C) and black (K). In this printing process, the scanner repeats the scanning operation in synchronous with the rotations of the photoconductive drum 41 and the transfer drum 51. Thereafter, a piece of plain copying paper on the toner images is formed and is separated from the transfer drum 51 by a separation nail 47 being activated, and then the toner images on the copying paper are fixed by passing the copying paper through a fixing unit 48. Thereafter, the copying paper is discharged onto a paper discharging tray 49.

It is to be noted that the copying paper is fed from a paper cassette 50 and then the top end thereof is chucked by a chucking mechanism 52 provided on the transfer drum 51. This arrangement can prevent the copying paper from being shifted from a predetermined position during the transfer process for transferring toner images.

Figure 3:
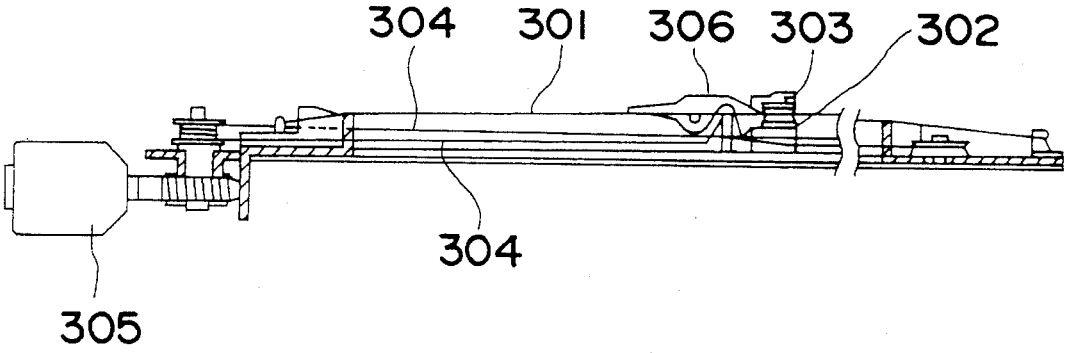
FIG. 3 is a partially broken schematic side view of a charge wire cleaning unit of the digital color copying machine shown in FIG. 1.

FIG. 3 is a partially broken schematic side view of a charge wire cleaning unit.

Referring to FIG. 3, a charge wire 301 of the corona charger 43 is provided between cleaning members 302 and 303 which are attached to a moving member 306. When the moving member 306 with the cleaning members 302 and 303 are moved in a longitudinal direction of the charge wire 301, the charge wire 301 is cleaned. The moving member 306 is mechanically connected with a rope 304. When the rope 304 is continuously wound up by a motor 305, the moving member 306 is moved. This movement normally serves to remove deposits adhering on the charge wire 301, thereby suppressing nonuniformity in the discharge.

The above-mentioned cleaning operation is performed always prior to detection of the surface voltage and the toner adhesion amount of an automatic image density control process (referred to as an AIDC process hereinafter). Thus, change or uniformity in the surface voltage which may occur due to the deposits adhering thereon by the charge operation can be suppressed, thereby allowing the surface voltage to be accurately corrected.

In the case of detecting the surface voltage of the photoconductive drum 41 and detecting the toner adhesion amount over the whole of the photoconductive drum 41 in the longitudinal direction thereof, a plurality of kinds of two or more sensors may be provided in parallel to the longitudinal direction of the photoconductive drum 41, and also a scan operation may be performed for a plurality of sensors. However, they result in a large scale and an expensive manufacturing cost. In order to dissolve the above problems, in the present preferred embodiment, the charge wire 301 is cleaned always prior to the above detections. The change or uniformity in the surface voltage in the longitudinal direction of the photoconductive drum 41 due to the deposits on the charge wire 301 can be prevented, resulting in allowing one voltage sensor 44 fixedly mounted to accurately control the copying process with a higher precision.

Figure 4:
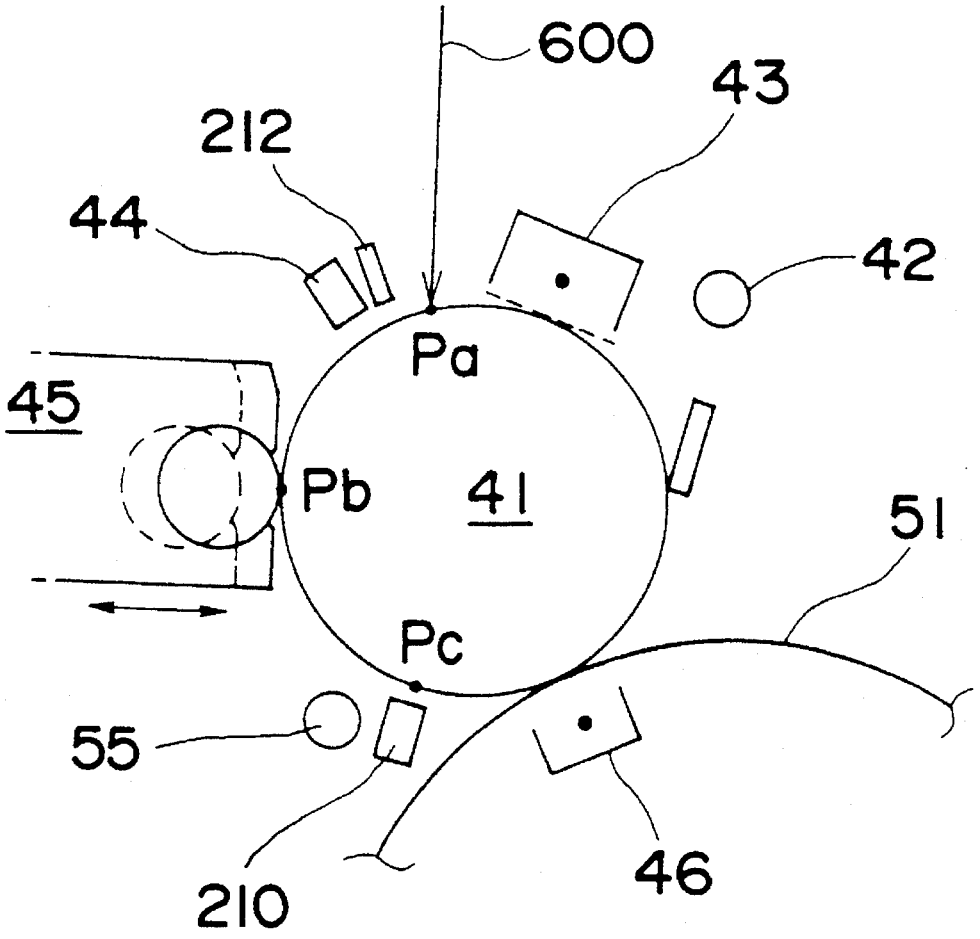
FIG. 4 is a side view showing an arrangement around the photoconductive drum shown in FIGS. 1 and 2.

FIG. 4 shows the arrangement around the photoconductive drum 41.

Referring to FIG. 4, the voltage sensor 44 is provided at a position between a laser light exposure position Pa and developing position Pb. The distance between the sensor surface of the voltage sensor 44 and the surface of the photoconductive drum 41 is set to about 3 mm. An AIDC sensor 210 is provided at a predetermined position Pc after the development process which is located apart by about 3 mm from the photoconductive drum 41. The AIDC sensor 210 and the voltage sensor 44 are positioned at the nearly same position in the longitudinal direction of the photoconductive drum 41, thereby suppressing the effect of voltage nonuniformity in the longitudinal direction of the photoconductive drum 41 which may occur due to partial mesh fouling or the like, and thus maintaining the accuracy in the detection of toner adhesion amount by the AIDC sensor 210.

Further, during the process of detecting the toner adhesion amount, a before-transfer eraser 55 is turned off in order to prevent its light from being applied to the light receiving part or the sensor surface of the AIDC sensor 210.

Similarly, during the process of detecting the surface voltage, since the developing unit 45 is out of pressure contact with the photoconductive drum 41 such that the light from the before-transfer eraser 55 will go around up to the voltage sensor 44, the before-transfer eraser 55 is also turned off this time.

In addition, around the photoconductive drum 41, a temperature sensor 212 for detecting a temperature of the photoconductive drum 41 is attached besides the aforementioned sensors 44 and 210, thereby allowing the correction of temperature characteristic of the voltage sensor 44 and the monitoring of the temperature inside the digital color copying machine.

Figure 5:
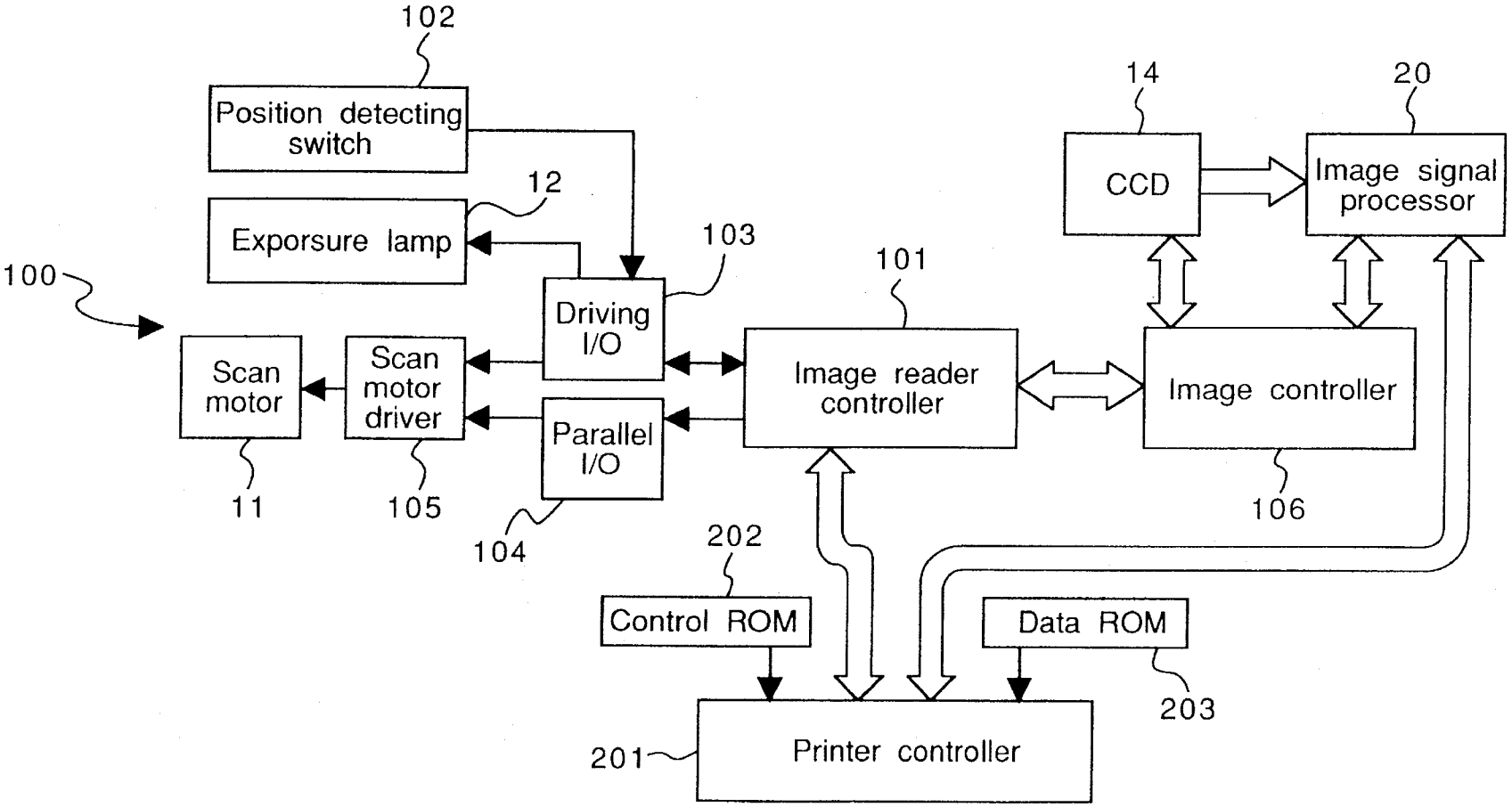
FIG. 5 is a schematic block diagram of a first part of a control system of the digital color copying machine shown in FIG. 1.
Figure 6:
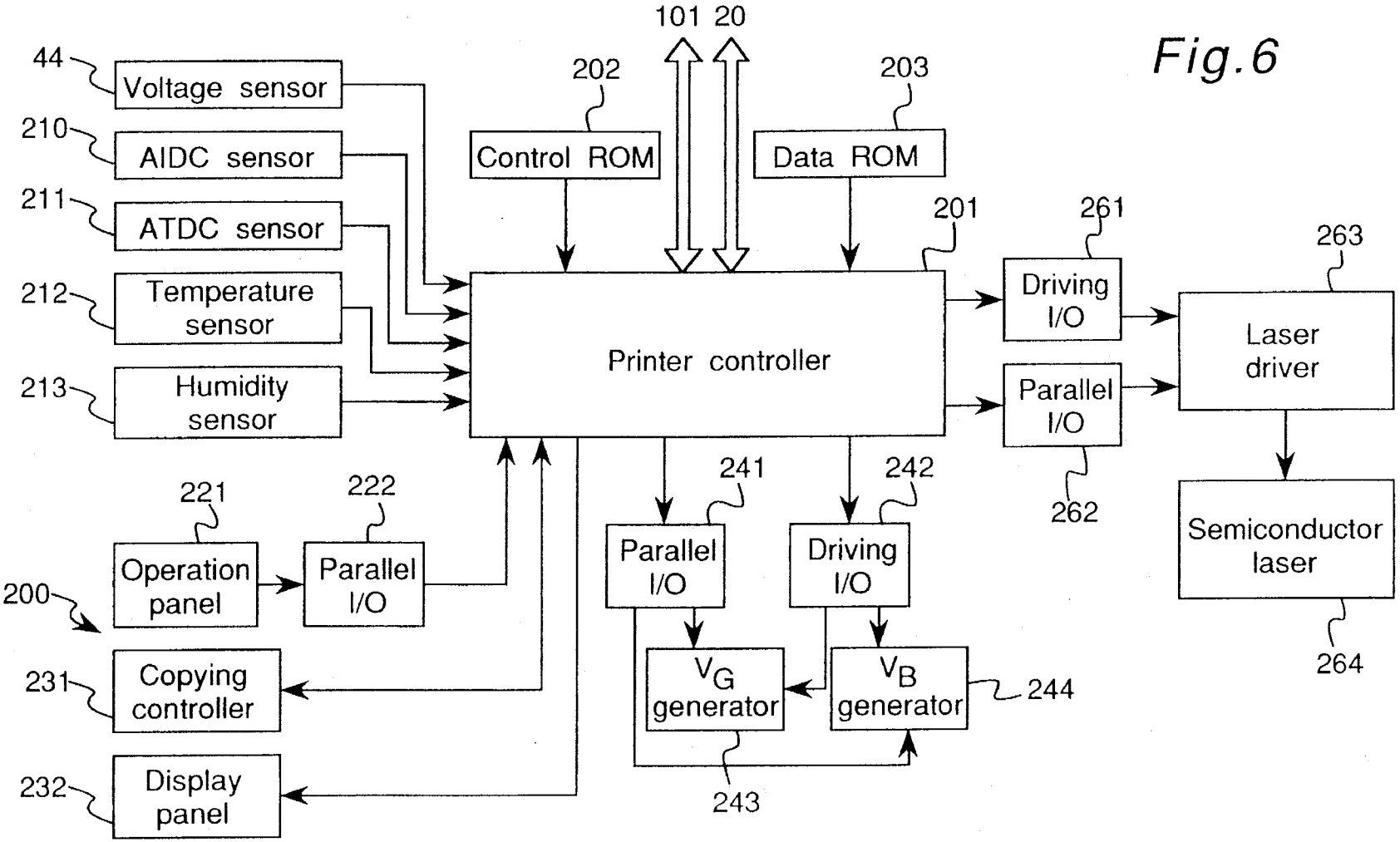
FIG. 6 is a schematic block diagram of a second part of the control system of the digital color copying machine shown in FIG. 1.

FIGS. 5 and 6 are schematic block diagrams of the control system of the digital color copying machine of the present preferred embodiment. 10 Referring to FIG. 5, the operation of the image reader 100 is controlled by an image reader controller 101. The image reader controller 101, in accordance with a position signal outputted from a position detecting switch 102 which presents the position of the document on the platen 15, controls the operation of the exposure lamp 12 through a driving input and output interface (referred to as a driving I/O hereinafter) 103, and further controls the operation of a scan motor driver 105 through the driving I/O 103 and a parallel input and output interface (referred to as a parallel I/O hereinafter) 104. The scan motor 11 is driven by the scan motor driver 105.

Meanwhile, the image reader controller 101 is coupled with an image controller 106 through bus. The image controller 106 is connected to not only the CCD color image sensor 14 but also the image signal processor 20 through bus. The image signals outputted from the image sensor 14 are fed to the image signal processor 20, and then are processed by the image signal processor 20.

Referring to FIG. 6, the copying section 200 comprises a printer controller 201 for generally controlling the copying operation.

To the printer controller 201 provided with a CPU are connected not only a control ROM 202 in which control programs are stored but also a data ROM 203 in which various kinds of data such as γ correction table data or the like are stored. The printer controller 201 controls the printing process using the data stored in these ROMs 202 and 203.

The printer controller 201 receives analog signals outputted from various types of sensors including:

(a) the Vo sensor 44 for detecting the surface voltage Vo of the photoconductive drum 41;

(b) the AIDC sensor 210 for detecting the toner adhesion amount of a reference toner image, or the amount of toner adhering onto the surface of the photoconductive drum 41;

(c) an automatic toner density control (referred to as an ATDC hereinafter) sensor 211 for detecting the toner densities of the toners provided within the developing units 45*a* to 45*d;*

(d) the above-mentioned temperature sensor 212; and (e) a humidity sensor 213 for detecting the humidity within the digital color copying machine.

The printer controller 201 controls the operation of a copying controller 231 and a display panel 232 according to the contents stored in the control ROM 202 based on data outputted from the sensors 44 and 210 to 213, an operation panel 221, and the data ROM 203. For the automatic image density control by the AIDC sensor 210, or a manual image density control which is performed according to an input value inputted using the operation panel 221, the printer controller 201 further controls the operations of a $V_G$ generator 243 for generating a grid voltage $V_G$ of the corona charger 43 and a $V_B$ generator 244 for generating a development bias voltage $V_B$ of the toner developing units 45*a* to 45*d* through a parallel I/O 241 and a driving I/O 242. It is to be noted that the printer controller 201 comprises an internal RAM for storing various kinds of data.

The printer controller 201 is also connected to the image signal processor 20 of the image reader 100 through image data bus, and controls a laser driver 263 through a driving I/O 261 and a parallel I/O 262 with reference to the contents stored in the data ROM 203, in which the γ correction or gradation correction tables are stored, based on the image density signal inputted through the image data bus. The semiconductor laser diode 264 is driven by the laser driver 263 so as to emit a beam of laser light according to the analog driving signal as described above. In the preferred embodiment, the gradation representation is achieved by the modulation of the intensity of a beam of laser light emitted from the laser diode 264.

(b) Image signal processing

Figure 7:
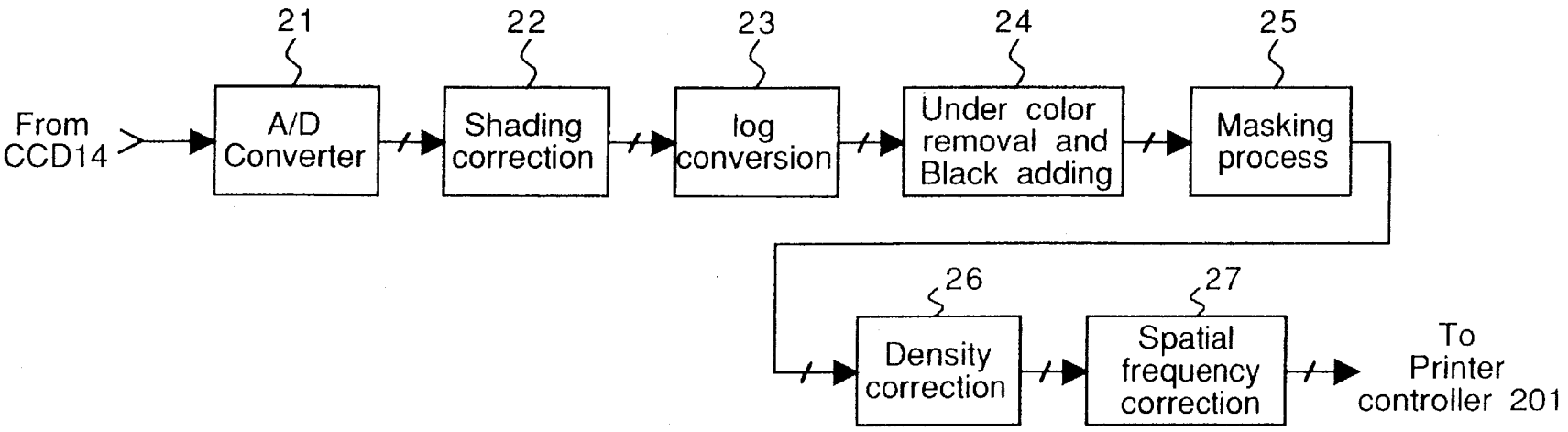
FIG. 7 is a schematic block diagram of an image processing section showing a flow of processing an image signal.

FIG. 7 is a schematic block diagram showing a flow of the processing of the image signal from the CCD color image sensor 14 to the printer controller 201 through the image signal processor 20.

Referring to FIG. 7, the image signal reading process in which an output signal from the image sensor 14 is processed into an output of gradation data is described below.

In the image signal processor 20, the analog image signals converted from the read image by the image sensor 14 are converted into the multi-value digital image data of three colors of red (R), green (G) and blue (B) by an A/D converter 21. Then, a shading correction circuit 22 performs a shading correction process for the converted multi-value digital image data. Since the image data after the shading correction are the data representing the intensity of the reflected light from the document, a log-conversion circuit 23 performs a log-conversion process for the image data, thereby converting them into the practical image density data. Thereafter, in order to remove the excessive black component and make real black image data, an under color removal and black adding circuit 24 generates black image data of black (K) in addition to the image data of R, G and B. Further, a masking process circuit 25 performs a masking process for the inputted image data of R, G, B and K, and then converts the image data of R, G and B into image data of yellow (Y), magenta (M) and cyan (C). Furthermore, a density correction circuit 26 performs a density correction process for the converted image data of Y, M and C including a multiplication with a predetermined coefficient, and then outputs the processed image data of Y, M, C and K. Finally, a spatial frequency correction circuit 27 corrects the spatial frequency of the inputted image data of Y, M, C and K, and then outputs the corrected image data of Y, M, C and K to the printer controller 201.

FIG. 8 is a schematic block diagram of the printer controller 201.

Referring to FIG. 8, the 8-bit image data outputted from the image signal processor 20 are fed to a first-in first-out memory 252 (referred to as an FIFO memory hereinafter) through an interface 251. The FIFO memory 252 is a line buffer memory which stores gradation data of an image having a predetermined number of lines in the main scan direction, is provided for absorbing a difference between the frequencies of an operation clock of the image reader 100 and an operation clock of the copying section 200. The data stored in the FIFO memory 252 are subsequently fed to a γ correction section 253. As described in detail later, the γ correction data stored in the data ROM 203 are transferred into the γ correction section 253 by the printer controller 201, and then the γ correction section 253 corrects the inputted image density data (ID) and also sends the corrected image density data to a digital to analog converter (referred to as a D/A converter hereinafter) 254. The D/A converter 254 converts the inputted image density digital data into an analog voltage signal. Thereafter, the analog voltage signal is amplified by an amplifier 255*a* and is inputted to a gain switching section 255. The gain switching section 255 attenuates the inputted analog voltage signal with a gain (defined as a gain including a gain of the amplifier 255*a* and an attenuation factor of the gain switching section 255) set by the printer controller 201, wherein switches SW1 to SW8 of the gain switching section 255 corresponding to different power levels P1 to P8 are switched over according to a gain switch signal outputted from a gain switch (SW) signal generator 256, thereby switching the gain of the inputted analog voltage signal. The analog voltage signal outputted from the gain switching section 255 is outputted to the laser driver 263 through the driving I/O 261, so that the laser diode 264 is driven to emit a beam of laser light having its intensity corresponding to the level of the inputted analog voltage signal.

Meanwhile, the printer controller 201 transmits a switching signal corresponding to a duty ratio, which is described in detail later, to a light emitting signal generator 265. The light emitting signal generator 265 transmits the light emitting signal in synchronous with a clock signal through a parallel I/O 262 to the laser diode driver 263, wherein the light emitting signal is switched according to the switching signal outputted from the printer controller 201. The light emitting signal generated by the light emitting signal generator 265 is generated based on the clock having a duty ratio corresponding to the clock switching signal. The laser driver 263 generates a driving current to be supplied to the laser diode 264 only when the laser driver 263 receives the light emitting signal. Accordingly, the duty ratio is switched by the light emitting signal (or light emitting clock signal). When the light emitting signal is outputted, the laser driver 263 outputs the analog driving signal inputted through the driving I/O 261, to the semiconductor laser diode 264, thereby driving the same.

(c) Gradation characteristic

In the case of copying half-tone images, gradation characteristic must be taken into consideration. In general, a reading density level (refereed to as an input level hereinafter) OD (original density) of the document image to be reproduced is not precisely in linearly direct proportion to a light emitting intensity level of a beam of laser light emitted from the laser diode 264 (or a reproduced image density level) ID, which is caused due to various kinds of factors such as the photoconductive characteristic of photoconductor drum 41, the characteristics of the toners of the developing units 45*a* to 45*d*, the environment in which the digital color copying machine is used, and the like. This non-linear relationship leads to a characteristic B, which is deviated from a linear characteristic A that should be properly obtained, as shown in the upper right chart of FIG. 9. Such a characteristic B is commonly called a γ characteristic (or gradation characteristic), which leads to deterioration in the fidelity of the reproduced images of, in particular, half-tone images. In order to dissolve the above problem, in the present preferred embodiment, the output power P characteristic of the semiconductor laser diode 264 is previously controlled by the γ correction section 253 according to an exposure correction characteristic in the lower right chart of FIG. 9, resulting in the above-mentioned linear characteristic A. This correction process is called a gradation correction or so-called γ correction. In other words, the output power P of the laser diode 264 is increased at a low gradation image, while the output power P thereof is decreased at a high gradation image, so that the density of the reproduced image becomes in proportion to the gradation data.

Figure 9:
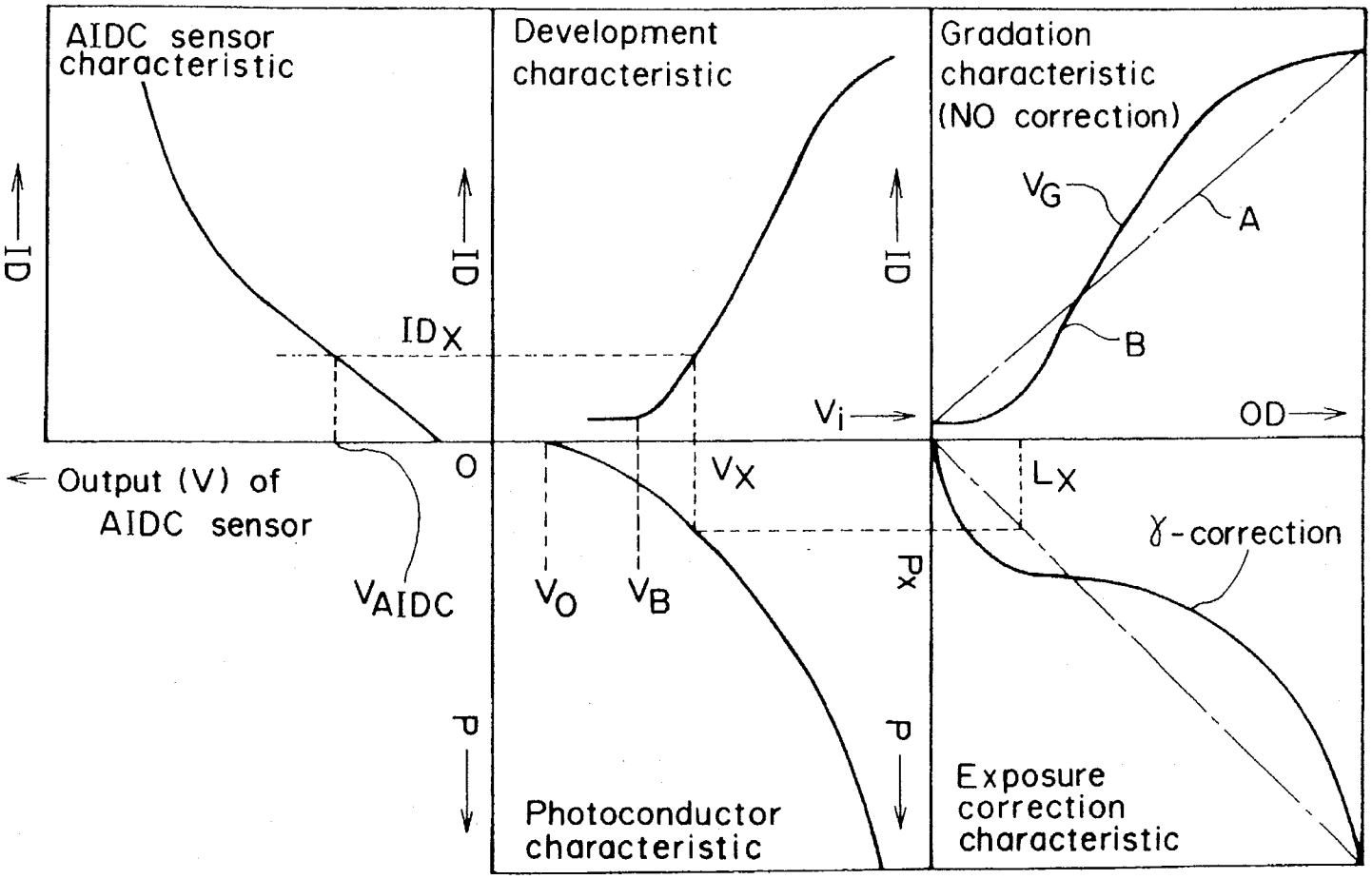
FIG. 9 is a graph showing characteristics of electrophotographic processes of the digital color copying machine shown in FIG. 1.

As shown in the photoconductor characteristic in the lower left chart of FIG. 9, an attenuated voltage Vi of the photoconductive drum 41 changes non-linearly according to the output power P of the laser diode 264. The toner adheres onto the photoconductive drum 41 under a condition of $Vi<V_B$, and the adhesion amount of the toner changes non-linearly as shown in the development characteristic in the upper left chart of FIG. 9.

(d) Automatic image density control

Figure 10:
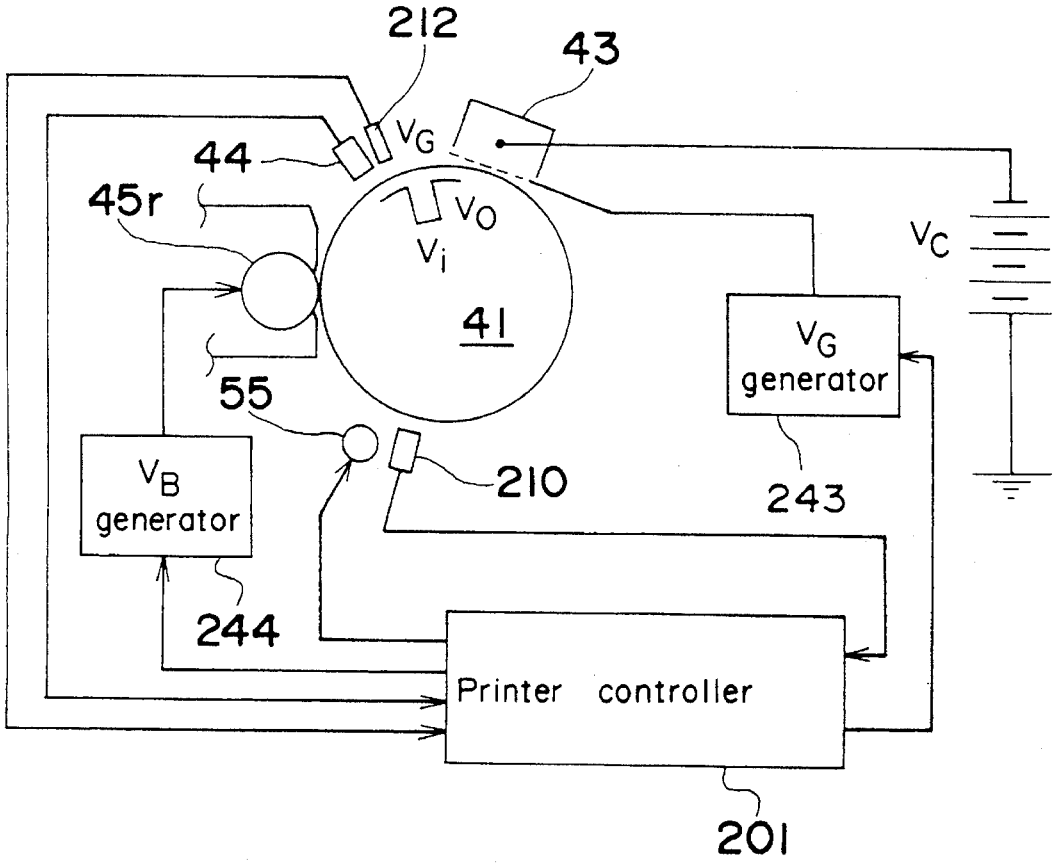
FIG. 10 is a schematic block diagram showing an arrangement of a corona charger and an developing unit provided around the photoconductive drum shown in FIG. 1.

FIG. 10 schematically illustrates the arrangement of the corona charger 43 and developing units 45*r* (one of 45*a* to 45*d*) provided around the photoconductive drum 41. In this arrangement, the corona charger 43 having a discharge voltage Vc is disposed opposite to the photoconductive drum 41. The grid of the corona charger 43 has a negative grid voltage $V_G$ applied by the $V_G$ generator 243. Since the relation between the grid voltage $V_G$ and the surface voltage Vo of the photoconductive drum 41 can be considered as approximately $Vo=V_G$, the surface voltage Vo of the photoconductive drum 41 can be controlled by the grid voltage $V_G$. In addition, the surface voltage Vo is detected by the voltage sensor 44, which is a surface voltage meter.

First of all, prior to the exposure of a beam of laser light onto the photoconductive drum 41, the photoconductive drum 41 is applied a negative surface voltage Vo by the corona charger 43, while a roller of the developing unit 45r is applied a low level negative development bias voltage $V_B$ (where $|V_B|<|Vo|$) by the $V_B$ generator 244. Accordingly, the surface voltage of the development sleeve of the developing unit 45r becomes equal to the development bias voltage $V_B$. The voltage at the exposure position on the photoconductive drum 41 lowers due to the exposure of a beam of laser light, and then it transits from surface voltage Vo to an attenuated voltage Vi of the electrostatic latent image. When the attenuated voltage Vi becomes lower than the development bias voltage $V_B$, the toner having negative electric charges carried up onto the sleeve surface of the developing unit 45r adheres onto the photoconductive drum 41.

The difference between the surface voltage Vo and the development bias voltage $V_B$ should neither be excessively large nor excessively small. The larger the development voltage $\Delta V=|V_B-Vi|$, the more the toner adhesion amount. On the other hand, the attenuated voltage Vi changes as the surface voltage Vo changes, even if the exposure amount of a beam of laser light is not changed. Thus, if the surface voltage Vo and the development bias voltage $V_B$ are changed while the difference between the surface voltage Vo and the development bias voltage $V_B$ is maintained within a certain range, for example, while the difference therebetween is kept approximately constant, then the difference between the development bias voltage $V_B$ and the attenuated voltage Vi may change so that the toner adhesion amount can be changed, thereby allowing the image density of the adhering toner to be controlled.

The toner adhesion amount of a reference toner image developed under an exposure having a predetermined light amount P in a predetermined region on the photoconductive drum 41 is optically detected by the AIDC sensor 210. In more detail, the reference toner image which serves as the reference for the image density control of the photoconductive drum 41 is formed, and a beam of laser light is projected onto the reference toner image, diagonally or at an inclined angle thereto, so as to allow the AIDC sensor 210 disposed near the photoconductive drum 41 to detect the normal reflected light of the reference toner image and the scattered reflected light thereof. These two detection signals representing the levels of the normal reflected light and the scattered reflected light are fed to the printer controller 201, where the toner adhesion amount is determined from the difference between the two detection signals.

Figure 36:
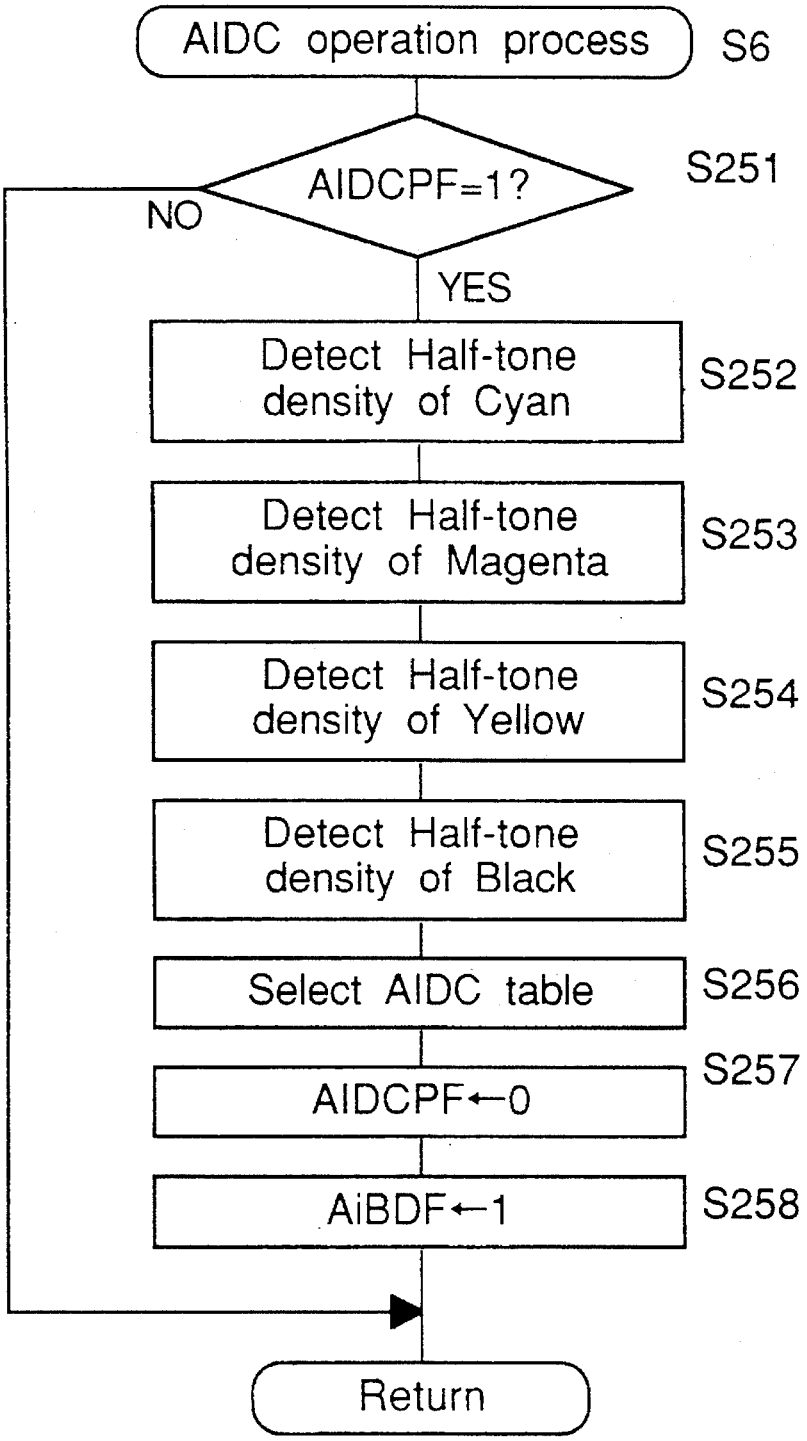
FIG. 36 is a flowchart of an AIDC operation process shown in FIG. 30.

Accordingly, changing the surface voltage Vo and the development bias voltage $V_B$ in accordance with the detection value of the AIDC sensor 210 makes it possible to implement the automatic image density control (AIDC), by which the toner adhesion amount at the maximum density level is kept constant as shown in "an AIDC operation process" of FIG. 36. Whereas the attenuation characteristic of the toner charging amount changes due to changes in environments such as the photoconductor sensitivity of the photoconductive drum 41 and the relative humidity, it is possible to automatically maintain the maximum image density constant by changing both the surface voltage Vo and the development bias voltage $V_B$. Therefore, in the present preferred embodiment, it is arranged that the development bias voltage $V_B$ and the grid voltages $V_G$ have one-to-one correspondence, where a set of ($V_B$, $V_G$) is changed in accordance with the density detection level LBA of 0 through 15, which correspond to the detection value detected by the AIDC sensor 210.

Table 1 lists exemplary data of sets of ($V_B$, $V_G$) which have been set in such a manner. Further, Tables 2 and 3 show a $V_B$ output table and a $V_G$ output table, respectively, where the grid voltage $V_G$ and the development bias voltage $V_B$ are changed with a step of 20 V. Each detection value detected by the AIDC sensor 210 is determined among the levels LBA 0 through 15, listed in the left-hand column according to the level of the detection value, where the development bias voltage $V_B$ changes from 220 V up to 820 V with a step of 20 V. The grid voltage $V_G$ is held to be 180 V greater than the development bias voltage $V_B$, and then the grid voltage $V_G$ changes from 400 V up to 1000 V. In addition, variations of sets of ($V_G$, $V_B$) may properly be determined depending on the preciseness of the control.

TABLE 1

AIDC Table

| No. | AIDC sensor output Vs (V) | Grid voltage $V_G$ (V) | Bias voltage $V_B$ (V) | γ correction table (gradation correction table) |
|---|---|---|---|---|
| 0 | 2.91~1 | −400 | −220 | 1 |
| 1 | ~2.9 | −440 | −260 | 2 |
| 2 | ~2.8 | −480 | −300 | 3 |
| 3 | ~2.7 | −520 | −340 | 4 |
| 4 | ~2.6 | −560 | −380 | 5 |
| 5 | ~2.5 | −600 | −420 | 6 |
| 6 | ~2.4 | −640 | −460 | 7 |
| 7 | ~2.3 | −680 | −500 | 8 |
| 8 | ~2.2 | −720 | −540 | 9 |
| 9 | ~2.1 | −760 | −580 | 10 |
| 10 | ~2.0 | −800 | −620 | 11 |
| 11 | ~1.9 | −840 | −660 | 12 |
| 12 | ~1.8 | −880 | −700 | 13 |
| 13 | ~1.7 | −920 | −740 | 14 |
| 14 | ~1.6 | −960 | −780 | 15 |
| 15 | ~1.5 | −1000 | −820 | 16 |

TABLE 2

Development Bias voltage $V_B$ Table

| No. | STEP 0 | 1 | 2 | 3 | 4 | OUTPUT VOLTAGE $V_B$ (V) |
|---|---|---|---|---|---|---|
| 0 | 0 | 0 | 0 | 0 | 0 | −200 |
| 1 | 1 | 0 | 0 | 0 | 0 | −220 |
| 2 | 0 | 1 | 0 | 0 | 0 | −240 |
| 3 | 1 | 1 | 0 | 0 | 0 | −260 |
| 4 | 0 | 0 | 1 | 0 | 0 | −280 |
| 5 | 1 | 0 | 1 | 0 | 0 | −300 |
| 6 | 0 | 1 | 1 | 0 | 0 | −320 |
| 7 | 1 | 1 | 1 | 0 | 0 | −340 |
| 8 | 0 | 0 | 0 | 1 | 0 | −360 |
| 9 | 1 | 0 | 0 | 1 | 0 | −380 |
| 10 | 0 | 1 | 0 | 1 | 0 | −400 |
| 11 | 1 | 1 | 0 | 1 | 0 | −420 |
| 12 | 0 | 0 | 1 | 1 | 0 | −440 |
| 13 | 1 | 0 | 1 | 1 | 0 | −460 |
| 14 | 0 | 1 | 1 | 1 | 0 | −480 |
| 15 | 1 | 1 | 1 | 1 | 0 | −500 |
| 16 | 0 | 0 | 0 | 0 | 1 | −520 |
| 17 | 1 | 0 | 0 | 0 | 1 | −540 |
| 18 | 0 | 1 | 0 | 0 | 1 | −560 |
| 19 | 1 | 1 | 0 | 0 | 1 | −580 |
| 20 | 0 | 0 | 1 | 0 | 1 | −600 |
| 21 | 1 | 0 | 1 | 0 | 1 | −620 |
| 22 | 0 | 1 | 1 | 0 | 1 | −640 |
| 23 | 1 | 1 | 1 | 0 | 1 | −660 |
| 24 | 0 | 0 | 0 | 1 | 1 | −680 |
| 25 | 1 | 0 | 0 | 1 | 1 | −700 |
| 26 | 0 | 1 | 0 | 1 | 1 | −720 |

TABLE 2-continued

| Development Bias voltage $V_B$ Table | | | | | | |
|---|---|---|---|---|---|---|
| No. | STEP 0 | 1 | 2 | 3 | 4 | OUTPUT VOLTAGE $V_B$ (V) |
| 27 | 1 | 1 | 0 | 1 | 1 | −740 |
| 28 | 0 | 0 | 1 | 1 | 1 | −760 |
| 29 | 1 | 0 | 1 | 1 | 1 | −780 |
| 30 | 0 | 1 | 1 | 1 | 1 | −800 |
| 31 | 1 | 1 | 1 | 1 | 1 | −820 |

TABLE 3

| Grid Voltage $V_G$ Output Table | | | | | | |
|---|---|---|---|---|---|---|
| No. | STEP 0 | 1 | 2 | 3 | 4 | OUTPUT VOLTAGE $V_G$ (V) |
| 0 | 0 | 0 | 0 | 0 | 0 | −380 |
| 1 | 1 | 0 | 0 | 0 | 0 | −400 |
| 2 | 0 | 1 | 0 | 0 | 0 | −420 |
| 3 | 1 | 1 | 0 | 0 | 0 | −440 |
| 4 | 0 | 0 | 1 | 0 | 0 | −460 |
| 5 | 1 | 0 | 1 | 0 | 0 | −480 |
| 6 | 0 | 1 | 1 | 0 | 0 | −500 |
| 7 | 1 | 1 | 1 | 0 | 0 | −520 |
| 8 | 0 | 0 | 0 | 1 | 0 | −540 |
| 9 | 1 | 0 | 0 | 1 | 0 | −560 |
| 10 | 0 | 1 | 0 | 1 | 0 | −580 |
| 11 | 1 | 1 | 0 | 1 | 0 | −600 |
| 12 | 0 | 0 | 1 | 1 | 0 | −620 |
| 13 | 1 | 0 | 1 | 1 | 0 | −640 |
| 14 | 0 | 1 | 1 | 1 | 0 | −660 |
| 15 | 1 | 1 | 1 | 1 | 0 | −680 |
| 16 | 0 | 0 | 0 | 0 | 1 | −700 |
| 17 | 1 | 0 | 0 | 0 | 1 | −720 |
| 18 | 0 | 1 | 0 | 0 | 1 | −740 |
| 19 | 1 | 1 | 0 | 0 | 1 | −760 |
| 20 | 0 | 0 | 1 | 0 | 1 | −780 |
| 21 | 1 | 0 | 1 | 0 | 1 | −800 |
| 22 | 0 | 1 | 1 | 0 | 1 | −820 |
| 23 | 1 | 1 | 1 | 0 | 1 | −840 |
| 24 | 0 | 0 | 0 | 1 | 1 | −860 |
| 25 | 1 | 0 | 0 | 1 | 1 | −880 |
| 26 | 0 | 1 | 0 | 1 | 1 | −900 |
| 27 | 1 | 1 | 0 | 1 | 1 | −920 |
| 28 | 0 | 0 | 1 | 1 | 1 | −940 |
| 29 | 1 | 0 | 1 | 1 | 1 | −960 |
| 30 | 0 | 1 | 1 | 1 | 1 | −980 |
| 31 | 1 | 1 | 1 | 1 | 1 | −1000 |

In principle, the AIDC process is most preferably effected just prior to the copying process from the standpoints of the control reliability and the control accuracy or preciseness. However, if this process was done every time prior to the copying process, the first copying operation would take a longer time. Moreover, the life of the photoconductor of the photoconductive drum 41 and the like would be reduced due to an increased number of times of the copying operations of the digital color copying machine.

The above-mentioned problems being taken account into consideration, in the present preferred embodiment, the AIDC operation timing is controlled in the following manner:

When the copying machine is powered ON, the charge wire is first of all cleaned immediately after the power-ON as shown in FIG. 3, and then an AIDC process is effected. This operation is carried out during the course of the warm-up operation of the fixing unit 47, so that the operation time of the first copying operation subsequent to power-ON can be reduced.

Figure 39:
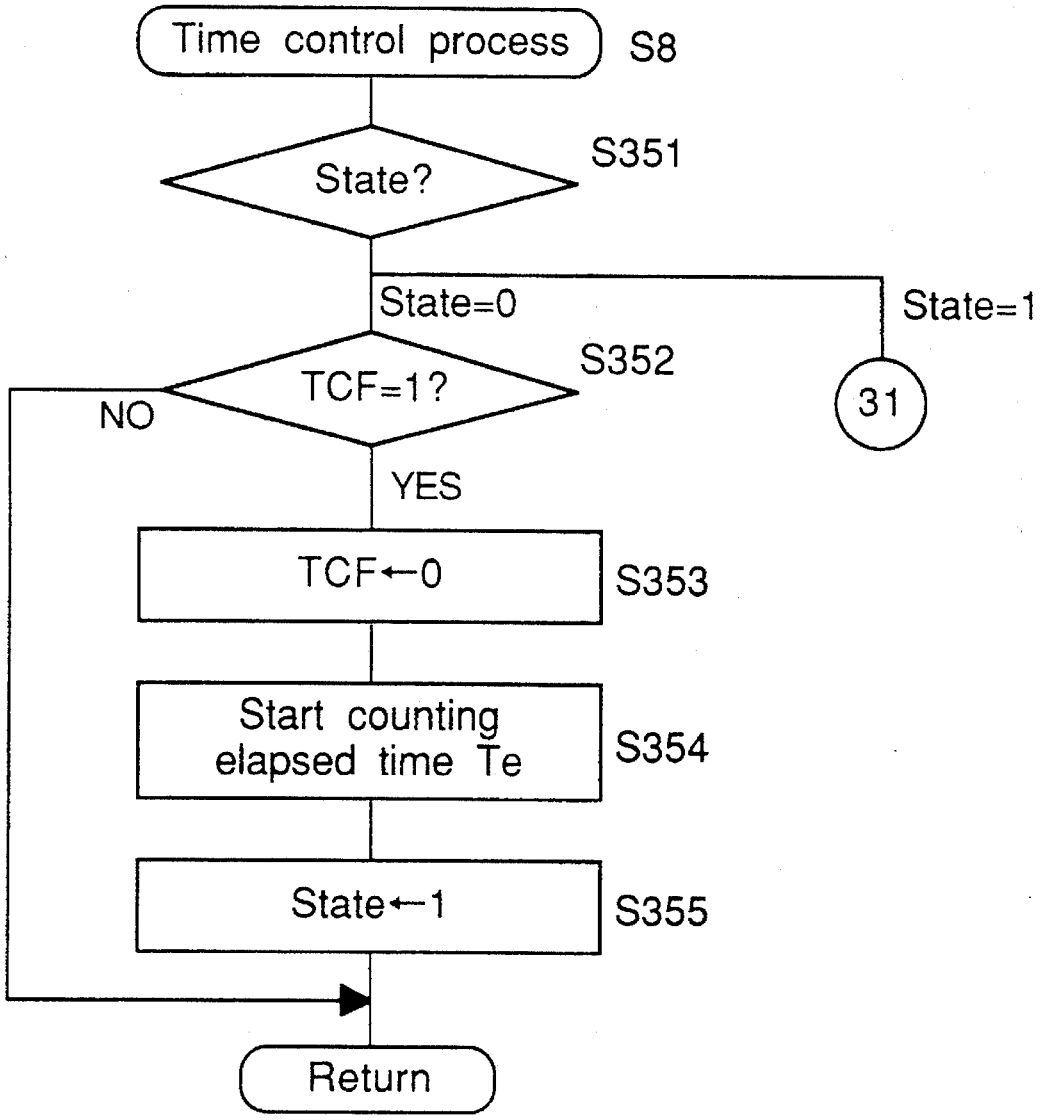
FIG. 39 is a flowchart of a first part of a time control process shown in FIG. 30.
Figure 40:
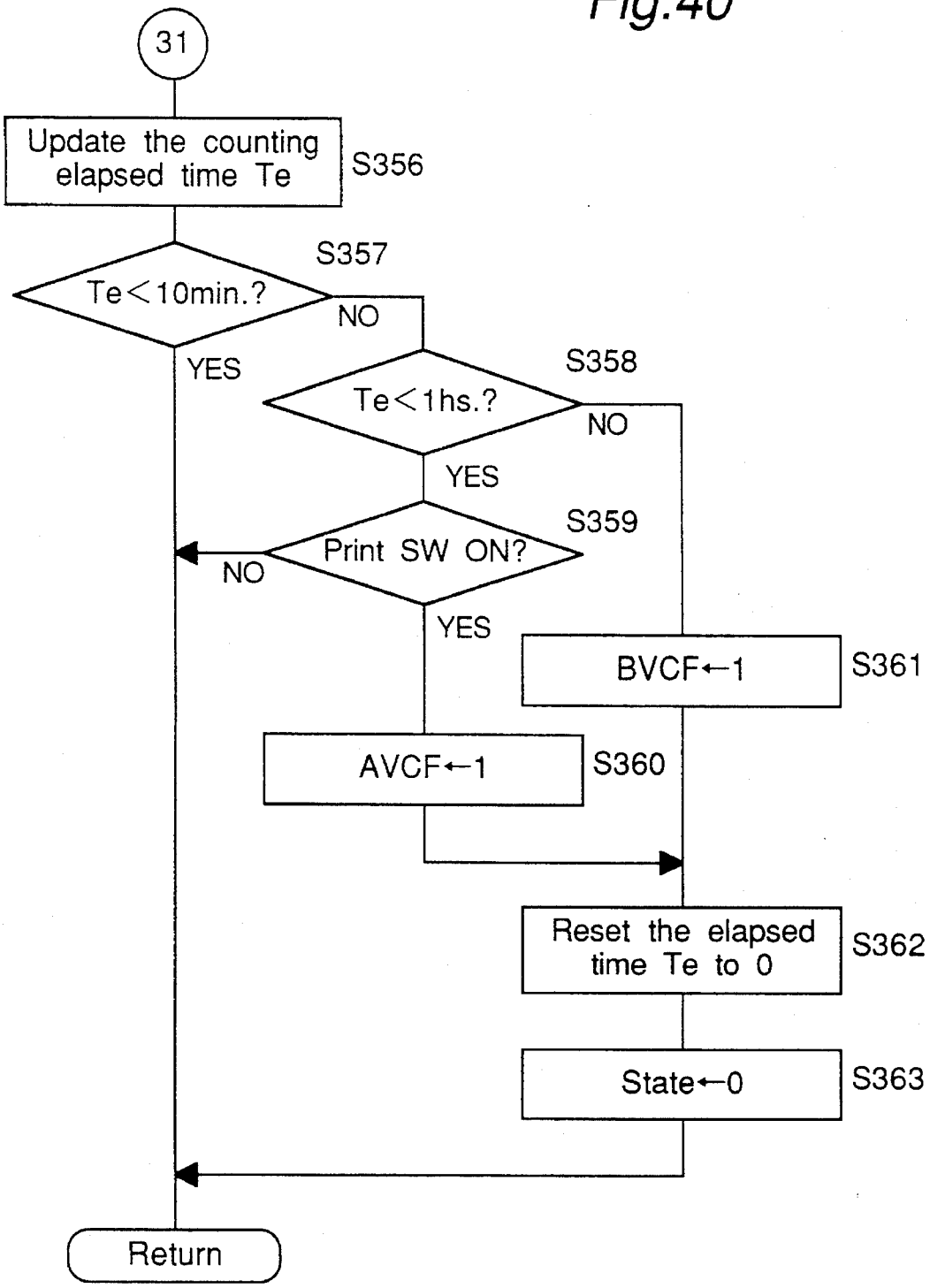
FIG. 40 is a flowchart of a second part of the time control process shown in FIG. 30.

In the case other than the above-mentioned cases, in view of the elapsed time and the environmental change from the preceding AIDC operation, the AIDC operation is carried out in the following manner, provided that the timer is reset and then information data of the current environments such as the temperature, the humidity or the like is stored at a timing of the preceding AIDC operation:

(1) If the elapsed time from the preceding AIDC operation to the succeeding copying operation as shown in "a time control process" of FIGS. 39 and 40 is
  (1-a) less than 10 minutes, the AIDC operation is not effected;
  (1-b) not less than 10 minutes and less than 60 minutes, the AIDC operation is effected after the copying process is completed; and
  (1-c) not less than 60 minutes, the AIDC operation is effected prior to the copying process.

Figure 41:
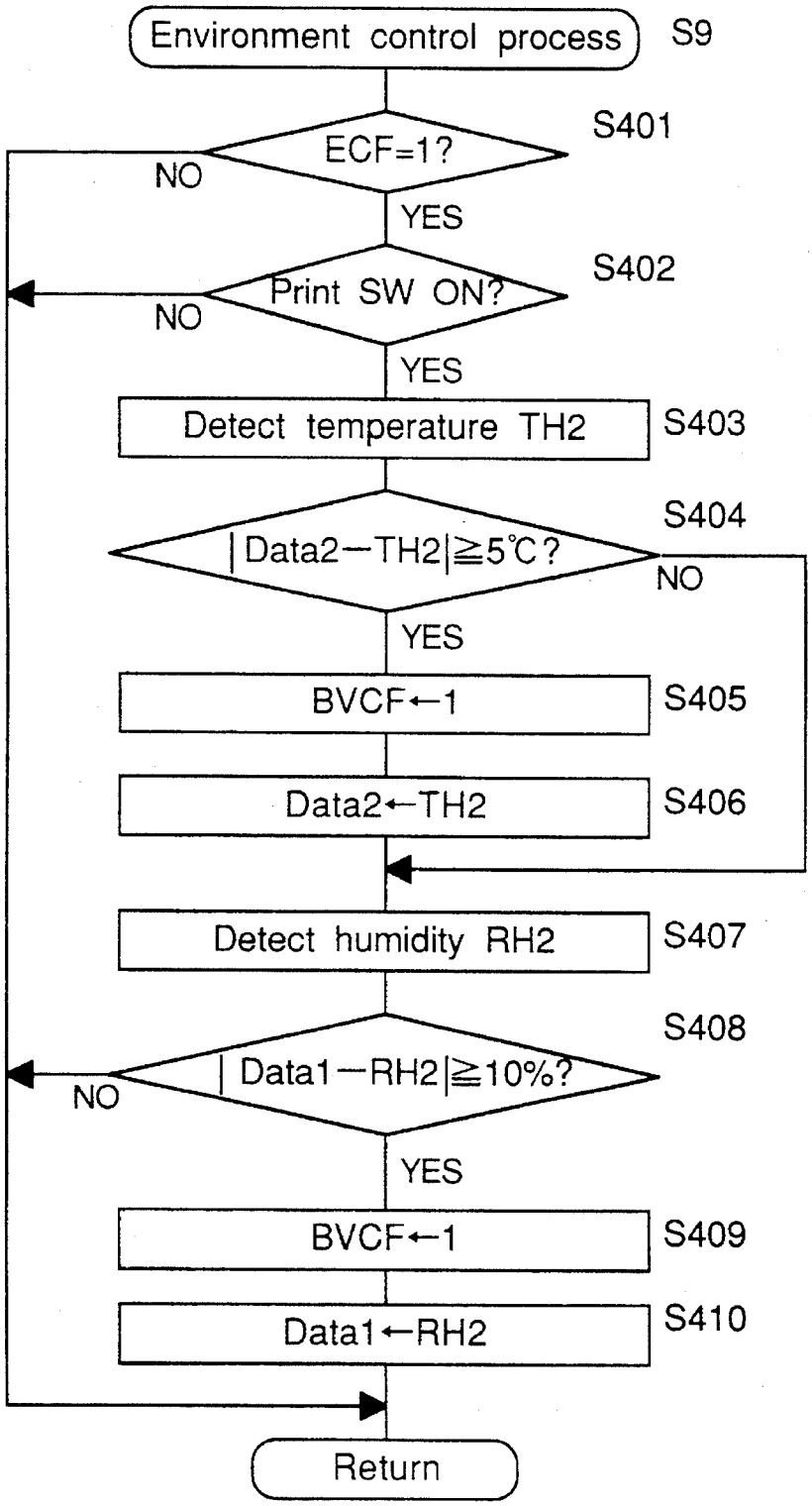
FIG. 41 is a flowchart of an environment control process shown in FIG. 30.

(2) If the environmental,change between the preceding AIDC operation and the succeeding copying operation as shown in "an environment control process" of FIG. 41 is
  a temperature change of 5° C. or more or a humidity change of 10% RH or more, the AIDC operation is effected before the copying process.

As described above, by controlling the timing of AIDC operations, it is effectuated to reduce the number of times of before-copying operations and to prolong the life of expendable supplies such as photoconductor of the photoconductive drum 41, the dyes, and the toners of the developing units 45*a* to 45*d*.

It is noted that the settings of the timer and environmental variations are not limited to the above, they may be changed depending on the characteristics of the expendable supplies and others.

(e) Accuracy enhancement of automatic image density control

In this section, there will be described with respect to detections of the dark-part voltage Vo and the bright-part voltage Vi of the surface voltage of the photoconductive drum 41 prior to the AIDC operation, and correction of the grid voltage $V_G$ and the maximum light amount.

Figure 11:
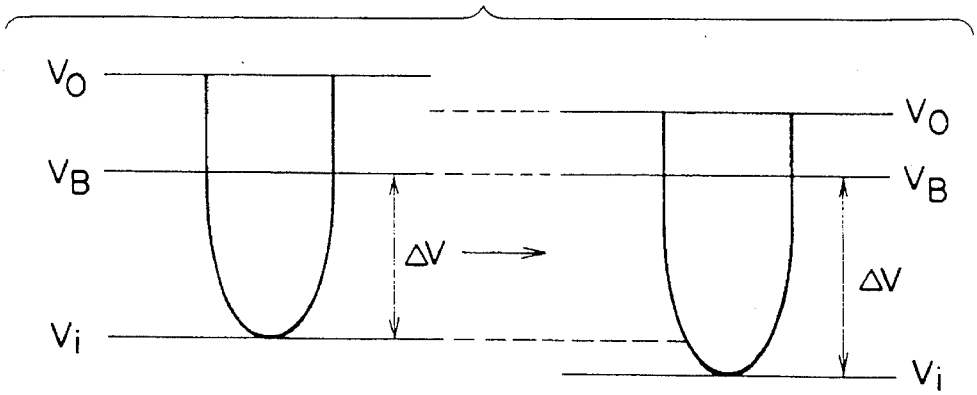
FIG. 11 is a schematic diagram showing an influence into a developing voltage when a surface voltage is changed in the digital color copying machine shown in FIG. 1.

As described earlier, density detection and control by AIDC operations are carried out in the following manner. That is, there is detected the toner adhesion amount of the predetermined reference toner image formed on the photoconductive drum 41, using the reference grid voltage $V_G$, the development bias voltage $V_B$, and the exposure amount. Thereafter, a set of (grid voltage $V_G$, and development bias voltage $V_B$) are changed in accordance with the resulting detection value of the toner adhesion amount, thereby controlling the toner adhesion amount. In this process, the value of surface voltage Vo for the reference grid voltage $V_G$ changes depending on any sensitivity change of the photoconductor of the photoconductive drum 41 due to its environment, dirts of the corona charger 43, and the like. Therefore, even if the same voltages $V_G$ and $V_B$ and the exposure amount are given, $\Delta V=|V_B-Vi|$ changes such that the resulting toner adhesion amount changes as shown in FIG. 11.

Figure 12:
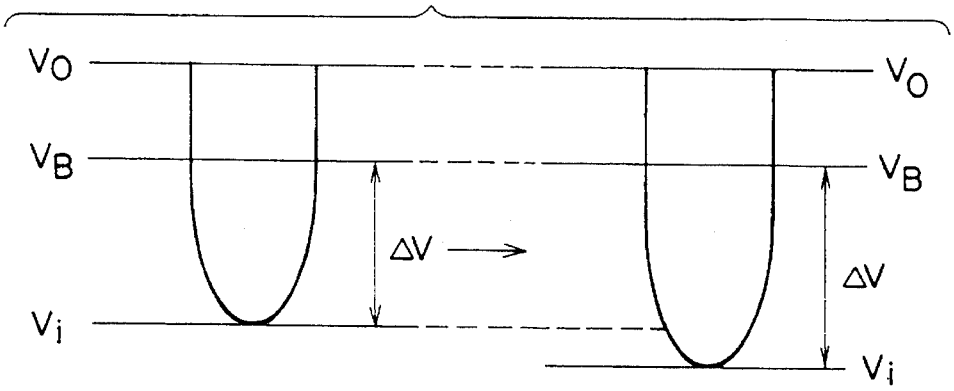
FIG. 12 is a schematic diagram showing an influence into a developing voltage when an electrostatic latent image voltage is changed in the digital color copying machine shown in FIG. 1.
Figure 13:
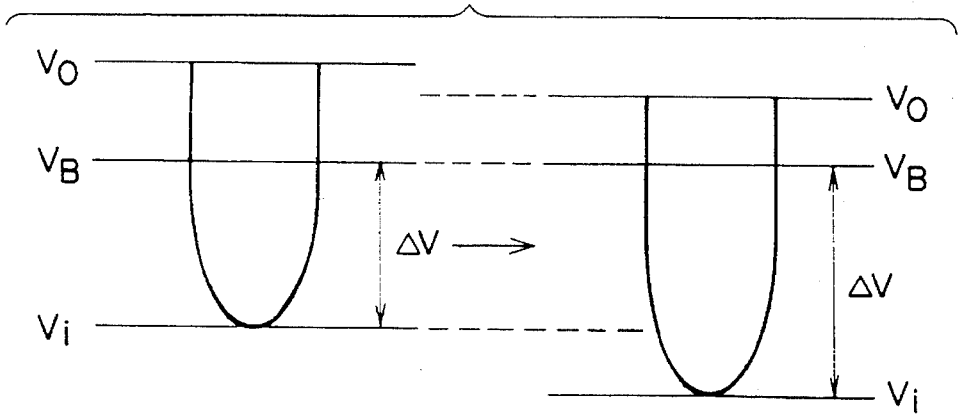
FIG. 13 is a schematic diagram showing an influence into a developing voltage when both a surface voltage and a latent image voltage are changed in the digital color copying machine shown in FIG. 1.

On the other hand, the bright-part voltage Vi also changes depending on any sensitivity change of the photoconductor of the photoconductive drum 41 due to any effect of its environments, duration and the like. Accordingly, even if the same voltages $V_G$ and $V_B$ and exposure amount are given, $|V_B-Vi|$ changes so that the resulting toner adhesion amount also changes as shown in FIG. 12. Naturally, when both the dark-part voltage Vo and the bright-part voltage Vi have changed, both the absolute value voltage $|V_B-Vi|$ and the toner adhesion amount further changes as shown in FIG. 13. On account of these possibilities, it is impossible to detect the toner adhesion amount on the assumption of a constant voltage $|V_B-Vi|$, which is a precondition for the toner adhesion amount by the AIDC process. Then, this leads to a lower accuracy in the automatic density control of the maximum density level.

For these reasons, the dark-part voltage Vo and the bright-part voltage Vi when forming the predetermined reference toner image are required to be maintained constant under any conditions in order to attain accurate automatic density control by the AIDC sensor 210. Thus, detections of the dark-part voltage Vo and the bright-part voltage Vi and correction of the grid voltage $V_G$ and the maximum light amount prior to the AIDC operation improves the accuracy or the preciseness of the automatic density control using the AIDC sensor 210. Below described is an actual example.

Figure 14:
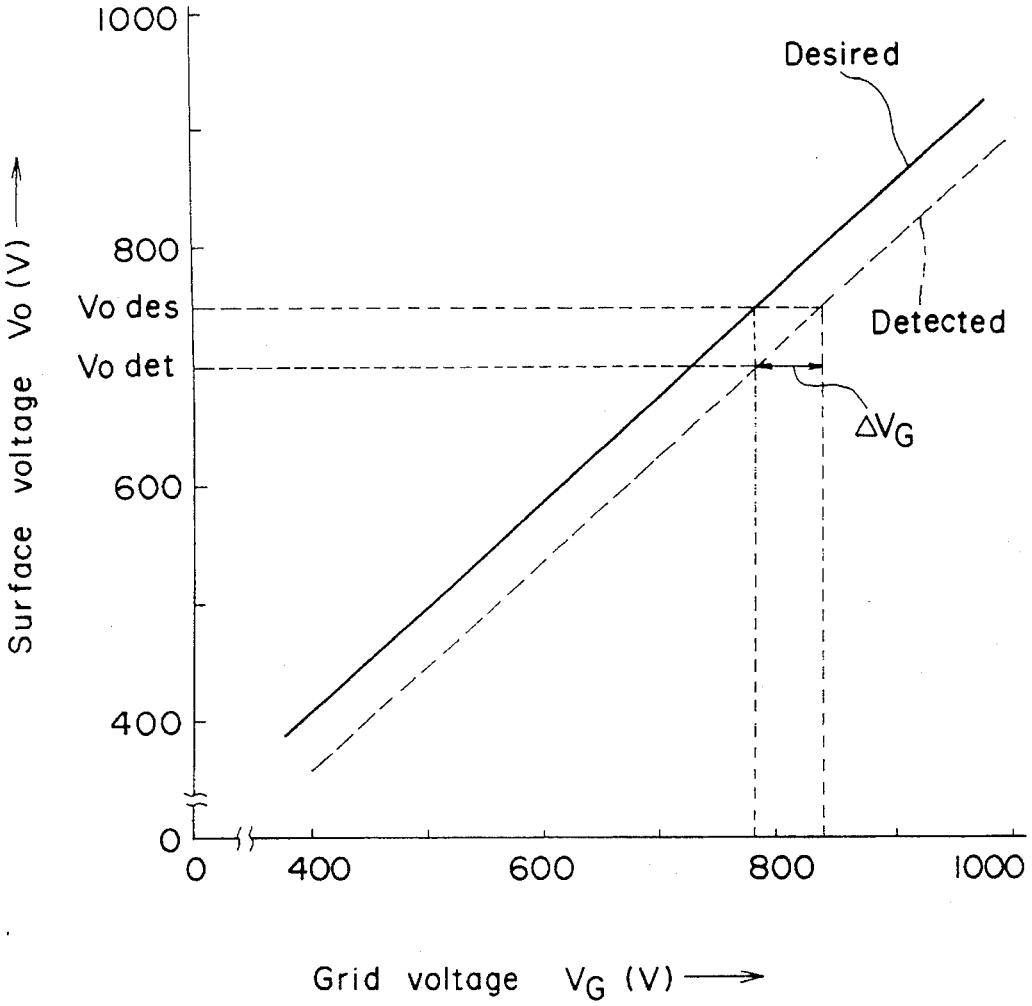
FIG. 14 is a graph showing a relationship between a grid voltage $V_G$ and a surface voltage Vo.
Figure 15:
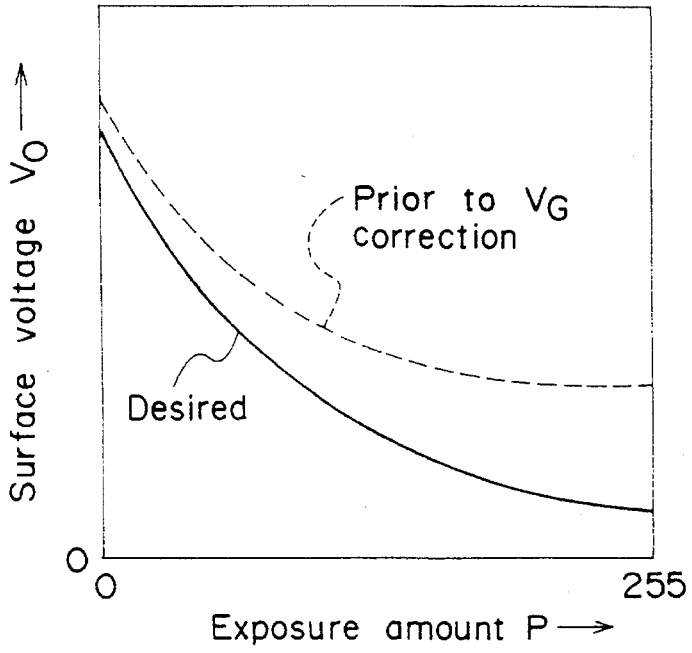
FIG. 15 is a graph showing a surface voltage Vo characteristic on an exposure amount prior to a grid voltage $V_G$ correction.
Figure 16:
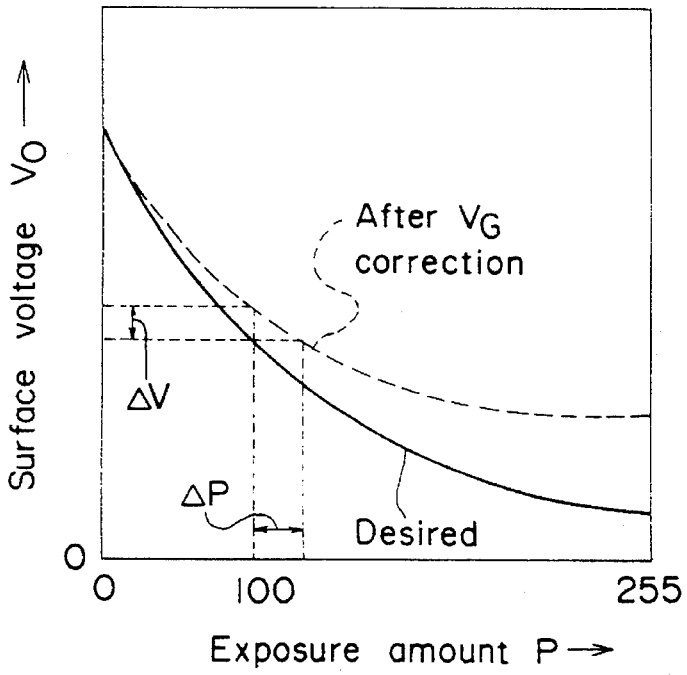
FIG. 16 is a graph showing a surface voltage Vo characteristic on the exposure amount after a grid voltage $V_G$ correction.
Figure 32:
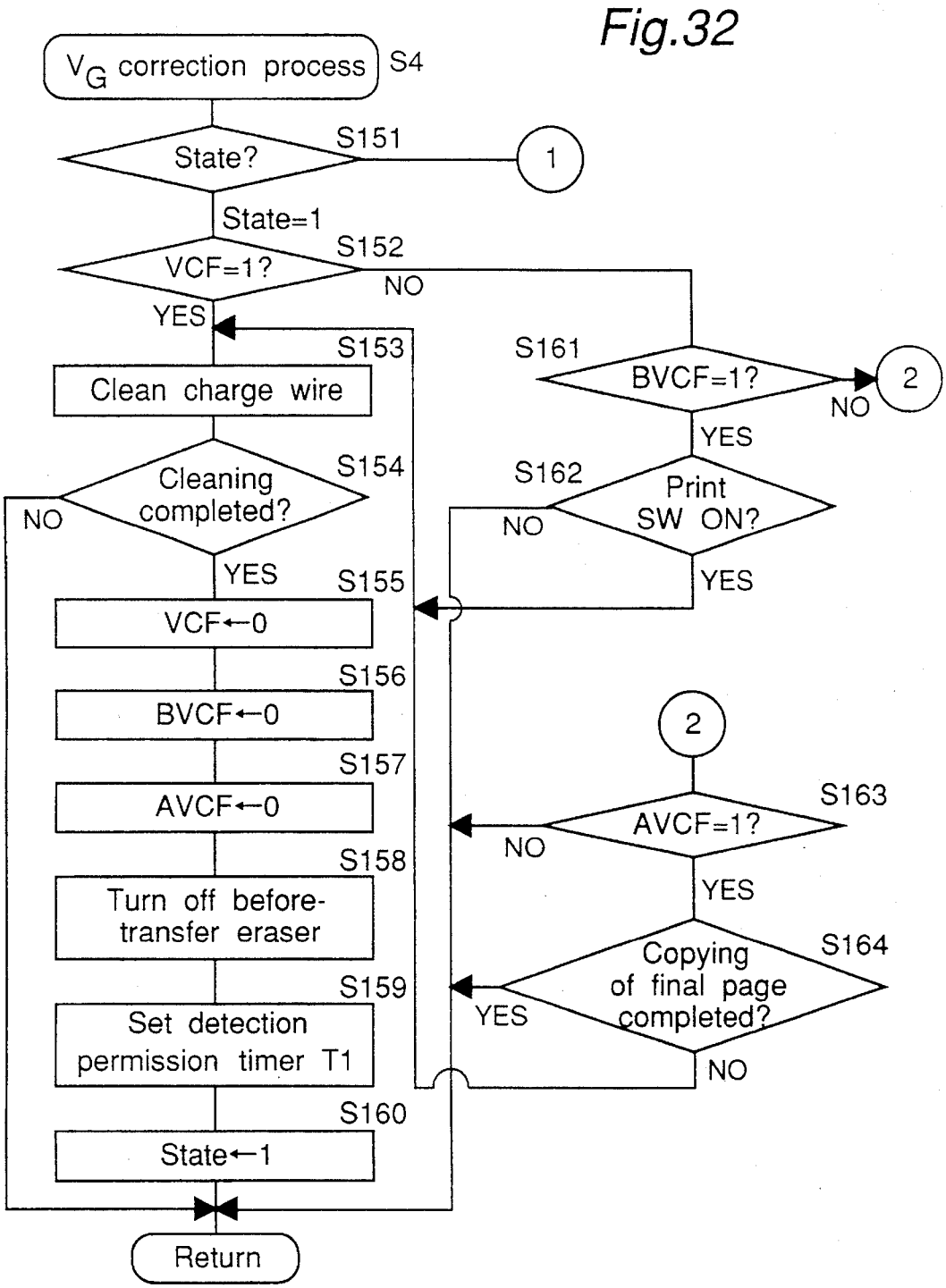
FIG. 32 is a flowchart of a first part of a $V_G$ correction process shown in FIG. 30.
Figure 33:
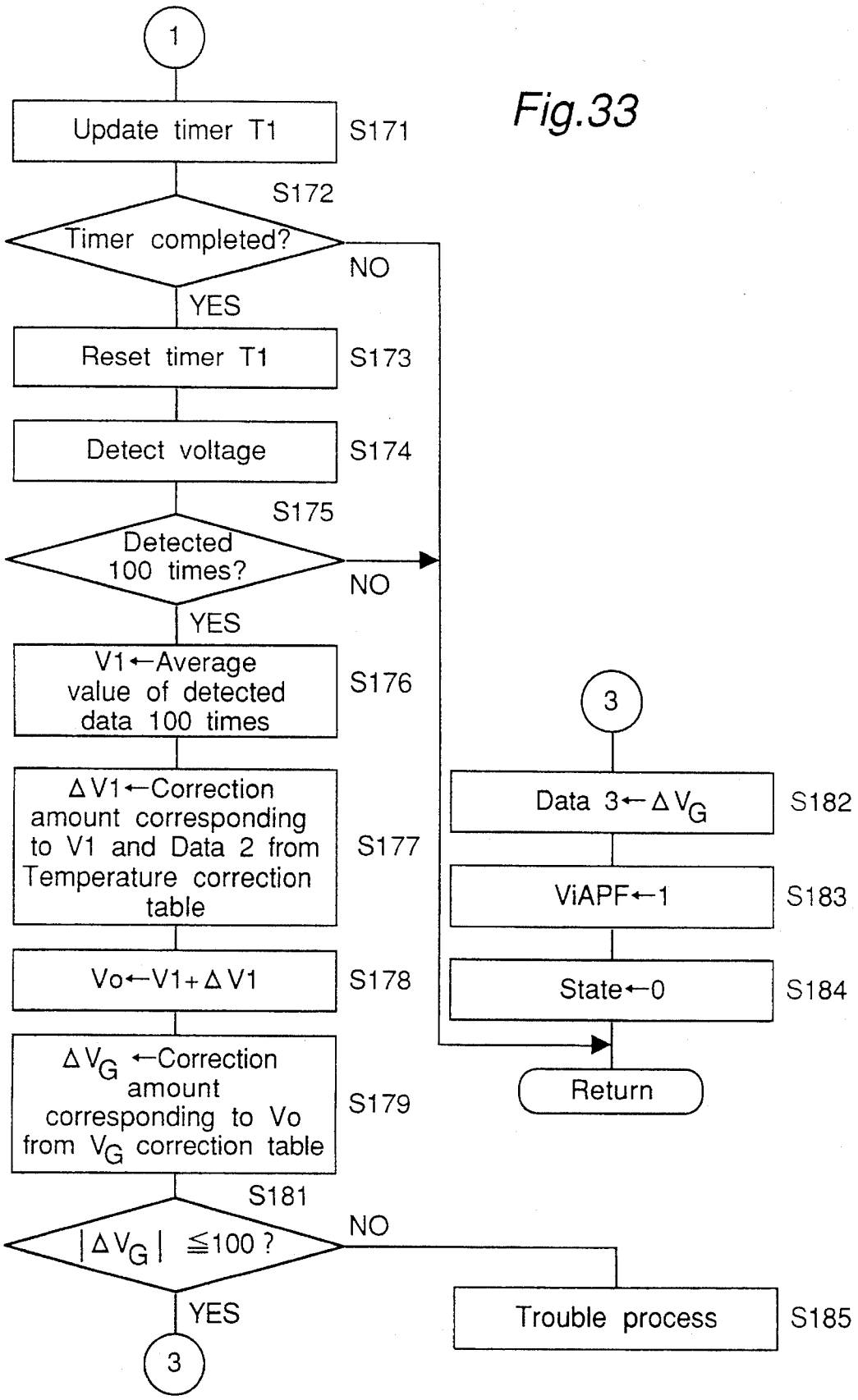
FIG. 33 is a flowchart of a second part of the $V_G$ correction process shown in FIG. 30.

First of all, prior to the density detection of a reference toner image which is carried out by the AIDC sensor 210, (FIG. 15 illustrating an example of the state prior to AIDC operation), the dark-part surface voltage Vo resulting when a predetermined grid voltage of −800 V (No. 21 of Table 3) is applied to the grid is measured by the voltage sensor 44. The reference grid voltage $V_G$ when detecting a surface voltage of the photoconductive drum 41 is assumed to be the same as the grid voltage $V_G$ used when forming a half-tone image for the AIDC detection. Thereafter, it is judged how the detected surface voltage Vo is deviated or shifted from the desired $V_G$–Vo characteristic, and then, a correction amount $\Delta V_G$ of the grid voltage $V_G$ is determined based on the $V_G$ correction table shown in Table 4 (See "a $V_G$ correction process" as shown in FIGS. 32 and 33). In the setting range of the grid voltage $V_G$ from 400 V to 1000 V in the present preferred embodiment, the detected $V_G$–Vo characteristic has the same inclination as that of the desired one but is shifted from the desired one, as is apparent from an example of FIG. 14. Accordingly, the $V_G$ correction amounts listed in the $V_G$ correction table shown in Table 4 are designed based on this characteristic variation. FIG. 16 shows a surface voltage Vo characteristic on the exposure amount P obtained when the grid voltage $V_G$ is corrected in such a manner and the dark-part voltage Vo is adjusted to a desired dark-part voltage Vo.

TABLE 4

Grid voltage $V_G$ correction Table

| Correction amount $\Delta V_G$ of grid voltage $V_G$ | Voltage sensor output (V) | Surface voltage $V_D$ (V) at developing position | Surface voltage Vo (V) at sensor position |
|---|---|---|---|
| +100 | ~3.54 | ~659 | ~709 |
| +80 | 3.55~ | 660~ | 710~ |
| +60 | 3.65~ | 680~ | 730~ |
| +40 | 3.75~ | 700~ | 750~ |
| +20 | 3.85~ | 720~ | 770~ |
| 0 | 3.95~ | 740~ | 790~ |
| −20 | 4.05~ | 760~ | 810~ |
| −40 | 4.15~ | 780~ | 830~ |
| −60 | 4.25~ | 800~ | 850~ |
| −80 | 4.35~ | 820~ | 870~ |
| −100 | 4.45~ | 840~ | 890~ |

As described above, after the grid voltage $V_G$ is corrected so that the dark-part voltage Vo is adjusted to a desired voltage Vo, the maximum light amount of a beam of laser light is corrected. In the present preferred embodiment, as shown in a laser power table of Table 5, the laser power of the laser diode 264 is set in a range of 0.70 mW/cm$^2$ to 2.25 mW/cm$^2$ with a step of 0.05 mW/cm$^2$. The maximum light amount of the laser diode 264 is selectively switched over so that one maximum light amount is selected among 256 steps (levels 0 through 255). In this case, in order to determine the voltage pattern for correcting the maximum light amount, a predetermined maximum light amount of 1.15 mW/cm$^2$ (No. 9 of Table 5) is selected from Table 5, and then, a beam of laser light having a middle light amount of level 100 which is determined from the maximum light amount thereof is projected onto the photoconductive drum 41 which has the corrected dark-part voltage Vo applied thereon. Then, a bright-part voltage Vi thereon is detected as a detected voltage ViA by the voltage sensor 44 as shown in FIG. 16.

Figure 17:
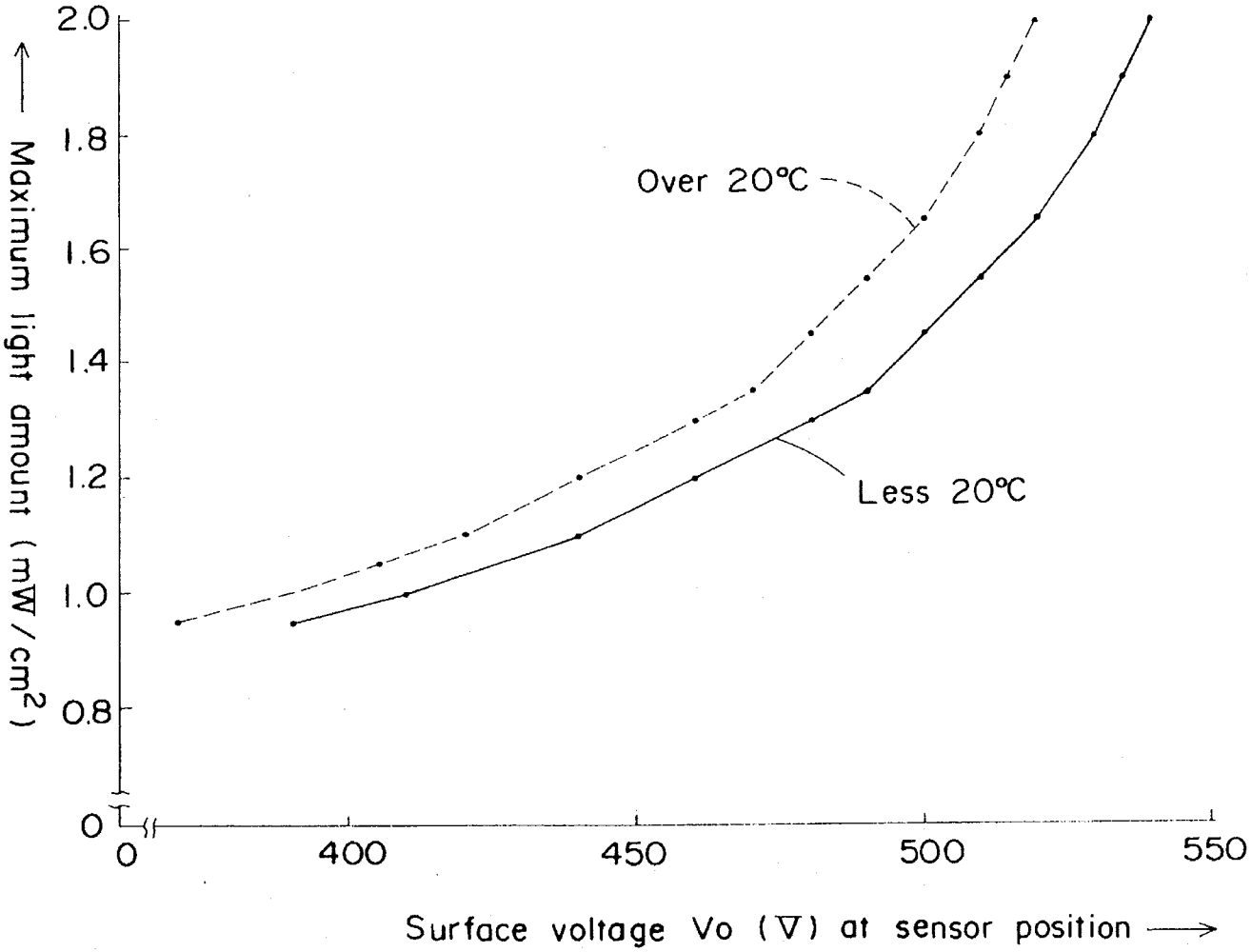
FIG. 17 is a graph showing a relationship between a maximum light amount to be set and a surface voltage ViA detected by a voltage sensor.
Figure 34:
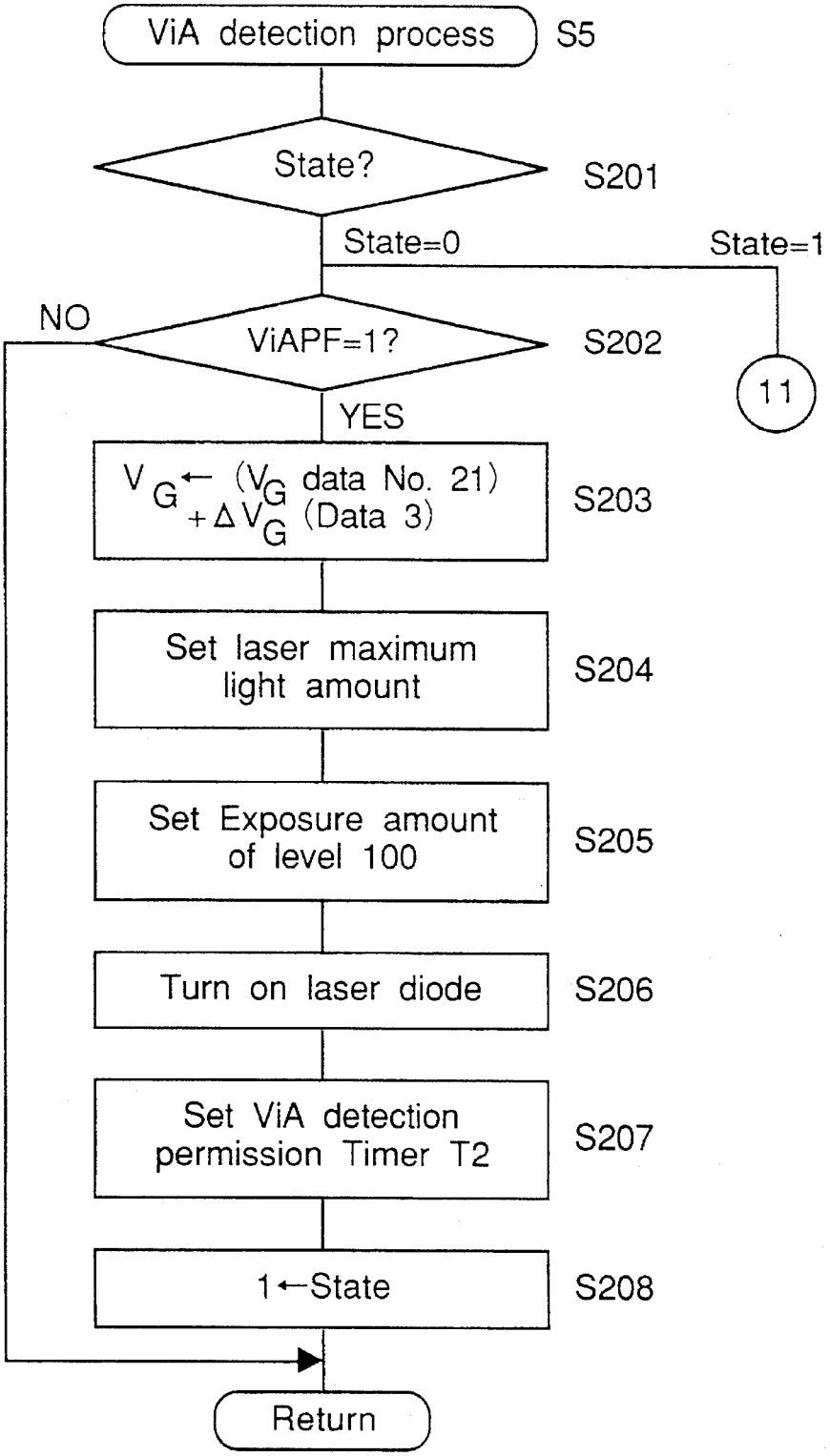
FIG. 34 is a flowchart of a first part of a ViA detection process shown in FIG. 30.

Thereafter, based on the resulting detected voltage ViA, the maximum light amount is corrected with reference to ViA correction tables for correcting the light amount shown in Tables 6 and 7 (See a detected voltage ViA detection process shown in FIGS. 34 and 35). In this case, the relationship between the detected voltage ViA and the. light amount to be set is shown in FIG. 17. Based on this relationship, the detected value ViA correction tables of Tables 6 and 7 are designed in the preferred embodiment.

Figure 18:
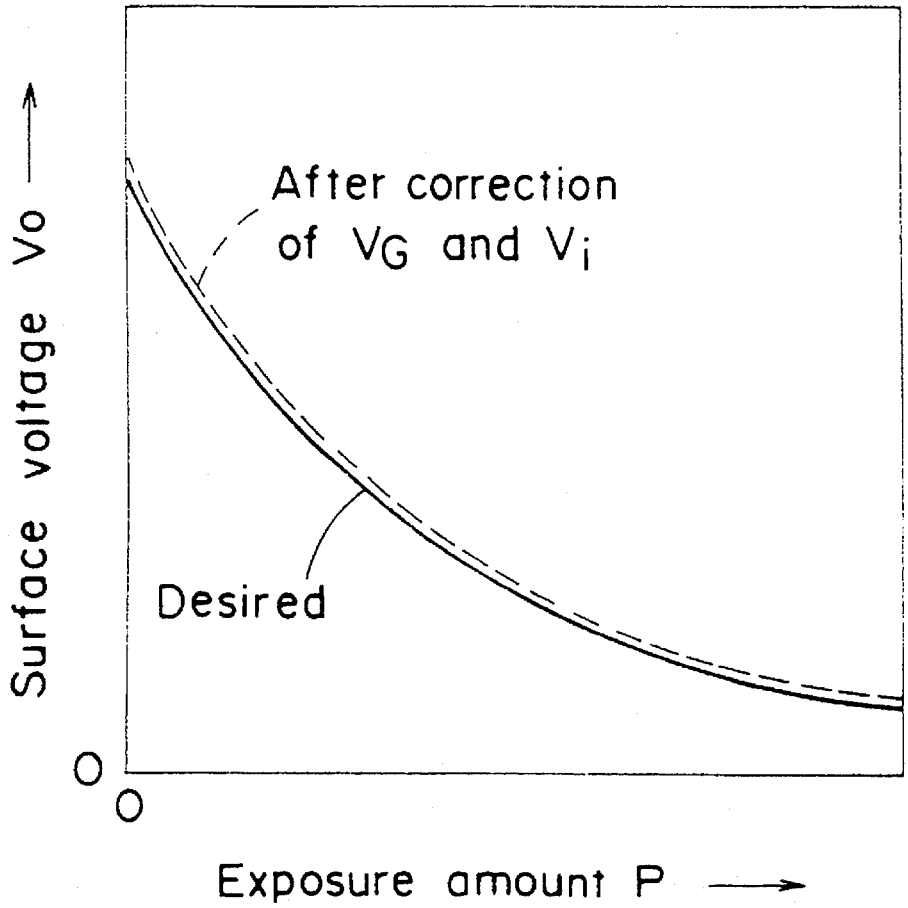
FIG. 18 is a graph showing a surface voltage Vo characteristic on the exposure amount after a correction of the grid voltage $V_G$ and the surface voltage Vo.

The above-mentioned $V_G$ correction and the maximum light amount correction are successively effected, thereby allowing the exposure characteristic to be made approximately coincident with the desired curve, as shown in FIG. 18.

In a continuous copying process or a multi-copying process for continuously performing a copying process for a plurality of pages or a plurality of copies, when the light amount is corrected using a large correction amount, this leads to a substantial change between the reproduced images before and after the correction thereof. Thus, in the present preferred embodiment, the change amount or the step amount of one step is set to a value of 0.05 mW/cm$^2$ so that no remarkable change in the reproduced image is caused, as shown in Table 5. Further, the time interval when detecting the surface voltage is set so that the light amount is not corrected by an amount larger than one step, in view of the change in the surface voltage of the photoconductive drum 41.

TABLE 5

Laser Power Table

| No. | STEP 0 | 1 | 2 | 3 | 4 | OUTPUT LASER POWER (mW/cm$^2$) |
|---|---|---|---|---|---|---|
| 0 | 0 | 0 | 0 | 0 | 0 | 0.70 |
| 1 | 1 | 0 | 0 | 0 | 0 | 0.75 |
| 2 | 0 | 1 | 0 | 0 | 0 | 0.80 |
| 3 | 1 | 1 | 0 | 0 | 0 | 0.85 |
| 4 | 0 | 0 | 1 | 0 | 0 | 0.90 |
| 5 | 1 | 0 | 1 | 0 | 0 | 0.95 |
| 6 | 0 | 1 | 1 | 0 | 0 | 1.00 |
| 7 | 1 | 1 | 1 | 0 | 0 | 1.05 |
| 8 | 0 | 0 | 0 | 1 | 0 | 1.10 |
| 9 | 1 | 0 | 0 | 1 | 0 | 1.15 |
| 10 | 0 | 1 | 0 | 1 | 0 | 1.20 |
| 11 | 1 | 1 | 0 | 1 | 0 | 1.25 |

TABLE 5-continued

| Laser Power Table | | | | | | |
|---|---|---|---|---|---|---|
| No. | STEP 0 | 1 | 2 | 3 | 4 | OUTPUT LASER POWER (mW/cm²) |
| 12 | 0 | 0 | 1 | 1 | 0 | 1.30 |
| 13 | 1 | 0 | 1 | 1 | 0 | 1.35 |
| 14 | 0 | 1 | 1 | 1 | 0 | 1.40 |
| 15 | 1 | 1 | 1 | 1 | 0 | 1.45 |
| 16 | 0 | 0 | 0 | 0 | 1 | 1.50 |
| 17 | 1 | 0 | 0 | 0 | 1 | 1.55 |
| 18 | 0 | 1 | 0 | 0 | 1 | 1.60 |
| 19 | 1 | 1 | 0 | 0 | 1 | 1.65 |
| 20 | 0 | 0 | 1 | 0 | 1 | 1.70 |
| 21 | 1 | 0 | 1 | 0 | 1 | 1.75 |
| 22 | 0 | 1 | 1 | 0 | 1 | 1.80 |
| 23 | 1 | 1 | 1 | 0 | 1 | 1.85 |
| 24 | 0 | 0 | 0 | 1 | 1 | 1.90 |
| 25 | 1 | 0 | 0 | 1 | 1 | 1.95 |
| 26 | 0 | 1 | 0 | 1 | 1 | 2.00 |
| 27 | 1 | 1 | 0 | 1 | 1 | 2.05 |
| 28 | 0 | 0 | 1 | 1 | 1 | 2.10 |
| 29 | 1 | 0 | 1 | 1 | 1 | 2.15 |
| 30 | 0 | 1 | 1 | 1 | 1 | 2.20 |
| 31 | 1 | 1 | 1 | 1 | 1 | 2.25 |

TABLE 6

| Detected Voltage ViA Correction Table (Less than 20° C.) | | | | |
|---|---|---|---|---|
| No. | Voltage sensor output (V) | Surface voltage $V_D$ (V) at developing position | Surface voltage ViA (V) at sensor position | Maximum light amount (mW/cm²) |
| 0 | ~1.94 | ~339 | ~389 | 0.90 |
| 1 | 1.95~ | 340~ | 390~ | 0.95 |
| 2 | 2.05~ | 360~ | 410~ | 1.00 |
| 3 | 2.125~ | 375~ | 425~ | 1.05 |
| 4 | 2.20~ | 390~ | 440~ | 1.10 |
| 5 | 2.25~ | 400~ | 450~ | 1.15 |
| 6 | 2.30~ | 410~ | 460~ | 1.20 |
| 7 | 2.35~ | 420~ | 470~ | 1.25 |
| 8 | 2.40~ | 430~ | 480~ | 1.30 |
| 9 | 2.45~ | 440~ | 490~ | 1.35 |
| 10 | 2.50~ | 450~ | 500~ | 1.45 |
| 11 | 2.55~ | 460~ | 510~ | 1.55 |
| 12 | 2.60~ | 470~ | 520~ | 1.65 |
| 13 | 2.65~ | 480~ | 530~ | 1.80 |
| 14 | 2.675~ | 485~ | 535~ | 1.90 |
| 15 | 2.70~ | 490~ | 540~ | 2.00 |

TABLE 7

| Detected voltage ViA Correction Table (20° C. or more) | | | | |
|---|---|---|---|---|
| No. | Voltage sensor output (V) | Surface voltage $V_D$ (V) at developing position | Surface voltage ViA (V) at sensor position | Maximum light amount (mW/cm²) |
| 0 | ~1.84 | ~339 | ~369 | 0.90 |
| 1 | 1.85~ | 340~ | 370~ | 0.95 |
| 2 | 1.95~ | 360~ | 390~ | 1.00 |
| 3 | 2.025~ | 375~ | 405~ | 1.05 |
| 4 | 2.10~ | 390~ | 420~ | 1.10 |
| 5 | 2.15~ | 400~ | 430~ | 1.15 |
| 6 | 2.20~ | 410~ | 440~ | 1.20 |
| 7 | 2.25~ | 420~ | 450~ | 1.25 |
| 8 | 2.30~ | 430~ | 460~ | 1.30 |
| 9 | 2.35~ | 440~ | 470~ | 1.35 |
| 10 | 2.40~ | 450~ | 480~ | 1.45 |

TABLE 7-continued

| Detected voltage ViA Correction Table (20° C. or more) | | | | |
|---|---|---|---|---|
| No. | Voltage sensor output (V) | Surface voltage $V_D$ (V) at developing position | Surface voltage ViA (V) at sensor position | Maximum light amount (mW/cm²) |
| 11 | 2.45~ | 460~ | 490~ | 1.55 |
| 12 | 2.50~ | 470~ | 500~ | 1.65 |
| 13 | 2.55~ | 480~ | 510~ | 1.80 |
| 14 | 2.575~ | 485~ | 515~ | 1.90 |
| 15 | 2.60~ | 490~ | 520~ | 2.00 |

Since the voltage sensor 44 cannot be physically located in the developing position, the voltage sensor 44 is mounted at the position just before the developing position in order to detect the surface voltage Vo of the photoconductive drum 41, as shown in FIG. 10. Therefore, the detected voltage ViA correction tables shown in Tables 6 and 7 are prepared taking into consideration the voltage attenuation over the range from the position of the voltage sensor 44 to the developing position.

Figure 19:
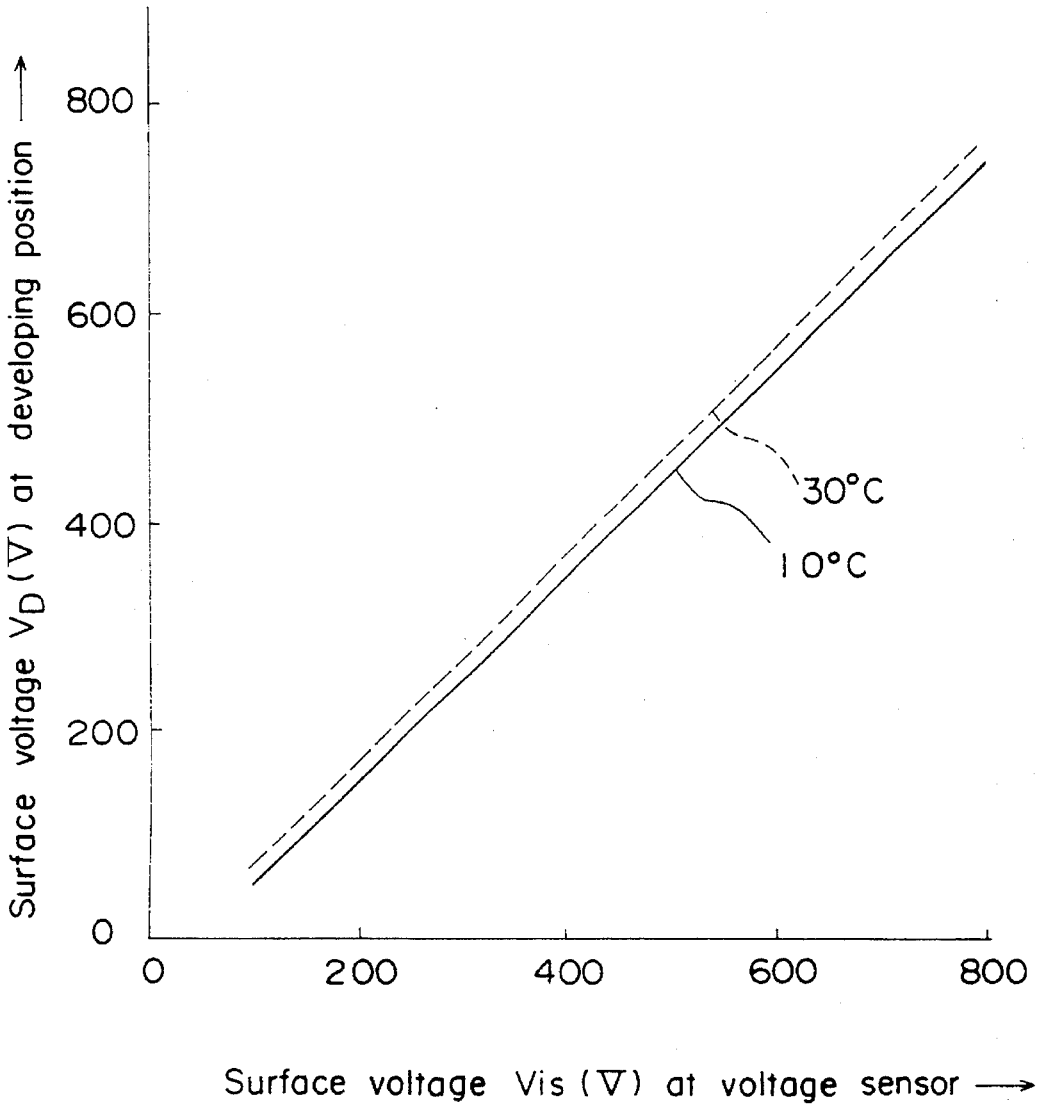
FIG. 19 is a graph showing a relationship between a surface voltage $V_D$ at a developing position and a surface voltage Vis at the voltage sensor, namely, showing a voltage attenuation from the position of the voltage sensor to the developing position.

However, this voltage attenuation may change due to change in the environments, and in particular, it is affected by the temperature as shown in the temperature characteristic of FIG. 19.

Thus, in the present preferred embodiment, two detected voltage ViA correction tables are prepared, including one for high temperatures and another one for low temperatures. One table is selected among these two tables by switching over depending on the temperature around the photoconductive drum 41 detected the temperature sensor 212 shown in FIG. 9. In the present preferred embodiment, when the detected temperature is lower than 20° C., the detected voltage ViA correction table for the low temperatures is selected. On the other hand, when the detected temperature is equal to or higher than 20° C., the detected voltage ViA correction table for the high temperatures is selected.

(f) Distance characteristic of voltage sensor and its correction

Figure 20:
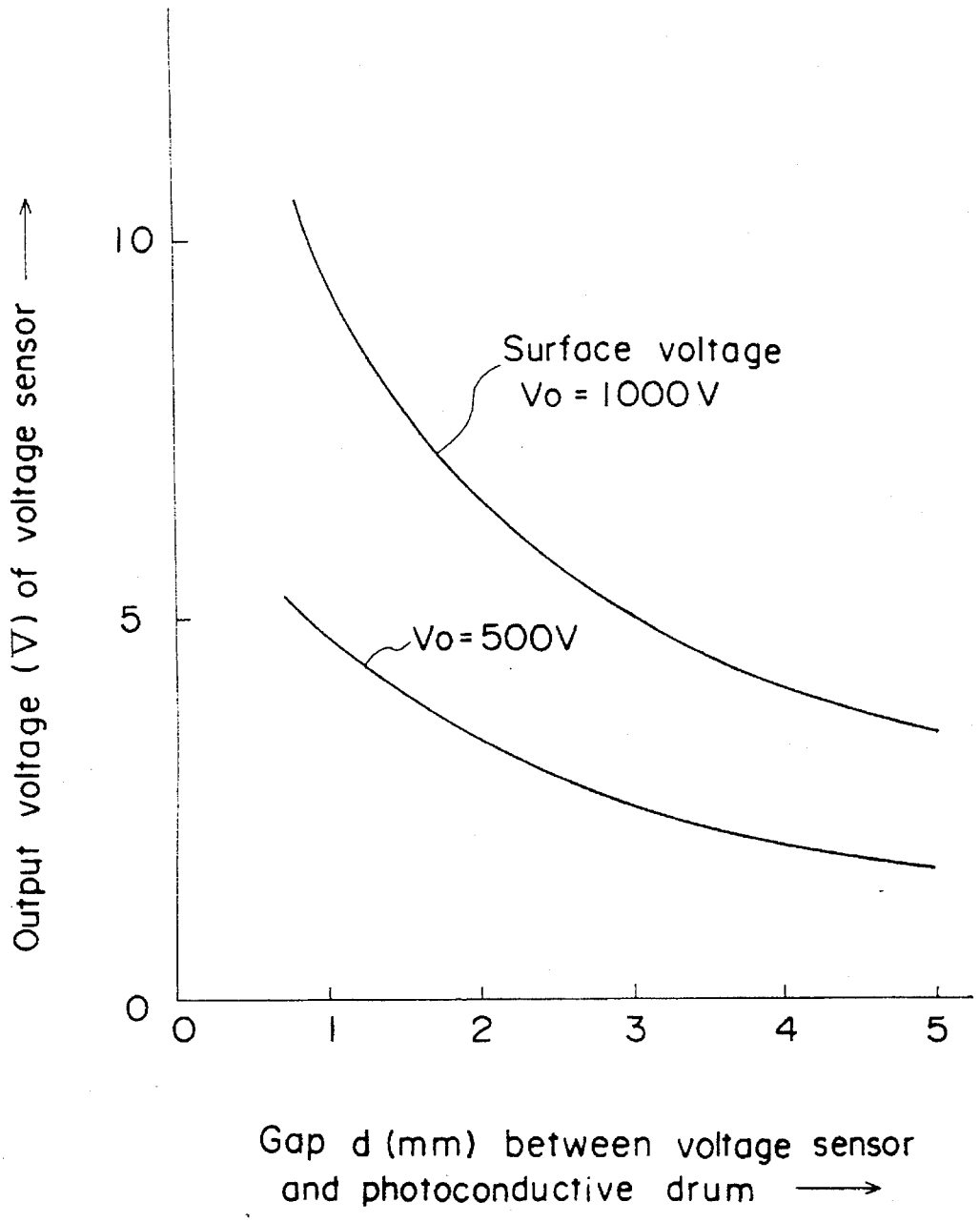
FIG. 20 is a graph showing a relationship between an output voltage of the voltage sensor and a gap between the voltage sensor and the photoconductive drum, namely, showing a distance characteristic of the voltage sensor.

FIG. 20 shows a distance characteristic of the voltage sensor 44 in the present preferred embodiment, namely, an output voltage characteristic of the voltage sensor 44 with a gap or distance d between the voltage sensor 44 and the surface of the photoconductive drum 41.

Figure 21:
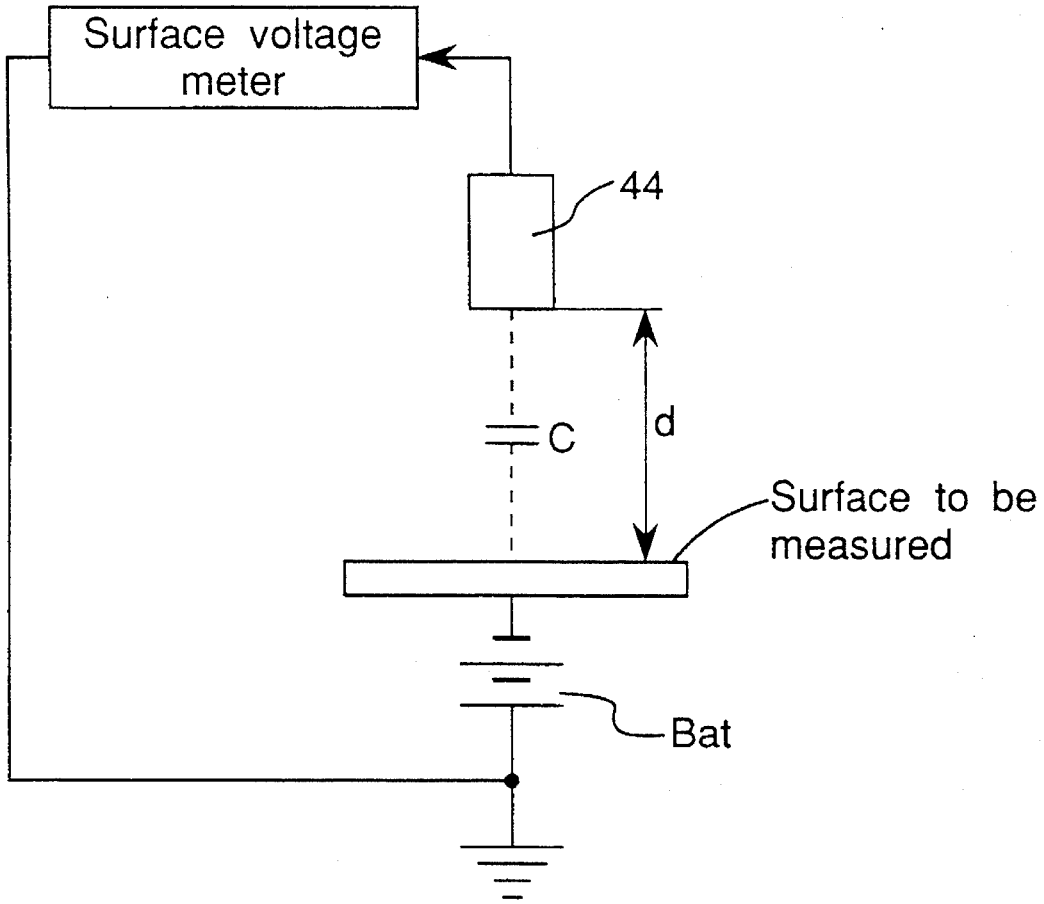
FIG. 21 is a schematic diagram showing an arrangement for measuring a surface voltage Vo using the voltage sensor.

This distance characteristic is dependent upon the fact that a capacitance C change as the distance g changes between the voltage sensor 44 and the measured surface of the photoconductive drum 41 under a measurement arrangement shown in FIG. 21, wherein the capacitance C is in direct proportion to the reciprocal of distance d. The change in the distance d may also occur due to a deviation which may be caused by decentering of the center of the photoconductive drum 41 when the photoconductive drum 41 is rotated, resulting in a remarkable error in the detected surface voltage.

Therefore, in the present preferred embodiment, upon detecting the surface voltage prior to the AIDC operation, a plurality of respective surface voltages during a time interval when the photoconductive drum 41 is rotated with one rotation are detected, and then the average value of the respective surface voltages is calculated. Then the average value thereof is used as the detected voltage ViA. In this case, the influence which may be caused due to decentering of the center of the photoconductive drum 41 can be removed, as shown in the ViA detection process of FIGS. 37 and 38.

However, in the case of a multi-copying process, if a plurality of respective surface voltages during a time interval when the photoconductive drum 41 is rotated are detected every copying process for each copy, the copying speed is lowered. Therefore, as described in detail later in the section (h), the process for detecting the surface voltage is executed only over a part of the outer peripherals of the photoconductive drum 41.

Figure 22:
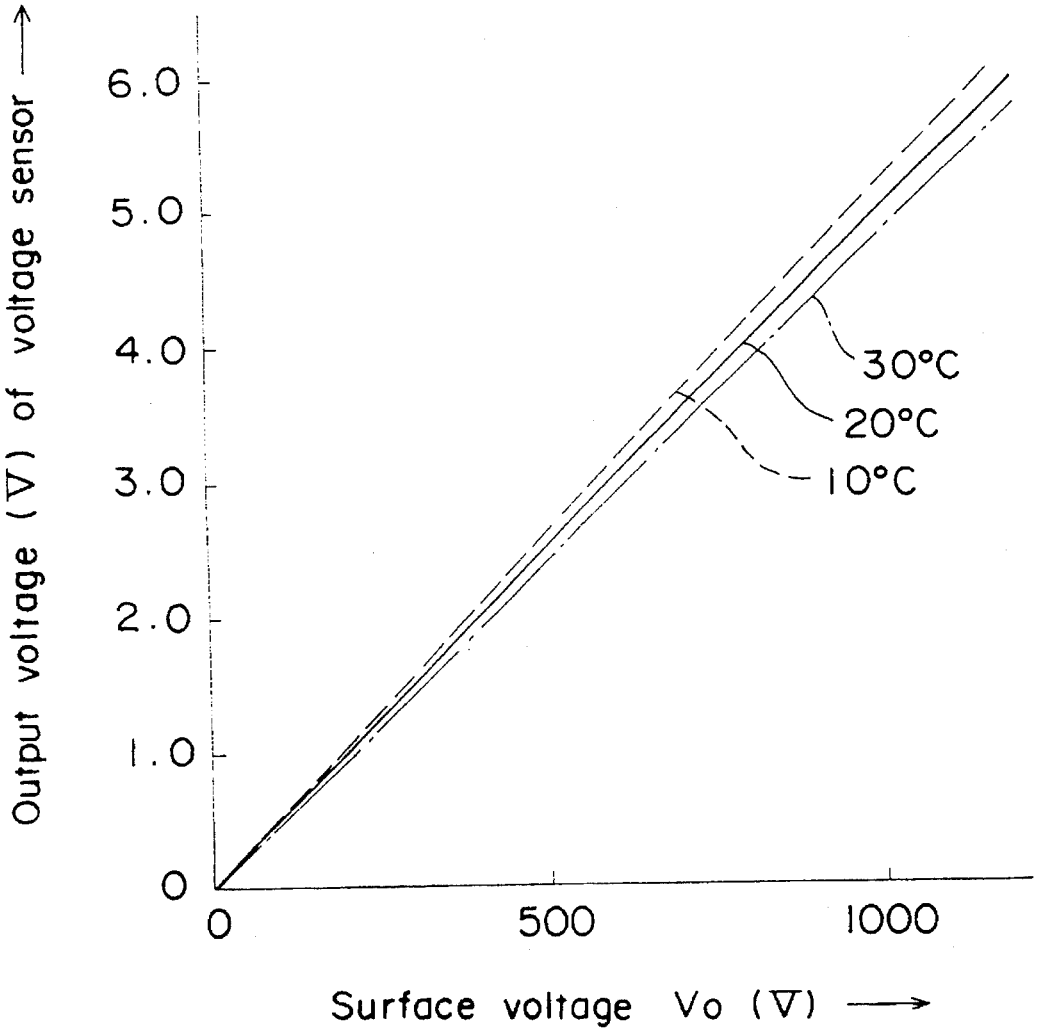
FIG. 22 is a graph showing a relationship on the temperature between the output voltage of the voltage sensor and the surface voltage Vo.

FIG. 22 show a temperature characteristic of the voltage sensor 44 of the present preferred embodiment. The change in this temperature characteristic is caused due to the temperature characteristics of a tuning fork and a piezoelectric device provided within the voltage sensor 44.

In order to correct any change in the output voltage of the voltage sensor 44 which may be caused due to this temperature characteristic, the temperature around the voltage sensor 44 is detected using the temperature sensor 212 prior to detecting the surface voltage of the photoconductive drum 41. Then, based on the detected temperature, the output voltage of the voltage sensor 44 is corrected.

Table 8 shows an example of a table for correcting the output voltage of the voltage sensor 44 depending on the temperature TH1° C. in the above-mentioned manner. In this case, a correction amount ΔV1 of the output voltage of the voltage sensor 44 is changed depending on the detected voltage V1.

TABLE 8

Correction Table for correcting output voltage of voltage sensor depending on temperature

| TH1 (°C.) | V1 (V) | ~399 | 400~ | 600~ | 800~ |
|---|---|---|---|---|---|
| ~7.4 | Sensor correction amount (V) | −0.075 | −0.15 | −0.225 | −0.30 |
| | ΔV1 (V) | −15 | −30 | −45 | −60 |
| 7.5~ | (V) | −0.05 | −0.10 | −0.15 | −0.20 |
| | (V) | −10 | −20 | −30 | −40 |
| 12.5~ | (V) | −0.025 | −0.05 | −0.075 | −0.10 |
| | (V) | −5 | −10 | −15 | −20 |
| 17.5~ | (V) | 0 | 0 | 0 | 0 |
| | (V) | 0 | 0 | 0 | 0 |
| 22.5~ | (V) | +0.025 | +0.05 | +0.075 | +0.10 |
| | (V) | +5 | +10 | +15 | +20 |
| 27.5~ | (V) | +0.05 | +0.10 | +0.15 | +0.20 |
| | (V) | +10 | +20 | +30 | +40 |
| 32.5~ | (V) | +0.075 | +0.15 | +0.225 | +0.30 |
| | (V) | +15 | +30 | +45 | +10 |

In this example, the dark-part voltage Vo can be corrected in a range of ±100 V with a predetermined reference dark-part voltage Vo, and the bright-part voltage Vi can be corrected in a range of ±75 V. Generally speaking, when the environments are within a permissible range for the application and the degree of printing load is within the life of the photoconductive drum 41, the output voltage of the voltage sensor 44 may not be often out of the above-mentioned correction ranges.

However, the output voltage of the voltage sensor 44 could be out of the above-mentioned correction ranges due to, for example, contaminations on the grid mesh and the charge wire of the corona charger 43, an abnormal fatigue of the photoconductive drum 41 or the like. In other words, if the detected voltage of the voltage sensor 44 is not fallen into the correction ranges, there may be some trouble or malfunction in some part of the system. Therefore, in such a case, the system is stopped operating, resulting in an alarm display as shown in step S185 of FIG. 33.

(g) Correction of maximum density change and gradation change during the process of multi-copying During the process of multi-copying, the dark-part voltage Vo and the bright-part voltage Vi of the photoconductive drum 41 gradually changes when the charging process and the developing process are repeated. This fact may be attributed principally to increase or decrease in the residual voltage $V_R$ after erasing by the eraser lamp 42. On the other hand, this change also differs depending on the environments and the degree of printing load to the photoconductive drum 41. Accordingly, the density of the reproduced images may gradually change so as to increase or decrease during the process of multi-copying.

To dissolve the above phenomenon, in the present preferred embodiment, the bright-part voltage Vi (referred to as ViC hereinafter) is detected between successive copied images during the process of multi-copying, and then the maximum light amount is corrected. This correction thereof is performed every copying process or once a plurality of copies. The reason why the bright-part voltage ViC is detected by each copying is that, even small change in the voltage leads to remarkable influence in the reproduced full color image.

Further, the change amount in the detected dark-part voltage Vo during the multi-copying process is relatively smaller than that in the detected bright-part surface voltage Vi. Further, the influence into the reproduced image due to a change in the dark-part voltage is larger than that in the bright-part voltage. Thus, in view of relatively short time intervals between successive copies, it is arranged in the present preferred embodiment that the maximum light amount is corrected by detecting only the bright-part voltage Vi.

Now, the correction method will be described in detail below.

(g-1) ViC detection and correction of maximum light amount

For the surface voltage detection prior to an AIDC operation, a plurality of respective surface voltages corresponding to one rotation of the photoconductive drum 41 are detected because of decentering of the photoconductive drum 41 or the like, and then the average value of the detected respective surface voltages is calculated. Then the average value thereof is set as the detected voltage (See the section (K-6)). However, in the case of a multi-copying process, if a plurality of respective surface voltages corresponding to one rotation of the photoconductive drum 41 are detected, the copying speed is lowered.

Thus, it was arranged in the present preferred embodiment that, during a multi-copying process, a predetermined electrostatic latent image pattern having a size of about 50×50 mm square is formed at the same position between succeeding images in the circumferential direction of the photoconductive drum 41, and there is judged the degree of the change in the detected voltage ViC at the same position from an initial voltage value ViB thereof. Then the maximum light amount is corrected based on the judgment results.

The above-mentioned initial voltage value ViB is defined as follows. The AIDC operation is effected under a corrected grid voltage $V_G$ and a maximum light amount which are obtained based on the surface voltage Vo detected prior to the AIDC operation, a predetermined corrected grid voltage $V_G$ is applied to the grid. Thereafter, when a beam of laser light having a level 100 when a level 255 is defined as the predetermined corrected maximum light amount (for example, selected as 1.15 W/cm$^2$ from Table 7) is projected onto the photoconductive drum 41, then the bright-part voltage Vi is detected as the above-mentioned initial voltage value ViB (See a voltage ViB detection process in FIGS. 37 and 38). In this case, a pattern similar to the pattern ViC between successive images for the voltage ViC detection (square of 50×50 mm) is formed at the same predetermined position on the circumference of the photoconductive drum 41.

This pattern between successive images is formed under the same conditions of the grid voltage $V_G$ and the maximum light amount as those in detecting the initial voltage value ViB, and the resulting surface voltage Vi is detected.

According to the above-mentioned method, even if any voltage nonuniformity in the circumferential direction of the photoconductive drum 41 or any decentering of the photoconductive drum 41 takes place, there will be no need for effecting the measurement of a plurality of respective surface voltages corresponding to one rotation, thereby allowing voltage detection to be implemented while the copying speed is maintained so as to be unchanged.

As described in the description of the overall construction of the digital copying machine of the present preferred embodiment, the ratio of the diameter of the photoconductive drum 41 to that of and the transfer drum 51 is an integer ratio of 1:2, and then the same predetermined position of the photoconductive drum 41 in the circumferential direction thereof is always in contact with that of the transfer drum 51. When the rotational position of the transfer drum 51 is detected, the rotational position of the photoconductive drum 41 can be detected. Then the measurement of the surface voltage Vi at the same predetermined position can be effected.

(g-2) Light amount correction table for multi-copying

Table 9 shows a light amount correction table for a multi-copying. Table 9 may be prepared from the relationship between the detected voltage ViA and the set light amount, which has been described in connection with the light amount correction prior to the AIDC operation.

Figure 23:
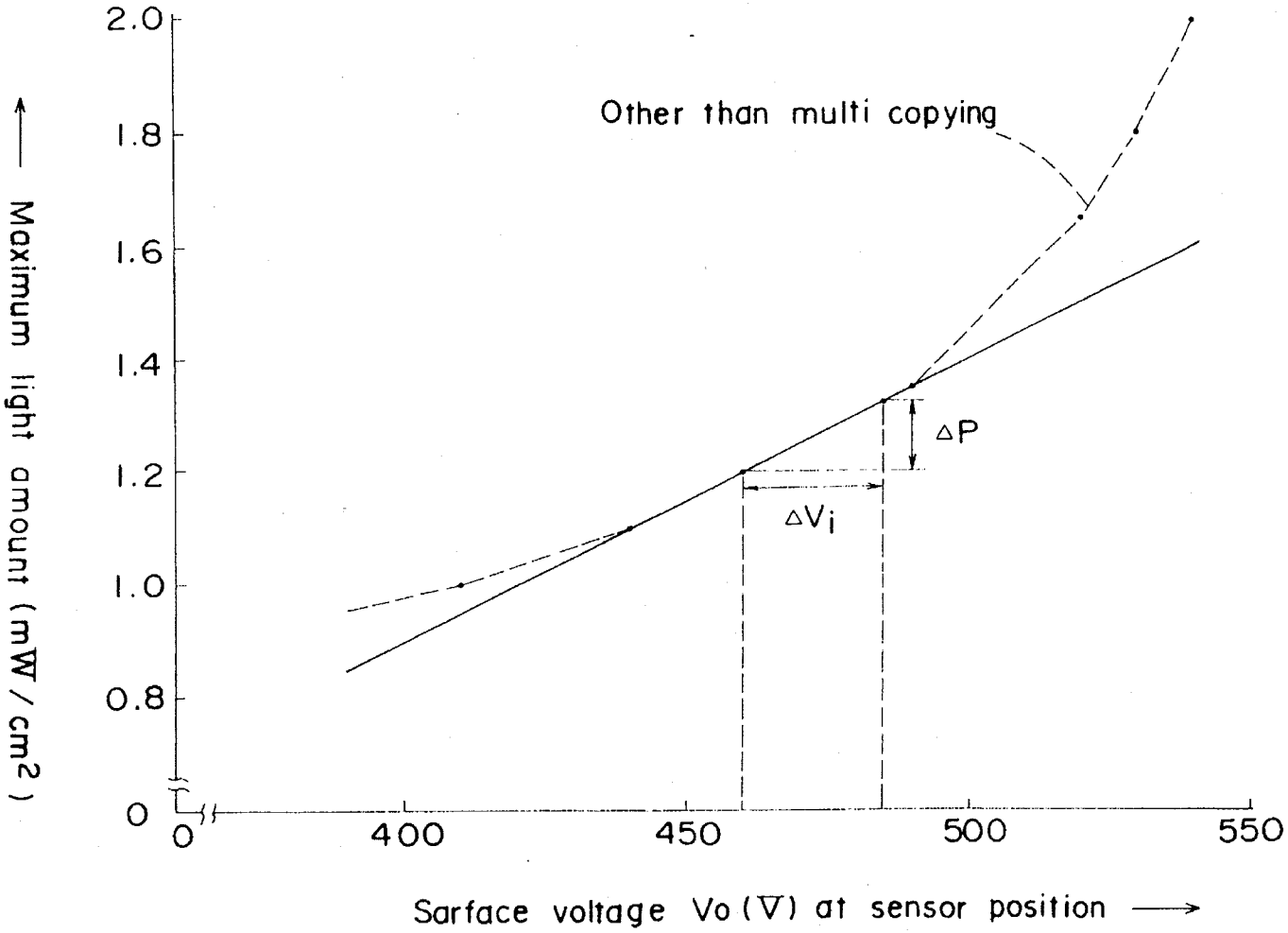
FIG. 23 is a graph showing a relationship between the maximum light amount to be set and the surface voltage Vo at the sensor position.

However, since this relationship has a nonuniform variation as shown in FIG. 23, the light amount for the correction changes depending on the level of the initial voltage value ViB in the case of the light amount correction for the multi-copying, even if the change between the detected voltage ViC detected between successive images and the initial voltage value ViB are the same as each other.

It should be preferable that all the light amounts to be set for the voltage variations of the detected voltage ViC between successive images corresponding to the initial value ViB be calculated or all tables be prepared, but this results in an extremely large memory capacity to be prepared. Therefore, in the present preferred embodiment, a correction table is prepared based on an average variation $\Delta P/\Delta Vi$ in the relationship as shown in FIG. 23.

With this method, there may occur some error in the maximum light amount at the surface voltage Vo apart from the center value of the surface voltage Vo, but this is negligible. Further, the memory capacity of the memory for storing the above-mentioned table can be substantially reduced.

TABLE 9

Light Amount Correction Table for Multi-copying

| STEP | Voltage sensor output ΔVs | Surface voltage ΔVi (V) at sensor position | Maximum light amount $\Delta P_{255}$ (mW/cm²) |
|---|---|---|---|
| +5 | ~−0.226 | ~−46 | +0.25 |
| +4 | −0.225~ | −45~ | +0.20 |
| +3 | −0.175~ | −35~ | +0.15 |
| +2 | −0.125~ | −25~ | +0.10 |

TABLE 9-continued

Light Amount Correction Table for Multi-copying

| STEP | Voltage sensor output ΔVs | Surface voltage ΔVi (V) at sensor position | Maximum light amount $\Delta P_{255}$ (mW/cm²) |
|---|---|---|---|
| +1 | −0.075~ | −15~ | +0.05 |
| 0 | −0.025~ | −5~ | ±0 |
| −1 | +0.025~ | +5~ | −0.05 |
| −2 | +0.075~ | +15~ | −0.10 |
| −3 | +0.125~ | +25~ | −0.15 |
| −4 | +0.175~ | +35~ | −0.20 |
| −5 | +0.225~ | +45~ | −0.25 |

(g-3) Modification example

Figure 52:
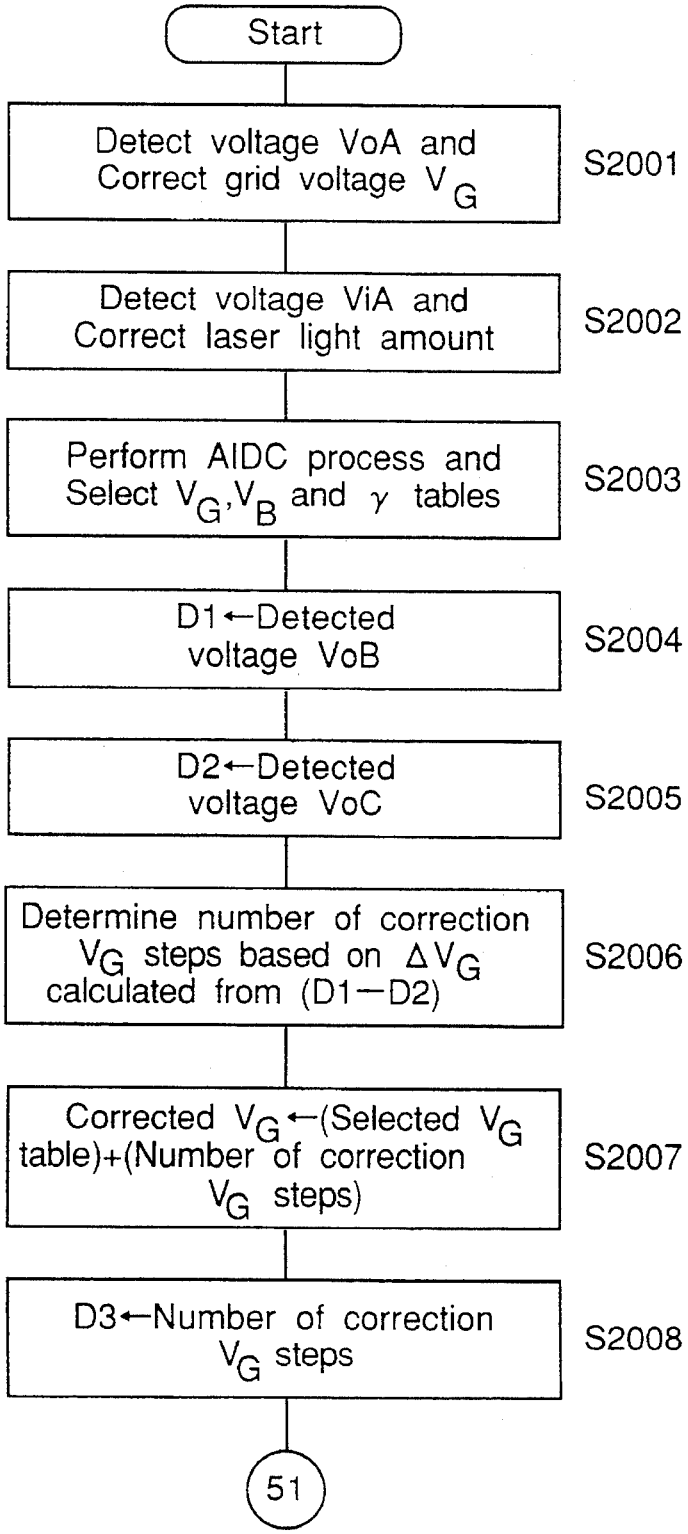
FIG. 52 is a flowchart of a first part of a process for correcting the grid voltage $V_G$ in a process of multi-copying of the digital color copying machine shown in FIG. 1.
Figure 53:
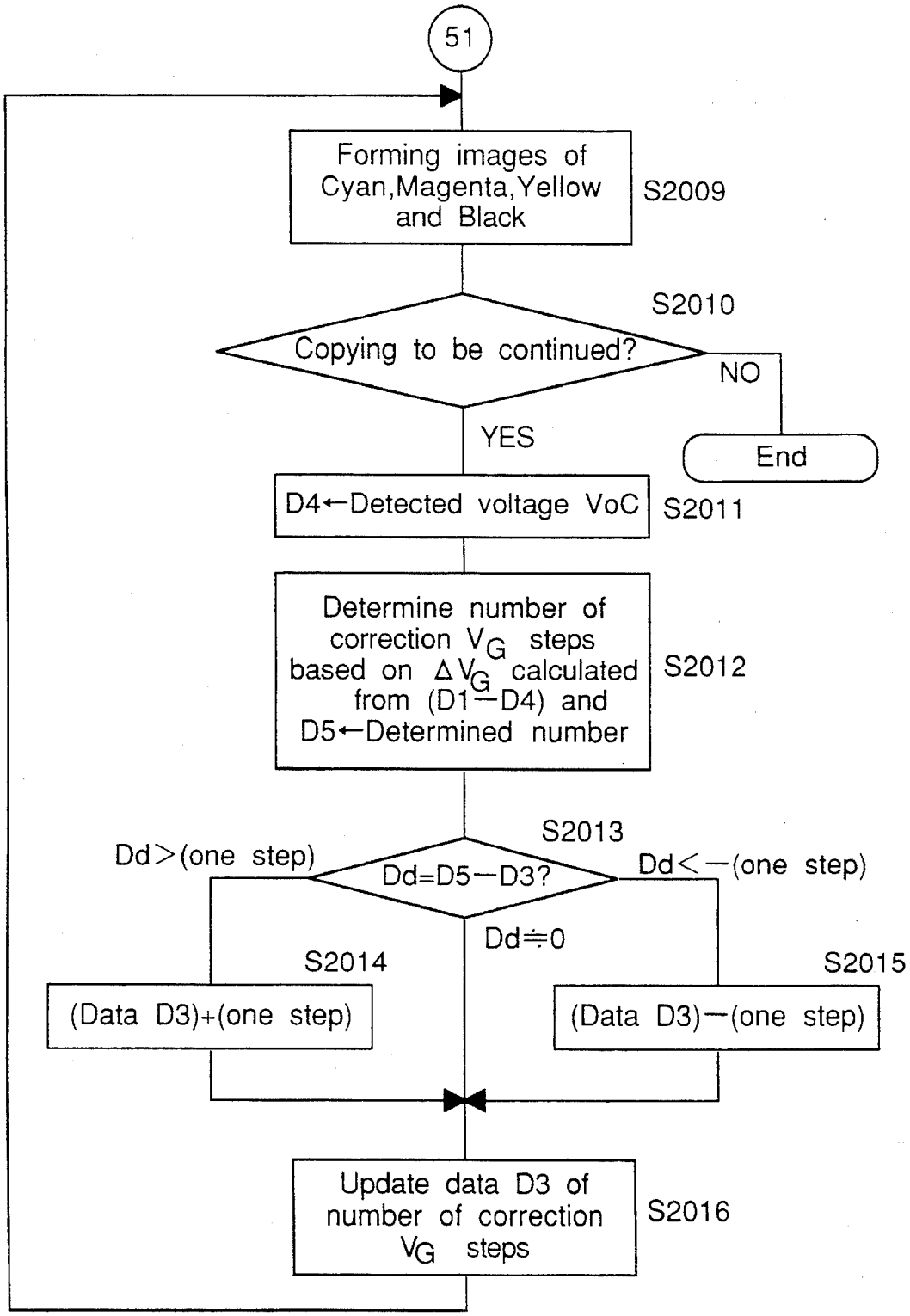
FIG. 53 is a flowchart of a second part of a process for correcting the grid voltage $V_G$ in a process of multi-copying of the digital color copying machine shown in FIG. 1.

Whereas the foregoing description has been made on the case where the light amount correction is effected during the process of multi-copying, the modification example described below is such that the dark-part voltage Vo on the photoconductive drum 41 electrically charged by a predetermined output voltage during the process of multi-copying is detected and then the grid voltage $V_G$ is corrected so that the dark-part voltage Vo is held constant as shown in the process of FIGS. 52 and 53.

In this case, after the above-described voltage control and AIDC operation, the corrected grid voltage $V_G$ is applied to the grid which is obtained based on the correction amount $\Delta V_G$ in the voltage control process, the resulting surface voltage Vo being detected by the voltage sensor 44. In this case, an image is formed at the same position as the pattern between successive images in the case of multi-copying. The resulting detected surface voltage is assumed to be an initial voltage value VoB. For the pattern between the successive images in the multi-copying, the photoconductor is electrically charged with the grid voltage $V_G$, under the same condition as for the initial voltage value VoB, and then the voltage VoC is detected. Then, based on the difference (or the variation) between the initial voltage value VoB and the detected voltage VoC detected every time, a correction amount $\Delta V_G$ of the grid voltage $V_G$ is determined according to the grid voltage $V_G$ correction table for the multi-copying shown in Table 10. Thereafter, based on the obtained correction amount $\Delta V_G$, the grid voltage $V_G$ for the succeeding copying is corrected.

If the difference between a correction amount $\Delta V_G$ obtained based on the detected voltage for one copy and another correction amount $\Delta V_G$ obtained based on the detected voltage for the preceding copy is ±2 steps or more shown in the correction table of Table 10, this leads to a steep change in the density of the reproduced image just after the correction the maximum light amount. Therefore, in the present preferred embodiment, the correction amount for each one copy is limited to ±1 step in the correction table of Table 10, thereby suppressing any steep change in the image density.

Furthermore, in another preferred embodiment, the development bias voltage $V_B$ may be corrected by detecting the bright-part voltage in stead of the dark-part voltage VoB. If the correction amount of development bias voltage $V_B$ is larger than a predetermined amount, a similar limiter control is performed.

TABLE 10

Grid voltage $V_G$ Correction Table for multi-copying

| STEP | Voltage sensor output | Surface voltage at sensor position | $V_G$ correction amount $\Delta V_G$ |
|---|---|---|---|
| +5 | 3.70~ | 690~ | +50 |
| +4 | 3.75~ | 700~ | +40 |
| +3 | 3.80~ | 710~ | +30 |
| +2 | 3.85~ | 720~ | +20 |
| +1 | 3.90~ | 730~ | +10 |
| 0 | 3.95~ | 740~ | 0 |
| −1 | 4.00~ | 750~ | −10 |
| −2 | 4.05~ | 760~ | −20 |
| −3 | 4.10~ | 770~ | −30 |
| −4 | 4.15~ | 780~ | −40 |
| −5 | 4.20~ | 790~ | −50 |

(h) Limitation of correction amount in multi-copying

If an excessive light amount correction is effected during the process of multi-copying, a remarkable change in the reproduced image may be caused before and after the correction of the light amount. Therefore, in the laser power table of Table 5, the change amount in the light amount for every one step is so set that any remarkable change in the reproduced image be not caused, as described above in the case of 0.05 mW/cm$^2$.

In the process of multi-copying, if the difference between a surface voltage detected by the voltage sensor 44 for a number copies and its preceding detected voltage is |±2 steps| or more in the light amount correction table of Table 9, the correction amount of light amount correction becomes too great, and then a change in the density between the reproduced image just before the correction of the light amount and another reproduced image just after the correction thereof becomes large, resulting in a possible dissatisfaction of users. When the copying process is done continuously, such a steep change in the image density in the reproduced image is undesirable.

Therefore, in the preferred embodiment, the light amount correction of 2 steps or more is not effected even if the difference between the current and preceding detected values, thereby preventing any steep change in the reproduced image. It is to be noted that the time interval of detecting the surface voltage Vo is set such that the light amount can not be corrected by more than one step, taking into consideration the change in the surface voltage on the photoconductive drum 41.

Conversely, when such a value has been detected as to require a correction mount of 2 steps or more in the correction table relative to the preceding correction, it is supposed that there may be caused some malfunction or a noise may be contained in the detected surface voltage. In particular, when a noise is contained in the detected surface voltage, it is possible that the detected surface voltage may steeply change as compared with the preceding detected surface voltage. In this case, it is supposed that, even through the change in the surface voltage is small, an excessive correction has been performed. From such a point of view, it is effective that the correction in the process of multi-copying is performed by one step for one correction.

The correction in the multi-copying is arranged so as not to be effected over a predetermined number of steps, and from this on, the copying is continued using the last correction value of the maximum light, thereby avoiding the above-mentioned overcorrection or excessive correction or the like. However, if such a detected voltage has appeared as to require a light amount correction over several steps even after this operation, the copying operation may be stopped with an alarm display.

The above-mentioned process can be applied in a similar manner to the correction of the grid voltage $V_G$, in which the correction amount is limited in the similar manner.

(i) Prevention of overcorrection in malfunction

Whereas the light amount correction for multi-copying is carried out in accordance with Table 9, the multi-copying of 1 copy to about 100 copies or sheets would normally be subject to change in the bright-part surface voltage Vi of the photoconductive drum 41 from the first copy in a range of at most 5 to 6 steps of Table 9. This change corresponds to a change in the surface voltage in rage from 20 to 25 V. If such an output voltage of the voltage sensor 44 has been detected as to need a correction over more than those numbers of steps, it may be attributed to the fact that the surface voltage has been changed abnormally or that a noise is contained in the detected output voltage. With the correction effected over eight steps, nine steps, and so on in such a state, there may occur an overcorrection or adverse effect on the other elements such as an excessively increased toner adhesion amount with increased particle fumes, etc.

Figure 24:
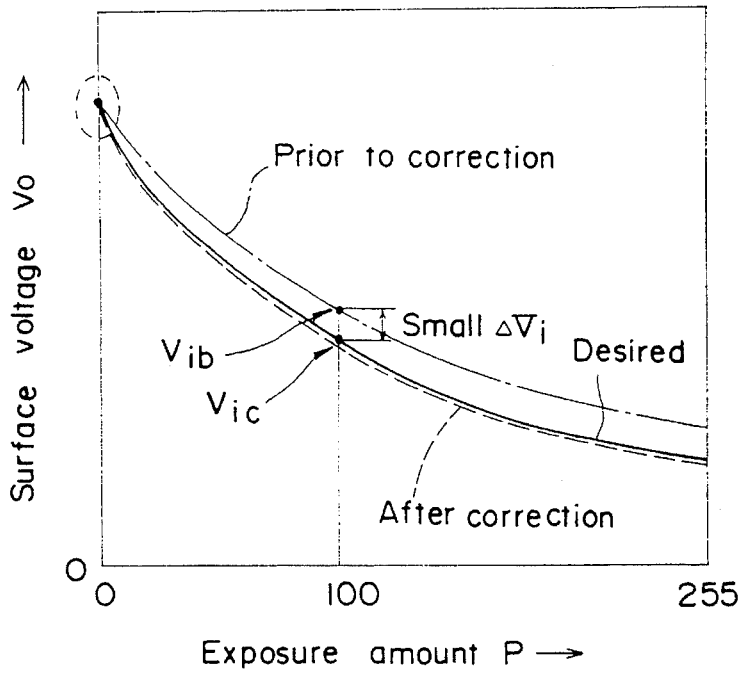
FIG. 24 is a graph showing a correction characteristic of a relationship between the surface voltage and the exposure amount, when there is caused no shift of the surface voltage Vo upon correcting the light amount.
Figure 25:
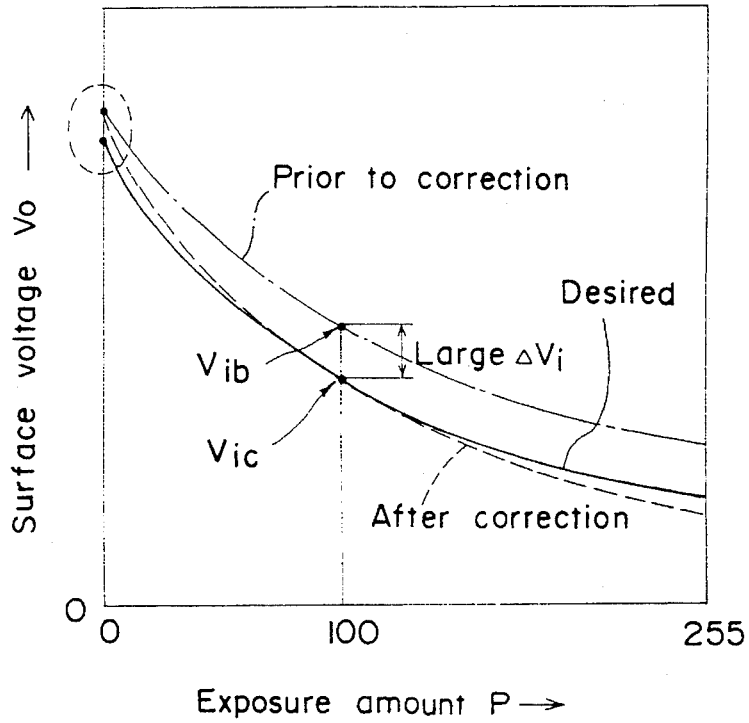
FIG. 25 is a graph showing a correction characteristic of a relationship between the surface voltage and the exposure amount, when there is caused a shift of the surface voltage Vo upon correcting the light amount.

When the correction of the light amount is effected over a certain number of steps during the process of multi-copying, it is supposed that there may be a large change in not only the bright-part voltage Vi but also the dark-part voltage Vo. As described above, when the dark-part voltage Vo is not shifted during the light amount correction, the difference ΔVi between the reference voltage value ViB and the detected surface voltage ViC is small, as shown in FIG. 24. Then when the bright-part voltage Vi is corrected based on the light amount, an LDC curve representing a relationship between the exposure amount of the laser diode 264 and the surface voltage of the photoconductive drum 41 is corrected approximately into a desired curve. However, if the dark-part voltage Vo is shifted during the process of multi-copying, a larger difference ΔVi between the reference voltage value ViB and the detected voltage ViC is caused as shown in FIG. 25. Then the LDC curve after the correction is shifted from the desired curve.

Figure 26:
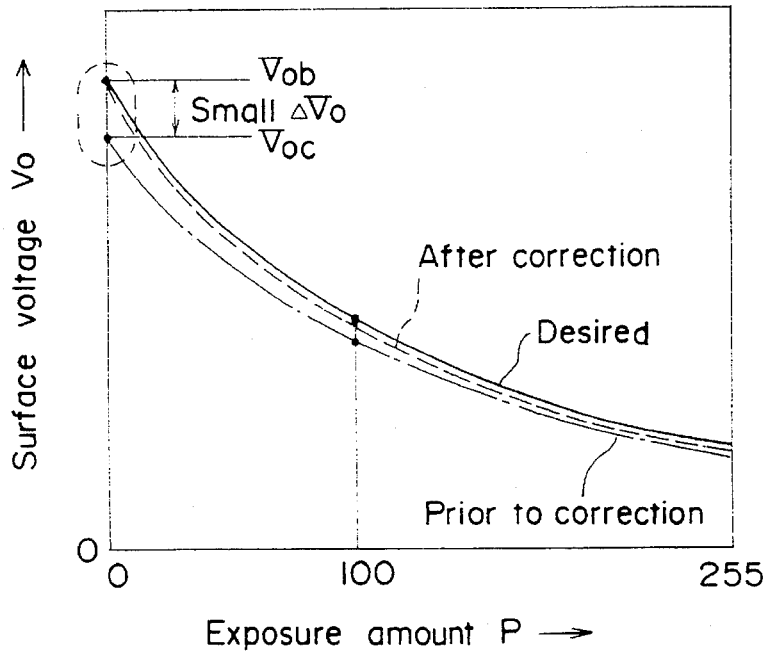
FIG. 26 is a graph showing a correction characteristic of a relationship between the surface voltage and the exposure amount, when there is caused a small shift of the surface voltage Vo upon correcting the grid voltage $V_G$.
Figure 27:
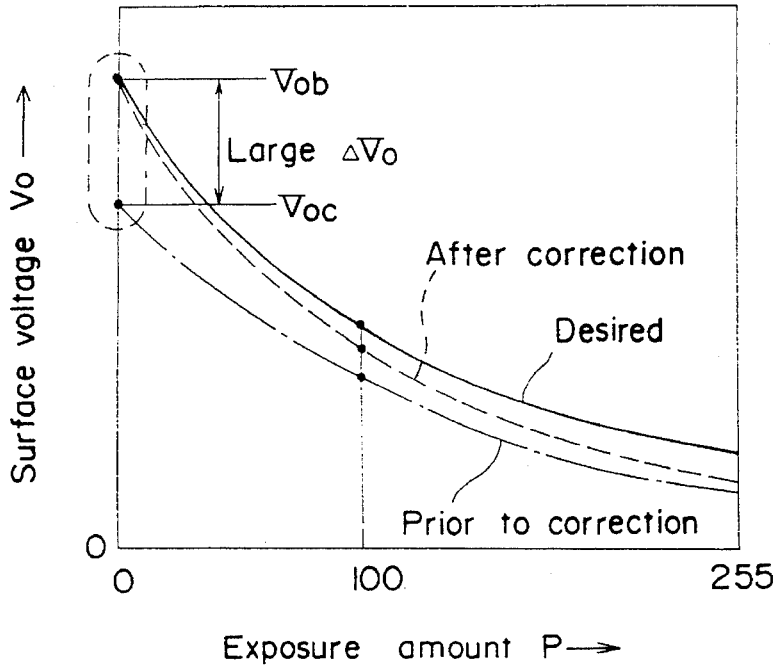
FIG. 27 is a graph showing a correction characteristic of a relationship between the surface voltage and the exposure amount, when there is caused a large shift of the surface voltage Vo upon correcting the grid voltage $V_G$.

Furthermore, an example when the shift amount of the dark-part voltage Vo is small is shown in FIG. 26, where the LDC curve is corrected approximately into a desired curve by the correction of the grid voltage $V_G$. However, as shown in FIG. 27, if the shift amount of the dark-part voltage Vo is a large value, the LDC curve is not corrected completely into the desired curve only using the correction of the grid voltage $V_G$.

Therefore, if any malfunction has been detected, the copying is once stopped at that timing, followed by returning to the setting process of the charge amount and redoing the correction process. In more detail, in the present preferred embodiment, prior to the AIDC operation, the process for correcting the dark-part and bright-part surface voltages Vo and Vi is effected and then the copying operation is done again as shown in the process of FIG. 54.

Figure 54:
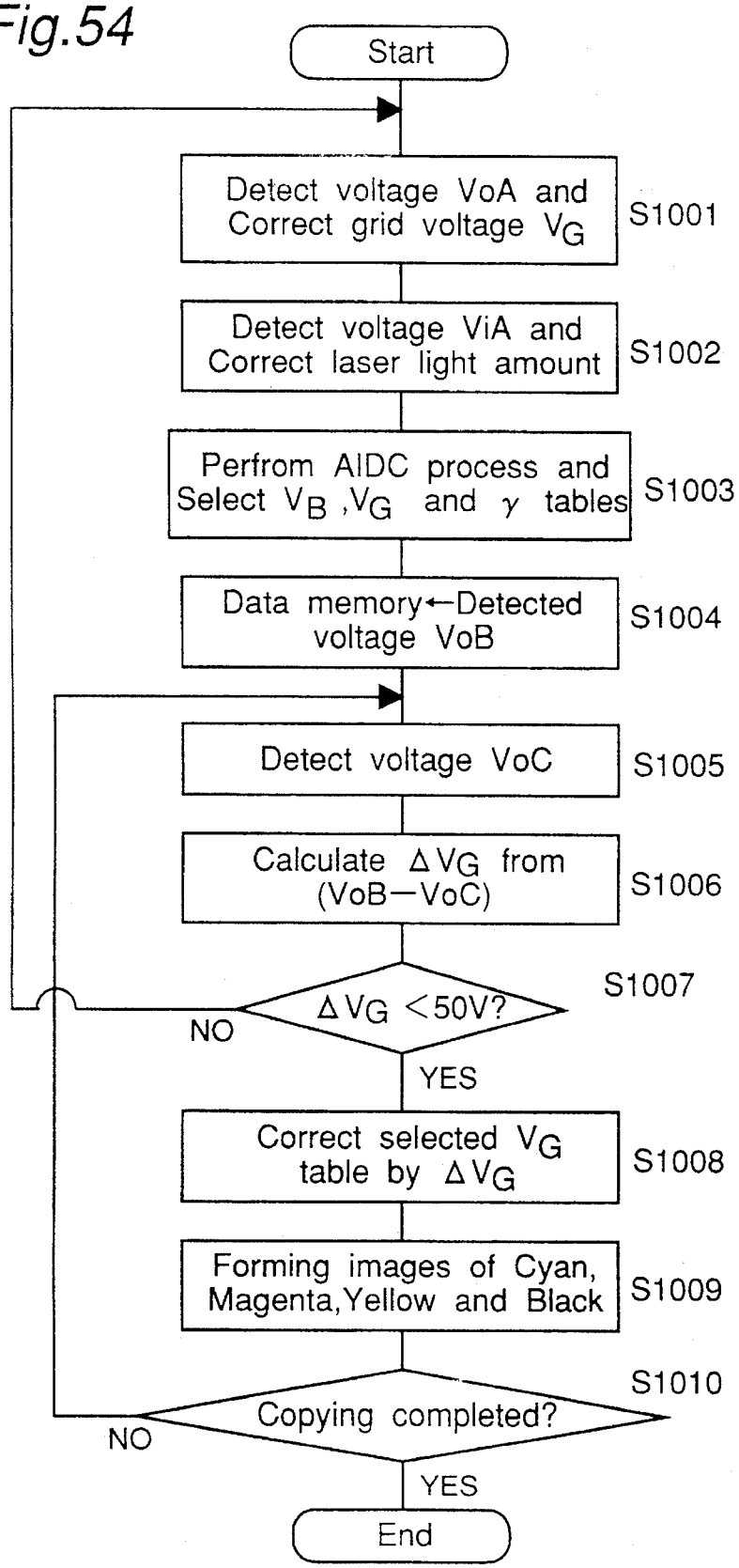
FIG. 54 is a flowchart of an overcorrection prevention process of the digital color copying machine shown in FIG. 1.

The process of FIG. 54 is such that when the correction amount $\Delta V_G$ of the grid voltage $V_G$ becomes over a predetermined amount, the process for setting the charging amount and the maximum light amount of the laser diode 264 including the reexecution of the AIDC operation. By executing these processes it is possible to reduce the shift amount of the bright-part surface voltage Vi due to a change in the dark-part surface voltage Vo.

Similarly, in the modification example, the bright-part voltage Vi may be detected instead of detecting the dark-part voltage Vo, and then the developing bias voltage $V_B$ may be corrected based on the resulting detected bright-part voltage. In this, case, when the correction amount of the development bias voltage $V_B$ becomes over a predetermined amount, the process is started again including the correction of the development bias voltage $V_B$, the grid voltage $V_G$, and the maximum light amount of the laser diode 264, and the like.

(j) Switching of Light emitting control mode

In the present preferred embodiment, by switching the light emitting control mode for the laser light emission, the reproductivity of the image to be reproduced can be switched.

In more detail, there are provided a first light emitting control mode in which one dot corresponds to one pixel, and a second light emitting control mode in which the laser diode 264 is turned on or off periodically with a constant duty ratio every one pixel or every some plural pixels.

Figure 28:
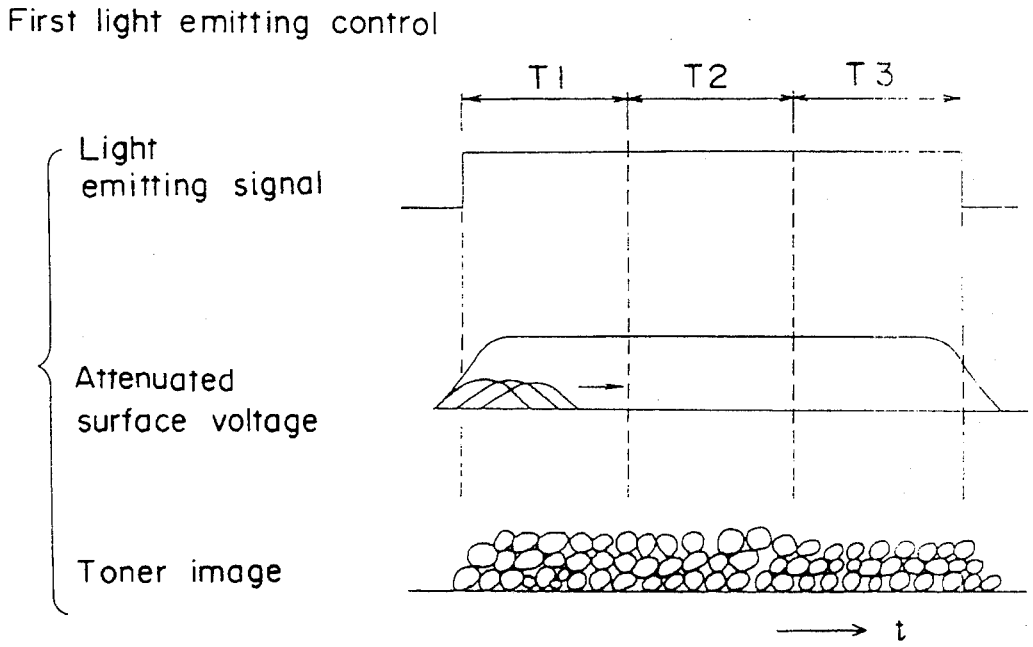
FIG. 28 is a timing chart showing an example of a relationship among a light emitting signal, an attenuated surface voltage and a toner image in a first light emitting control of the preferred embodiment.
Figure 29:
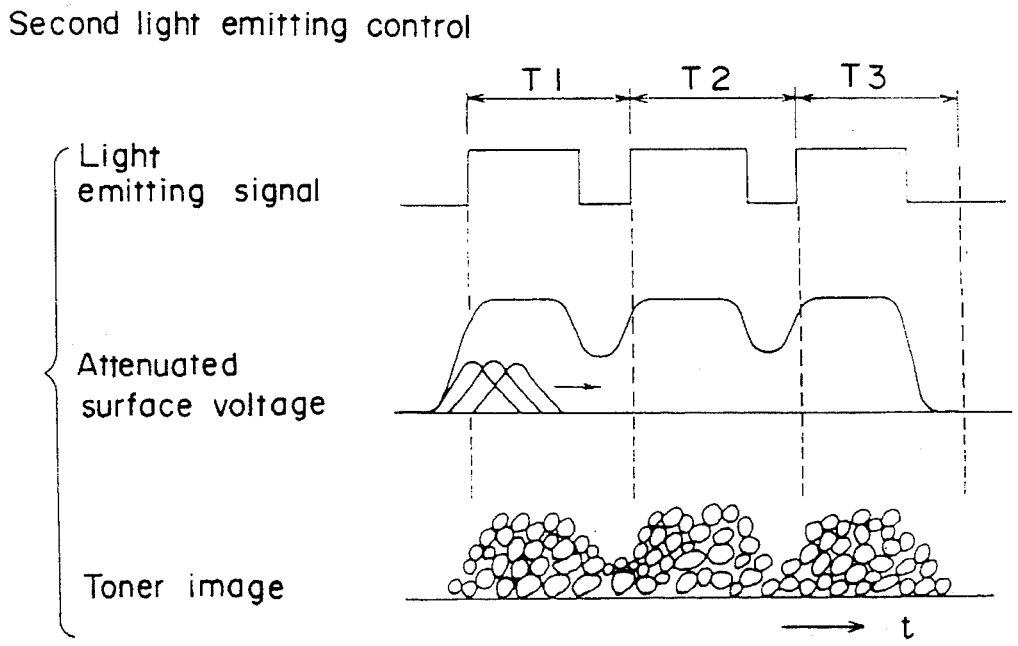
FIG. 29 is a timing chart showing an example of a relationship among a light emitting signal, an attenuated surface voltage and a toner image in a second light emitting control of the preferred embodiment.

FIGS. 28 and 29 show the first and second light emitting control modes, respectively, where there are illustrated in the middle part attenuated surface voltages of the photoconductive drum 41 obtained when a beam of laser light of three dots is continuously projected onto the photoconductive drum 41 using the same maximum light amount in the main scan direction as shown in the upper part of each of FIGS. 28 and 29. In this case, there is used a duty ratio of 70% for each one pixel.

In these illustrations, a series of small hills represent that the light intensity distribution of a beam of laser light changes with the elapsed time when the beam of laser light is scanned in the main scan direction. In the second light emitting control mode shown in FIG. 29, since the duty ratio is not 100%, the light intensity distribution changes with a cycle corresponding to one dot. On the other hand, in the first light emitting control mode shown in FIG. 28, the light intensity distribution does not change for a time interval of the emission time of three dots. Corresponding to this, the attenuated surface voltage on the surface of the photoconductive drum 41 in the second light emitting control mode has a cycle for each one dot, while that in the first light emitting control mode has no change between the successive dot images.

As a result, the adhering amount of the toner developed on the photoconductive drum 41 also has a peak for each one dot in the second light emitting control mode, as shown in the lower part of the FIG. 29. In this case, the total toner adhesion amount is substantially the same as that in the first light emitting control mode, however, a smaller portion of the toner adhesion amount is caused between the successive dot images. This causes a delayed saturation of the image density with higher light amounts in the second light emitting control mode. In addition, the light emitting signal generator 265 changes the period of the light emission depending on the signal outputted from the printer controller 201 shown in FIG. 8.

As compared with the first light emitting control mode, the second light emitting control mode has a smoother gradation reproduction. The first light emitting control mode can be more preventive of noise by periodically turning on and off the light emission, however, the resolution of the reproduced image becomes lower.

Thus, in the present preferred embodiment, it is arranged that the light emitting control mode is selectively switched by the user depending oh the original document to be reproduced.

In such a case, it is necessary to perform the processes of detecting the surface voltage and the toner adhesion amount for every time of the light emitting control for the purpose of stabilizing the image reproduction, followed by the related above-mentioned correction. Further, in this case, it is necessary to provide a control program and a gradation correction table or an exposure amount correction table for every time of the light emitting control. However, this results in an increased memory capacity.

Therefore, in the present preferred embodiment, a gradation correction table for one light emitting control mode (which is the first light emitting control mode in the embodiment) is stored, while, for another light emitting control mode, only the shifted amounts from the above-mentioned gradation correction table are stored. Then, when another light emitting control mode is selected, data for emitting a beam of laser light is determined by adding the foregoing shift amount to the value of the gradation correction table of the first light emitting control mode.

Further, in the present preferred embodiment, detecting the surface voltage and the toner adhesion amount for stabilizing image reproduction is performed in one light emitting control mode (which is the first light emitting control mode in the present preferred embodiment), and only the gradation correction table in the first light emitting control mode is stored. Then the above-mentioned correction is done at step S604 of FIG. 42. Thereafter, the light emitting control mode is switched at the timing when the copying process is started at steps S605 to S607 of FIG. 42.

This arrangement allows a simplification of the control program and control data and a substantial reduction in the memory capacity.

In the second light emitting control mode, the light amount is insufficient relative to that of the first light emitting control mode, by the degree which the laser light emission is turned off within one pixel. As a result, the toner adhesion amount of the second light emitting control mode becomes less than that of the first light emitting control mode. Thus, in order to compensate for the light amount, the maximum light amount is increased as compared with that of the first light emitting control mode.

The laser power light emitting control switching table of Table 11 shows these relationships, where the maximum light amount is changed concurrently with the switching of the light emitting control mode according to Table 11. This allows the effect on the memory capacity to be suppressed to only a small one.

TABLE 11

Laser Power Emitting Control Switching Table

| No. | First emitting control mode maximum light amount ($mW/cm^2$) | Second emitting control mode maximum light amount ($mW/cm^2$) |
|---|---|---|
| 0 | 0.90 | 1.05 |
| 1 | 0.95 | 1.10 |
| 2 | 1.00 | 1.15 |
| 3 | 1.05 | 1.20 |
| 4 | 1.10 | 1.25 |
| 5 | 1.15 | 1.30 |
| 6 | 1.20 | 1.35 |
| 7 | 1.25 | 1.40 |
| 8 | 1.30 | 1.45 |
| 9 | 1.35 | 1.50 |
| 10 | 1.45 | 1.60 |
| 11 | 1.55 | 1.70 |
| 12 | 1.65 | 1.80 |
| 13 | 1.80 | 1.95 |
| 14 | 1.90 | 2.05 |
| 15 | 2.00 | 2.15 |

(k) Flow of Printer control (k-1) Explanation of Main routine

Figure 30:
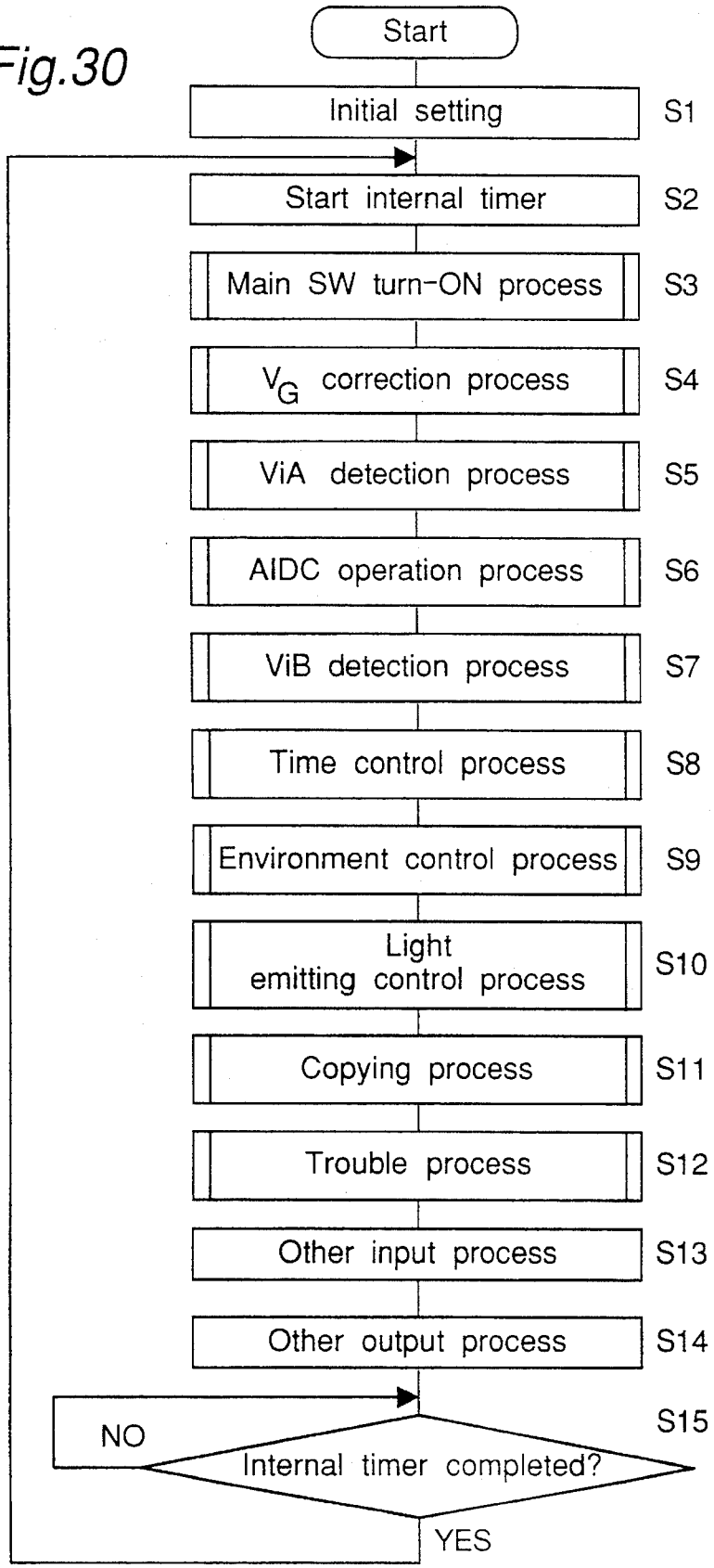
FIG. 30 is a flowchart of a main routine of a copying control process executed by the digital copying machine of the preferred embodiment.

FIG. 30 is a flowchart of a main routine executed by the digital color copying machine. First of all, when the power switch of the machine is turned ON, an initialization is performed where internal registers, various kinds of timers and the like are set into their initial setting values at step S1. Thereafter, the internal timer that specifies the elapsed time of the main routine is started at step S2. Then the following processes of steps S3 through S12 are performed as described below.

Figure 31:
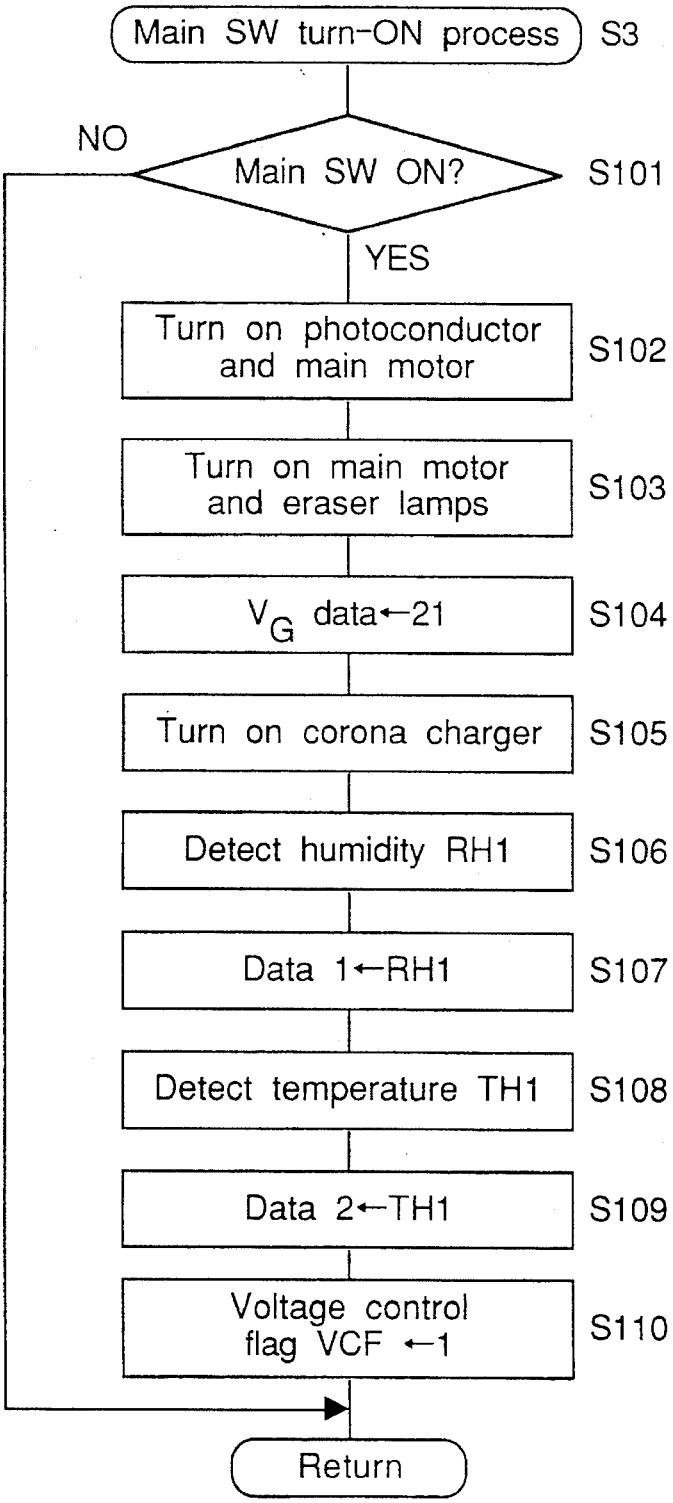
FIG. 31 is a flowchart of a main switch turn-ON process shown in FIG. 30.

First of all, at step S3, the main switch (SW) turn-ON process shown in FIG. 31 is performed. Thereafter, at step S4, a $V_G$ correction process shown in FIGS. 32 and 33 is performed, where respective ones of the dark-part voltage Vo are detected corresponding to one rotation of the photoconductive drum 41 and the correction amount $\Delta V_G$ which may change due to the temperature is determined based on the obtained data of the dark-part voltages Vo.

Figure 37:
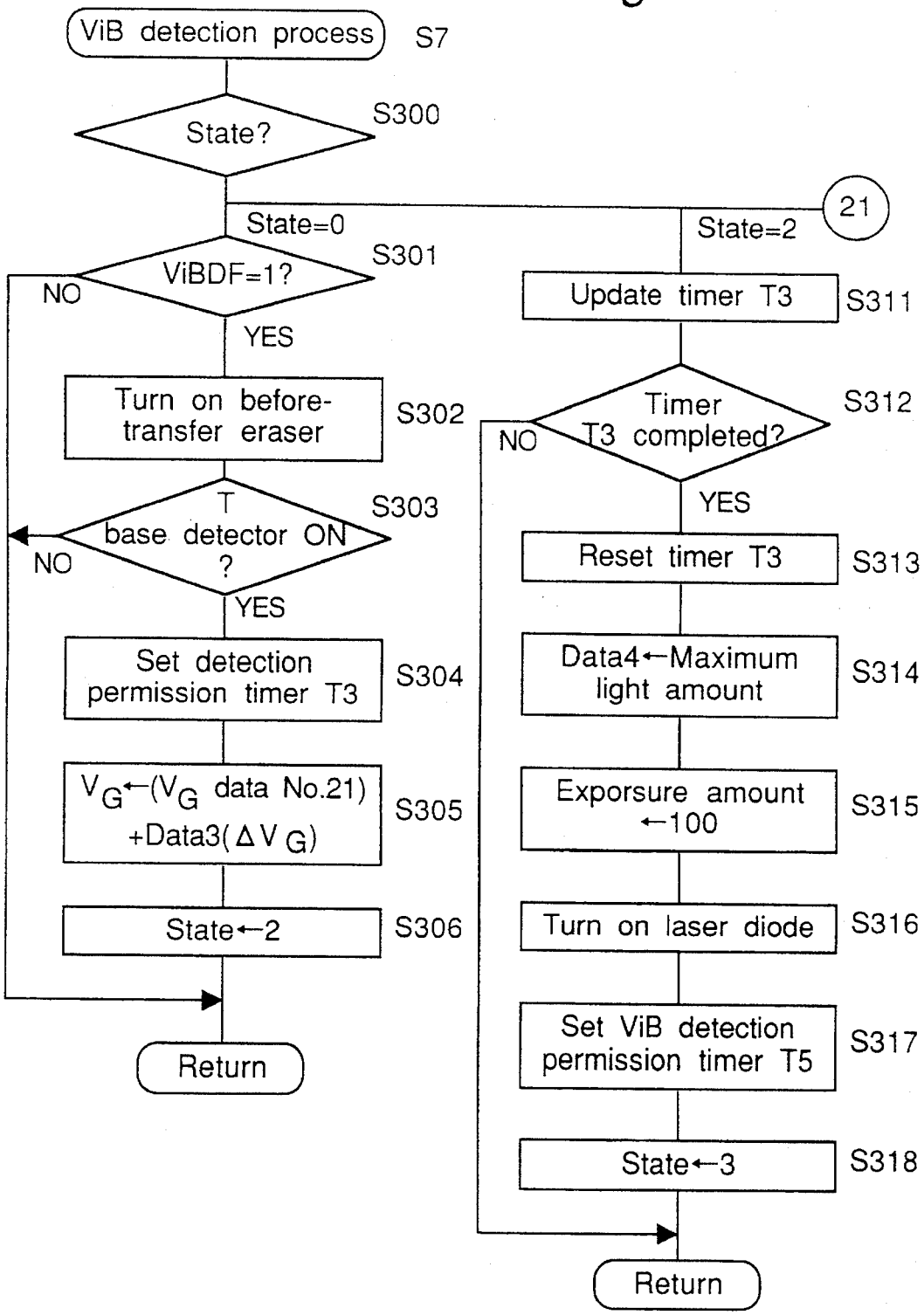
FIG. 37 is a flowchart of a first part of a ViB detection process shown in FIG. 30.
Figure 38:
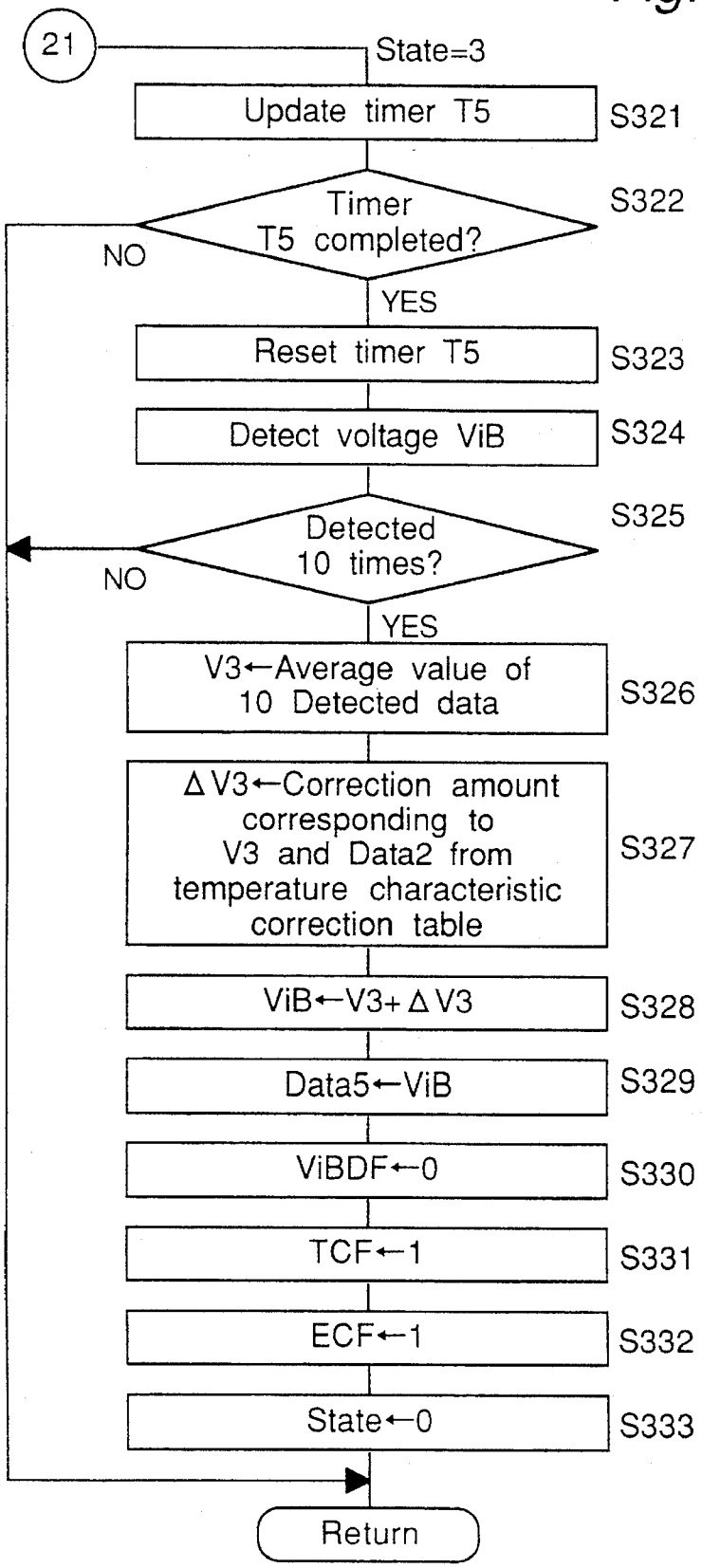
FIG. 38 is a flowchart of a second part of the ViB detection process shown in FIG. 30

Thereafter, at step S5, the ViA detection process shown in FIGS. 34 and 35 is performed, where respective ones of the bright-part voltage ViA are detected corresponding to one rotation of the photoconductive drum 41, and then the light amount is determined by determining the sensitivity thereof. Then at step S6, the AIDC operation process shown in FIG. 36 is performed, where the AIDC operation is performed with a higher accuracy under the above-mentioned set conditions. Thereafter, at step S7, the ViB detection process shown in FIGS. 37 and 38 is performed, where the reference voltage ViB for copying is determined.

Figure 42:
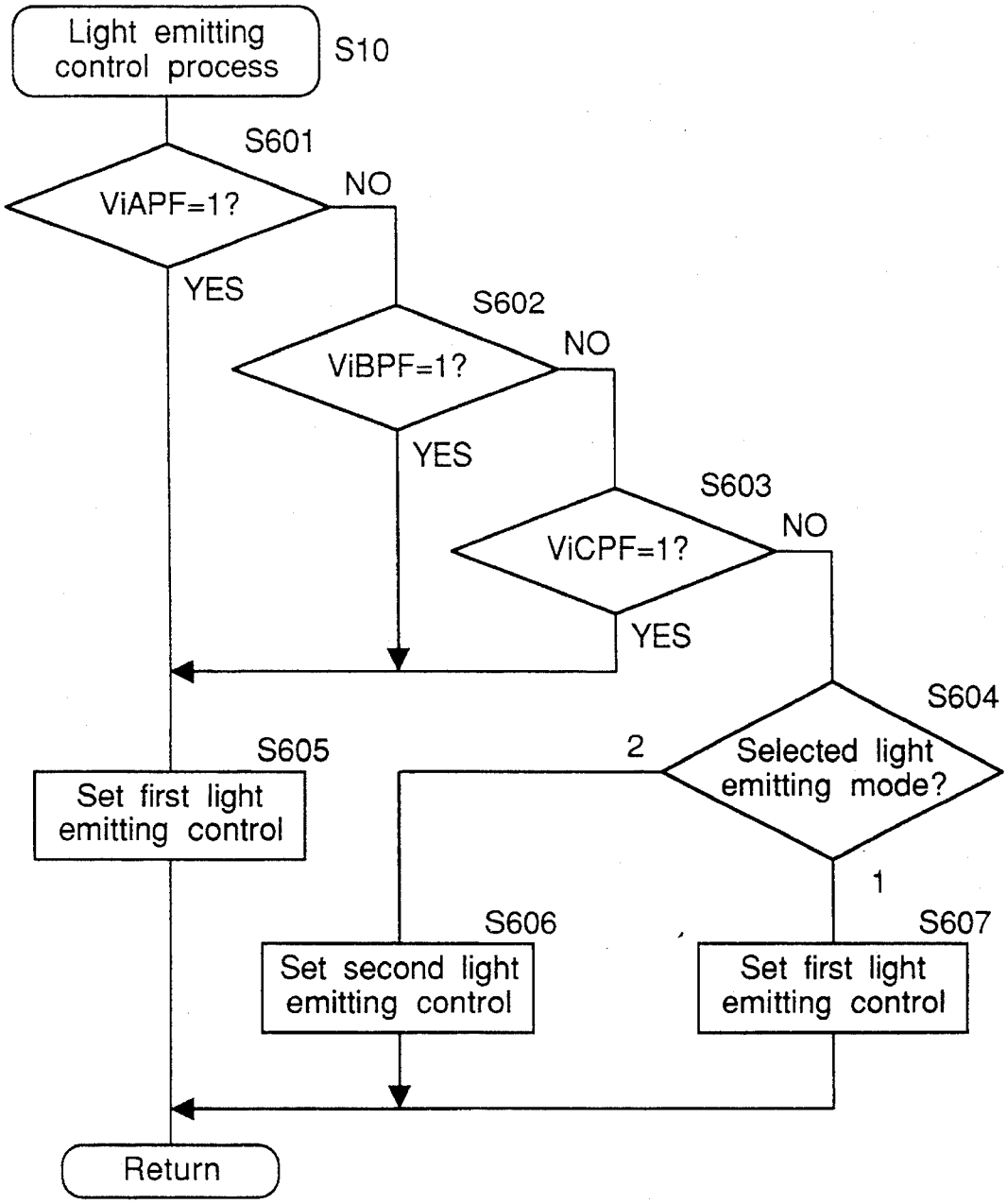
FIG. 42 is a flowchart of a light emitting control process shown in FIG. 30.
Figure 51:
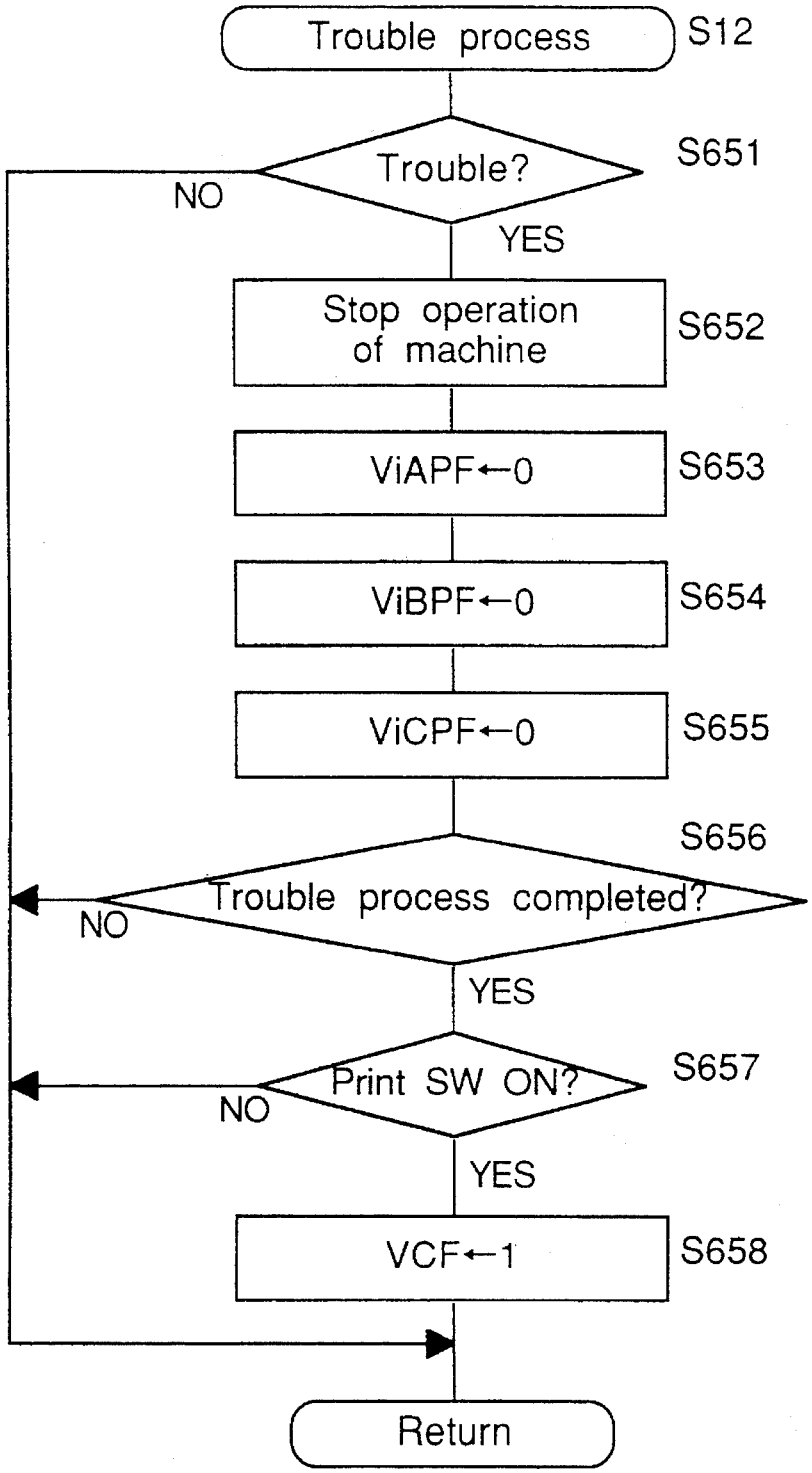
FIG. 51 is a flowchart of a trouble process shown in FIG. 30.

Thereafter, at step S8, a time control process shown in FIGS. 39 and 40 is performed, and then at step S9, an environmental measurement process shown in FIG. 41 is performed. Thereafter, at step S10, the light emitting control process shown in FIG. 42 is performed, and then at step S11, the copying process shown in FIGS. 43 to 50 is performed. After the step S11, at step S12, a trouble process shown in FIG. 51 is performed, and then there are performed not only the other input process at step S13 but also the other output process at step S14. Then, the program flow is temporality stopped at step S14 until counting of the internal timer is completed, and then when the counting of the internal timer is completed (YES at step S15), the program flow goes back to step S2.

First of all, the outline of the image stabilizing control shown in the control flow is described below.

In order to enhance the accuracy of the automatic image density control (AIDC) intended for stably forming images, it is necessary to keep both of the dark-part voltage Vo and the bright-part voltage Vi constant under any conditions upon forming the reference toner image. Therefore, prior to the AIDC operation process of step S6, the $V_G$ correction process of step S4 and the ViA detection process of step S5 are performed.

In the $V_G$ correction process of step S4, in order to eliminate the effect of any change in the surface voltage of the photoconductive drum 41 in the circumferential direction thereof, respective ones of the dark-part voltage Vo are detected corresponding to one rotation of the photoconductive drum 41, and then the average value thereof is calculated as the surface voltage Vo. Thereafter, in the ViA detection process of step S5, an electrostatic latent image is formed on the photoconductive drum 41 in the circumferential direction thereof with the above-determined surface voltage Vo and a predetermined light amount, wherein respective ones of the bright-part voltage Vi are detected corresponding to one rotation of the photoconductive drum 41, and then the average value thereof is calculated as the detected voltage ViA. Further, data of the maximum light amount is determined. The above AIDC operation of step S6 is performed based on the grid voltage $V_G$ and the maximum light amount determined in this manner, and then, the grid voltage $V_G$, the development bias voltage $V_B$ and the gradation correction table are selected depending on the detected value of the toner adhesion amount.

Subsequently, the copying process is performed. In the voltage control intended for correcting the change in the surface voltage upon the copying process, the surface voltage is detected by forming an electrostatic latent image pattern only on a part of the photoconductive drum 41 which is a part located between successive images, so as to reduce the copying time.

First of all, in the ViB detection process of step S7, an electrostatic latent image is formed at a position between successive images with the grid voltage $V_G$ and the light amount in the possible best state ever obtained in the process including the AIDC process and the processes performed before the AIDC operation, and then a bright-part voltage Vi is measured as a reference voltage value ViB.

In the copying process of step S11, an electrostatic latent image pattern is formed at the same position under the same conditions as those in the ViB detection process of step S7, and then the bright-part voltage Vi is measured as ViC. Thereafter, the maximum light amount is correct based on the difference between the detected voltage value ViC and the above-determined reference voltage value ViB. In the case of the multicopying, the bright-part voltage ViC is detected for each one copy, and then the maximum light amount is corrected. This is because, even if a slightly small change in the surface voltage is caused, this leads to a remarkable effect in the reproduced full-color images.

(k-2) Main switch turn-ON process

FIG. 31 shows a flowchart of the main switch turn-ON process for performing the initialization process of the units provided around the photoconductive drum 41 at step S3 of FIG. 30.

Referring to FIG. 31, at step S101, it is checked whether or not the main switch of the operation panel 221 that gives an instruction for copying start is turned on. With the main switch turned ON, at steps S102 and S103, the photoconductive drum 41, a main motor, the eraser lamp 42, and a before-transfer eraser lamp 55 are turned on. On the other hand, if the main switch is not turned on, the program flow returns to the main routine.

Thereafter, at step S104, in order to apply a predetermined grid voltage $V_G$, the grid voltage $V_G$ data (No. 21, $V_G$=−800 V in the present preferred embodiment) is set. Then at step S105, the above-determined grid voltage $V_G$ is applied to the grid of the corona charger 43.

Steps S106 through S109 are processes for detecting and storing the temperature and the humidity around the photoconductive drum 41. The resulting temperature and humidity data are used for correcting the temperature characteristic of the voltage sensor 44, the ViA detection process for determining the maximum light amount, and the process for determining the AIDC operation, which are described in detail later.

First of all, at step S106, the humidity is detected as RH1. This detected humidity RH1 is stored as data 1 in the internal RAM at step S107. Thereafter, at step S108, the temperature is detected as TH1. This detected temperature TH1 is stored as data 2 in the internal RAM at step S109. Finally, at step S110, a voltage control flag VCF is set to one, and then the program flow returns to the main routine.

(k-3) $V_G$ correction process

FIGS. 32 and 33 are flowcharts of the $V_G$ correction process of step S4 shown in FIG. 30. In this process, respective ones of the dark-part voltage Vo are detected corresponding to one rotation of the photoconductive drum 41, thereby determining the temperature correction amount $\Delta V_G$.

Referring to FIG. 32, first of all, the current state number is checked at step S151, where the program flow is branched into 0 and 1 depending on the state number. This state number is set to 0 every time the digital color copying machine is turned ON. In all the cases of the state processing, as described in detail later, the state number is set to 0 when the machine is turned ON.

In the case of a state number of 0, there are checked the voltage control flag VCF at step S152, a before-copy voltage control flag BVCF at step S161, and an after-copy voltage control flag AVCF at step S163. If any one of the flags VCF, BVCF and AVCF is set to 1, it is such a state as controlling the voltage at present.

If the flag VCF=1 (YES at step S152), cleaning of the charge wire of the corona charger 43 is started at step S153, and completion of the cleaning the same is judged at step S154. If the cleaning thereof is completed, the program flow goes to step S155. Otherwise, the program flow returns to the main routine, directly.

If YES at step S154, all the aforementioned flags VCF, BVCF and AVCF are reset to 0, respectively, at steps S155, S156 and S177. Thereafter, at step S158, the before-transfer eraser lamp 55 is turned off, and then, at step 159, a detection permission timer T1 is set, thereby starting counting of the timer T1. Thereafter, at step S160, the state number is set to "1", the program flow returns to the main routine.

However, even with before-copy voltage control flag BVCF set to 1 (YES at step S161), if the print switch has not been pressed (NO at step S162), the program flow returns to the main routine, directly. Further, even with the after-copy voltage control flag AVCF set to 1 (YES step S163) in the case of NO at step S161, if the copying process of the final page has been completed, the program flow returns to the main routine directly.

The reason why the before-transfer eraser lamp 55 is turned off at step S158 is as follows. During the AIDC operation, which is described in detail later, when the light from the before-transfer eraser lamp 55 may go around through the developing part and then is incident onto the AIDC sensor 210, the surface voltage slightly lowers, thereby making accurate measurement impossible. In this state, if the AIDC operation is performed by executing the later-described voltage control and feeding the control values into the units, the desired image forming conditions could not be obtained. Therefore, the before-transfer eraser lamp 55 is turned off during the voltage detection control so that the conditions are adjusted to the predetermined AIDC operation conditions.

Referring to FIG. 32, if NO at step S161 in the state number of 1, the program flow goes to step S171 of FIG. 33, and then the timer T1 is updated. If counting a predetermined time of the timer T1 is completed (YES at step S172), then it is judged that the surface voltage of the photoconductive drum 41 has been stabilized, the timer T1 is reset to zero, respectively, at steps S172 and S173. The timer T1 is provided for counting the elapsed time required for the surface voltage of the photoconductor to be stabilized after the corona charger 43 is turned on and the motor of the photoconductive drum 41 motor is started.

Then, the voltage detection is performed by the voltage sensor 44 at step S174, and then it is judged whether or not the number of times of the voltage detection becomes 100 at step S175. If YES at step S175, the 100 detected voltage data are averaged, the resulting average value data being assumed as V1 at step S176. The measurement of this 100 detected data corresponds to the time of one rotation of the photoconductive drum 41, and then the above-mentioned averaging process is to determine the average voltage V1 in the one rotation of the photoconductive drum 41. This is because of the following fact. Since the voltage sensor 44 has the above-mentioned dependent characteristic on the distance d between the sensor surface of the voltage sensor 44 and the surface of the photoconductive-drum 41 as shown in FIG. 20, decentering of the photoconductive drum 41 in the diameter direction thereof leads to a change in the distance d therebetween when the photoconductive drum 41 is rotated, and therefore leads to a change in the output voltage of the voltage sensor 44. In order to dissolve the above problems, respective ones of the surface voltage corresponding to one rotation of the photoconductive drum 41 are detected and then the average value thereof is calculated.

Thereafter, based on the sensor temperature correction table of Table 8, the temperature correction voltage amount ΔV1 corresponding to the average value V1 of those corresponding to one rotation of the photoconductive drum 41 and the data 2 of the temperature TH1 obtained at step S108 of FIG. 31 are obtained at step S177. Thereafter, the sum voltage (V1+ΔV1) is assumed as the surface voltage Vo of the photoconductive drum 41 at step S178.

Subsequently, the correction amount $\Delta V_G$ of the grid voltage corresponding to the above-obtained surface voltage Vo is obtained based on Table 4 at step S179. In Table 4, the correction amount $\Delta V_G$ of the grid voltage $V_G$ corresponds to the unit of steps, one step being correspondent to 20 V. Data of this correction amount $\Delta V_G$ are stored as data 3 in the internal RAM at step S182.

Then, if the absolute value of this correction amount $\Delta V_G$ is larger than 100 V (NO at step S181), it is judged that a trouble has taken place in the copying machine, followed by a trouble process at step S185.

If no trouble has taken place (YES at step S181), subsequently the correction value $\Delta V_G$ is stored as data 3 at step S182, and then the ViA permission flag ViAPF is set to "1" at step S183. Thereafter, the state number is set to "0" at step S184, and then the program flow returns to the main routine.

(k-4) ViA detection process

FIG. 34 is a flowchart of the ViA detection process at step S5 of FIG. 30. The ViA detection process is provided for determining the maximum light amount of the laser diode 264, matching or corresponding to the sensitivity of the photoconductive drum 41.

Referring to FIG. 34, first of all, at step S201, the current state number is checked.

In the case of the state number of "0", it is checked whether or not the ViA permission flag ViAPF is set to "1", wherein the ViA permission flag ViAPF is set to one in the $V_G$ correction process at step S183 of FIG. 33. If the flag ViAPF is not set to one (NO at step S202), the program flow returns to the main routine, directly. If the ViA permission flag ViAPF is set to "1" (YES at step S202), a sum of a predetermined grid voltage $V_G$ data No. 21 (−800 V) and $\Delta V_G$ (stored as data 3, step S182 of FIG. 33) is stored as the grid voltage $V_G$.

Then, the predetermined maximum light amount data of the laser diode 264 (No. 9, 1.15 mW/cm$^2$ in Table 7) is set at step S204, the predetermined light amount level "100" is set and the laser diode 264 is turned on, respectively, at steps S205 and S206. Thereafter, the ViA detection permission timer T2 is set at step S207 thereby starting the counting of the timer T2, and then the state number is set to "1" at step S208. The timer T2 is provided for counting a margin time required when it takes that the electrostatic latent image on the photoconductive drum 41, which is formed by projecting a beam of laser light, passes through the voltage sensor 44 from a timing when the beam of laser light is projected thereonto.

Referring to FIG. 35, in the case of the state number of "1", the timer T2 is updated at step S211, and then it is judged whether or not counting of the timer T2 is completed at step S212. If counting of the timer T2 has been completed (YES at step S212), the timer T2 is reset zero at step S213. Subsequently, there is detected at step S214 the surface voltage ViA of the part projected with the predetermined grid voltage $V_G$ corrected by the $V_G$ correction process (at step S4 of FIG. 30) and the predetermined light amount. Then, If this voltage ViA has been detected 100 times (YES at step S215), then the 100 detected voltages ViA are obtained. Thereafter, the laser diode 264 is turned off at step S216, and the detected voltages ViA are averaged, the resulting average value of the 100 detected voltages ViA being assumed as V2 at step S217. Otherwise (NO at step S215), the program flowreturns to the main routine. The reason why the voltage ViA is repeatedly detected 100 times is to obtain the average value of the 100 detected voltages ViA corresponding to one rotation of the photoconductive drum 41, in a manner similar to that in the $V_G$ correction process at step S4 of FIG. 30.

Then voltage data correction value corresponding to the voltage V2 and the temperature TH1 (data 2) is obtained from Table 8, the sensor temperature characteristic correction table, the resulting value being assumed as ΔV2 at step S218. Thus, a sum of the voltage V2 (which is the average value of the 100 detected voltages data) and the correction amount ΔV2 is assumed as ViA at step S219.

Subsequently, it is checked whether or not the data 2 which is the temperature data TH1 is less than 20° C. or not at step S220. Then, based on the temperature TH1 of data 2, the maximum light amount data is obtained from either one of the low-temperature ViA correction table of Table 6 or the high-temperature ViA correction table of Table 7, respectively, at steps S221 and S222, and then the program flow goes to step 223.

At step S223, the resulting light amount data are stored as data 4 in the internal RAM at step S223. Further, the ViA permission flag ViAPF is reset to "0" at step S224, and then the AIDC permission flag AIDCPF is set to "1" at step S225. Further the state number is set to "0" at step S226, and then the program flow returns to the main routine.

(k-5) AIDC operation process

FIG. 36 is a flowchart of the AIDC operation process at step S6 of FIG. 30. In this AIDC operation process, the AIDC operation is executed at the grid voltage $V_G$ and the maximum light amount which are determined by the $V_G$ correction process at step S4 of FIG. 30 and the ViA detection process at step S5 of FIG. 30.

First of all, at step S251, it is checked whether or not an AIDC permission flag AIDCPF has been set to "1". This flag AIDCPF is set in the ViA detection process at step S225 of FIG. 31. If this flag AIDCPF is not set to "1" (NO at step S251), the program flow returns to the main routine, immediately. If the AIDC permission flag AIDCPF is set to "1" (YES at step S251), a half-tone density detection process is performed for each color of cyan (C), magenta (M), yellow (Y), and black (K), respectively, at steps S252 through S255. In this case, at the predetermined grid voltage $V_G$ obtained by correcting the same using the correction amount $\Delta V_G$ which has been determined by the foregoing voltage detection and using the predetermined maximum light amount determined by the voltage detection, image density levels of the half-tone images of respective colors which are developed using the predetermined development bias voltage $V_B$ on the charged and exposed photoconductive drum 41 are detected by the AIDC sensor 210, thereby executing the above-described correction.

At step S256, a set of the grid voltage $V_G$ and the development bias voltage $V_B$, and gradation correction tables corresponding to the detected voltage for each color are selected from the AIDC table of Table 1. Thereafter, the AIDC permission flag AIDCPF is reset to "0" at step S257, and then the ViB detection flag ViBDF is set to "1" at step S258. Thereafter, the program flow returns to the main routine.

(k-6) ViB detection process

FIGS. 37 and 38 are flowcharts of the ViB detection process at step S7 of FIG. 30. In this process, for the purpose of correcting the change in the surface voltage of the photoconductive drum 41 in the copying process, a voltage pattern is prepared and formed on the photoconductive drum 41 under conditions of the grid voltage $V_G$ obtained in the $V_G$ correction process and the maximum light amount obtained in the ViA detection process. Using the detected voltage ViB of the voltage pattern, the surface voltage upon the copying process is corrected.

Referring to FIG. 37, first of all, at step S300, the state number is checked.

In the state number of "0", first of all, at step S301, it is checked whether or not a ViB detection flag ViBDF is set to "1". This flag ViBDF is set in the AIDC operation process at step S258 of FIG. 36. If this flag ViBDF is not set to "1" (NO at step S251), the program flow returns to the main routine immediately.

Thereafter, at step S302, the before-transfer eraser lamp 55 is turned on. The reason why the process of step S302 is performed is as follows. The detected voltage ViB is necessary to be detected under the same conditions as those in the voltage pattern (ViC voltage pattern) for measuring the surface voltage or for correcting the maximum light amount for each time of the copying process, which will be described in detail later. However, if the pattern is prepared and formed thereon under the conditions that the before-transfer eraser lamp 55 is turned off, the conditions are different from those in the measurement of the voltage ViC, so that a proper maximum light amount could not be selected. Thus, the before-transfer eraser lamp 55 is turned on in the present preferred embodiment.

At steps S303 and S304, when the T base sensor for detecting the predetermined rotational position of the transfer drum 51 is turned ON, a detection timer T3 is set and then counting of the detection timer T3 is started. Otherwise (NO at step S303), the program flow returns to the main routine.

The detection timer T3 is provided for counting the time for which the time elapses until the corrected grid voltage $V_G$ is applied to the grid of the corona charger 43 and it is stabilized. Then, a sum of the predetermined $V_G$ data 21 (800 V) and the data 3 (the correction amount $\Delta V_G$) determined by the $V_G$ correction process shown in FIG. 33 is set to the grid voltage $V_G$ at step S305, and then the state number is set to "2" at step S306. Further, the process of the state number of "0" is completed, and then the program flow returns to the main routine.

In the case of the state number of "2", first of all, the timer T3 is updated at step S311, and then it is judged whether or not counting of the timer T3 is completed at step S312. If counting of the timer T3 is completed (YES at step S312), the timer T3 is reset at step S313, and then the program flow goes to step S314. Otherwise (NO at step S312), the program flow returns to the main routine.

Then, the corrected maximum light amount data are stored as data 4 at step S314, and then the predetermined light amount level "100" is set as the maximum light amount at step S315. Thereafter, the laser diode 264 is turned on at step S316. Further, the ViB detection permission timer T5 is set to one at step S317, and then the state number is set to "3" at step S318. Then the processing of the state number "2" is completed. The timer T5 is provided for counting a sum of the time for when the time elapses until the electrostatic latent image formed on the photoconductive drum 41 reaches the voltage sensor 44 from a timing when the laser diode 256 is turned, and a margin time thereof.

Referring to FIG. 38, in the state number of "3", first timer T5 is updated at step S321, and then it is judged whether or not counting of the timer T5 is completed at step S322. If YES at step S322, the timer T5 is reset at step S323, and then the voltage pattern for detecting the voltage is detected at step S324. Then the program flow goes to step S325. Otherwise (NO at step S322), the program flow returns to the main routine.

Further, it is judged whether or not the 10 detected voltages have been detected at step S325. If YES at step S325, the program flow goes to step S326. Otherwise (NO at step S325), the program flow returns to the main routine. At step S326, the average value of the 10 detected voltages is calculated as V3 at step S326.

The reason why the voltage detection is effected 10 times at step S326 is as follows. Whereas the ViC pattern, which is described in detail later, is necessary to be prepared and formed at a position on the photoconductive drum 41 between the successive images, there is not enough time to detect the voltage pattern corresponding to one rotation of the photoconductive drum 41 at the part between successive images. Thus, it is necessary to prepare and form the electrostatic latent image for a short time at a part on the photoconductive drum 41, and then to detect the voltage pattern only using the part thereof. In this case, unless the voltage pattern ViB, which serves as the reference voltage for the ViC voltage pattern, is prepared and formed at the predetermined same position on the photoconductive drum 41 as that for the ViC voltage pattern, the accurate correction could not be obtained because of effects of decentering of the photoconductive drum 41 and the nonuniformity of the surface voltage on the outer circumference of the photoconductive drum 41. Thus, there arises a need of detecting both the ViC voltage pattern and the ViB voltage pattern for the same time and at the same on the photoconductive drum 41.

Based on the voltage V3 data and temperature data 2 (TH1), the correction value is calculated from the voltage sensor temperature correction table of Table 8, the resulting data being assumed as ΔV3 at step S327. Then, a sum of the voltage V3 and the correction amount ΔV3 is obtained as a detected voltage value ViB at step S328, and then the resulting data are stored as data 5 in the internal RAM at step S329. Further, the ViB detection flag ViBDF is reset to "0" at step S330, and then both the time control flag TCF and the environment control flag ECF are set to "1", respectively, at steps S331 and S332. Finally the state number is set to "0" at step S333, and then the program flow reruns to the main routine.

(k-7) Time control process

FIGS. 39 and 40 are flowcharts of a flow of the time control process is provided for managing the time that elapses after the completion of the ViB detection process at step S8 of FIG. 30.

In the present preferred embodiment, various kinds of processes are sequentially performed, including the $V_G$ correction process at step S4 of FIG. 30, the ViA detection process at step S5 of FIG. 30, the AIDC process at step S6 of FIG. 30, and the ViB detection process at step S7 of FIG. 30, where the AIDC process is performed every time prior to the ViB detection process. This AIDC process is provided for controlling the toner adhesion amount of the toner adhering on the photoconductive drum 41. Therefore, if the charging amount of the developer, the electrostatic characteristics of the photoconductive drum 41 or the like change due to the idle time or stopping time, the quality of the reproduced images could change. To obtain successful images at all times, it may be proper to perform the optimum control of the toner adhesion amount by effecting the AIDC control process every time, however, the AIDC process requires a relatively long time, then causing a lower copying speed. Accordingly, in this time control process, the idle time that will affect the before-development charging characteristics and the electrostatic characteristics of the photoconductive drum 41 is obtained by experiments, and a step is involved to decide whether or not the AIDC control should be effected based on the idle time, so that the AIDC process be effected only when necessary.

Referring to FIG. 39, first of all, at step S351, the state number is checked.

In the state number of "0", at step S352, it is checked whether or not a time control flag TCF to be set in the ViB detection process at step S331 of FIG. 38 is set to "1". If the time control flag TCF is set to "1" (YES at step S352), the flag TCF is reset to "0" at step S353, and then counting the elapsed time Te is started at step S354. Thereafter, the state number is set to "1" at step S355, and then the program flow returns to the main routine. If NO at step S352, the program flow returns to the main routine, directly.

Referring to FIG. 40, in the state number of "1", first of all, the aforementioned time Te counting is updated at step S356, and then it is checked whether or not the elapsed time Te is smaller than 10 minutes at step S357, and further it is checked whether or not the elapsed time Te is smaller than one hour.

If it is not more than 10 minutes from the timing when obtaining the voltage ViB (YES at step S357), then the program flow returns to the main routine.

If the elapsed time Te is not less than 10 minutes and also less than 1 hour from the timing when obtaining the voltage ViB (NO at step S357 and YES at step S358), it is then judged whether or not the print switch has been pressed at step S359. If the print switch has not pressed (NO step S359), the program flow returns to the main routine directly. On the other hand, if the print switch has pressed (YES at step S359), the program flow goes to step S360, and then an after-copy voltage control flag AVCF is set to "1" at step S360. Subsequently, counting the elapsed time Te is reset at step S362, and then the state number is set to "0" at step S363. In this case, since the copying process is effected, the AIDC operation is executed upon completion of the copying process.

Further, if the elapsed time Te is 1 hour or longer since the timing when obtaining the voltage ViB (NO at step S358), a before-copy voltage control flag BVCF is set to "1" at step S361. Thereafter, the processes of steps S362 and S363 are performed, and then the program flow returns to the main routine. In this case, the AIDC operation is executed before the copying process.

(k-8) Environment control process

FIG. 41 shows the flow of the environment control process at step of FIG. 30. Even if the elapsed time after the AIDC is managed by the time control process at step S8 of FIG. 30, a steep change in the environments such as the temperature, the humidity or the like may lead to changes in the charging amount of the developer and the electrostatic characteristics of the photoconductive drum 41 so that a proper reproduced image could not be obtained. Thus, by detecting the environmental changes at the time when the print SW is pressed, from the environments at the time when the preceding AIDC operation is effected, it is arranged that the AIDC operation is forcedly effected before the copying process only. if there has been a substantial change in the environments, in order to obtain a successful proper reproduced image. The environments for the preceding AIDC operation in the present preferred embodiment is measured based on the environment data obtained by the main switch turn-ON process at step S3 of FIG. 30.

Referring to FIG. 41, first of all, at step S401, it is checked whether or not an environment control flag ECF which is set to one in the ViB detection process at S332 of FIG. 38 is set to "1". If the environment control flag ECF is set to "1" (YES at step S401), then subsequently it is judged whether or not the print switch has been pressed at step S402. Otherwise (NO at step S401 or NO at step S402), the program flow returns to the main routine, directly.

If YES at step 402, the temperature is detected at step S403, the resulting data being assumed as TH2. Then if there is a difference over 5° C. between the data 2 (the temperature TH1) which is the temperature data detected in the main switch turn-ON process, and the temperature data TH2 at step S404, the before-copy voltage control flag BVCF is set to "1" at step S405, and then the temperature data TH2 are stored as the data 2 in the internal RAM, namely, the temperature data TH1 are replaced by the temperature data TH2. Further, if the temperature difference therebetween is judged to be less than 5° C. (NO at step S404), or otherwise the process of step S406 has been completed, the humidity is detected, the resulting data being assumed as RH2 at step S407.

Furthermore, if there is a difference over 10% RH between the humidity data 1 (RH1) and the humidity RH2 (YES at step S408), the before-copy voltage control flag BVCF is set to "1" at step S409, and then the humidity data RH2 are stored as the data 1 in the internal RAM, namely, the humidity data RH1 are replaced by the humidity data RH2 at step S410. Thereafter, the program flow returns to the main routine.

If the environment control flag ECF is not set to "1" (NO at step S401), or if the print switch has not been pressed (NO at step S402), the program flow returns to the main routine, immediately.

(k-9) Light emitting control process

FIG. 42 shows the flow of the light emitting control process at step S10 of FIG. 30. This process is provided for changing the light emitting control mode of the laser diode 264 between the processes of the voltage detection and the image formation. The light emission of the laser diode for the voltage control is performed all in the first light emitting control mode. Accordingly, even if the second light emitting control mode is selected in the process of the image formation, the laser light emitting control for the voltage control is forcedly set into the first light emitting control mode. As a result, various kinds of correction tables can be simplified.

Referring to FIG. 42, first of all, at steps S601 through S603, it is respectively checked successively whether or not the ViA permission flag ViAPF is set to "1", the ViB permission flag ViBPF is set to one, and the ViC permission flag ViCPF is set to one. If any one of the flags ViAPF, ViBPF and ViCPF is set to one (YES at at least one of steps S601, S602 and S603), the copying machine is set in the voltage control state, and therefore the light emission mode of the laser diode 264 is set into the first light emitting control mode at step S605. Then the program flow returns to the main routine.

If none of the flags ViAPF, ViBPF and ViCPF is set to one, the copying machine is in the image forming process, and therefore the light emitting control mode selected is judged at step S604. If the second light emitting control mode is selected, the second light emitting control mode is selected at step S606. On the other hand, if the first light emitting mode is selected, the first light emitting control mode is selected at step S607. Then the program flow returns to the main routine.

In the second light emitting control mode, since the differences of the gradation correction table between those in the first and second light emitting control modes have been stored, by using the gradation correction table of the first light emitting control mode, the differences data are read from the storage memory, and the read differences are added to the gradation correction data of the first light emitting control mode, thereby obtaining the gradation correction data in the second light emitting control mode. Further, the maximum light amount of the laser diode 264 is selectively switched by the gain switching section 255 shown in FIG. 8 according to the laser power light emitting control switching table of Table 11.

(k-10) Copying process

FIGS. 43 through 50 show the flow of the copying process at step S11 of FIG. 30. The copying process is provided for correcting the change in the surface voltage during the copying operation or process and the change in the electrostatic characteristics caused after the AIDC operation.

Figure 43:
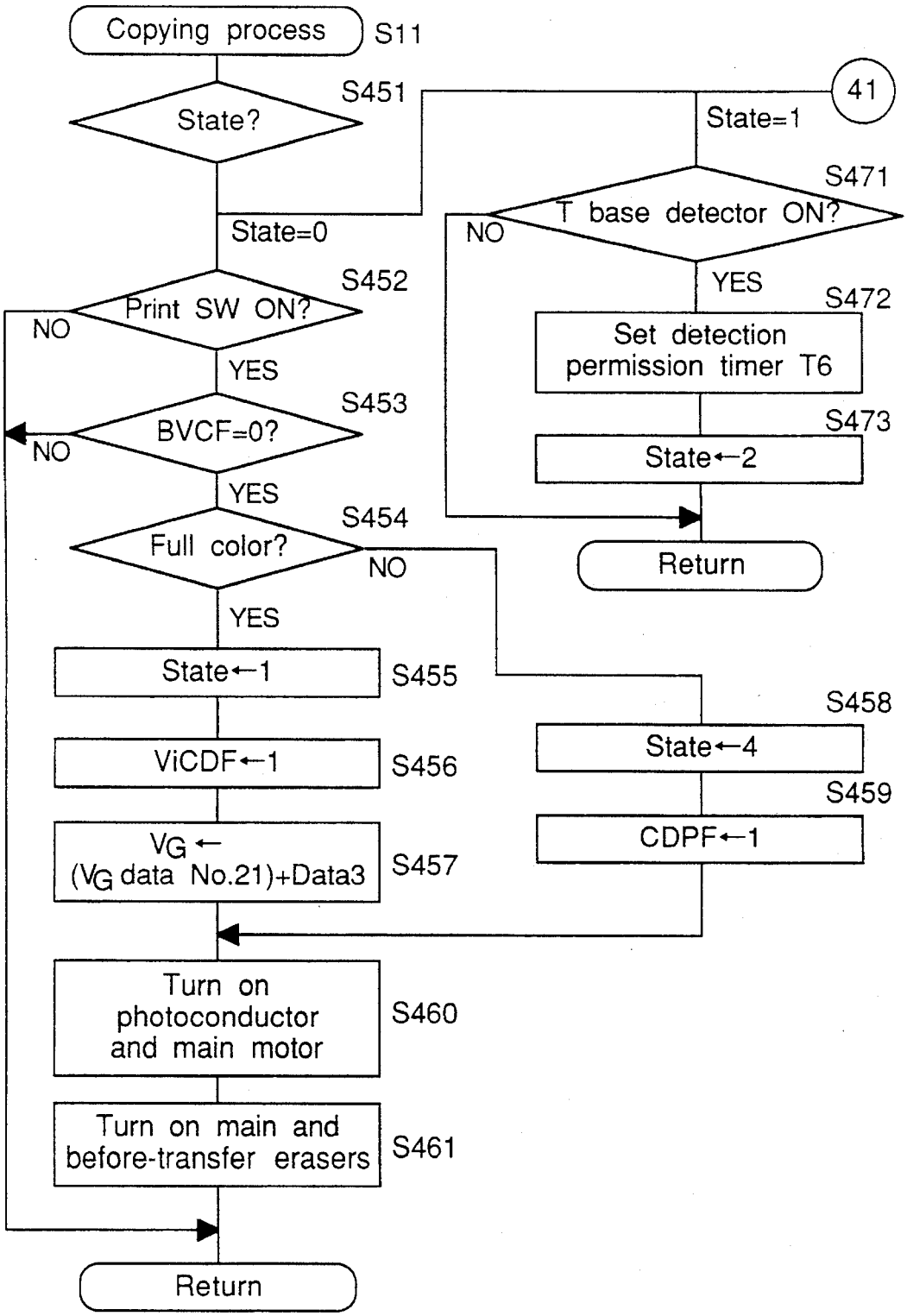
FIG. 43 is a flowchart of a first part of a copying process shown in FIG. 30.

Referring to FIG. 43, first of all, at step S451, the current state number is checked.

In the state number of "0", at step S452, it is checked whether or not the print switch has been pressed. If the print switch has been pressed, then subsequently it is checked whether or not the before-copy voltage control flag BVCF is set to "1" at step S453. The program flow is awaiting by the process of step S453 until the flag BVCF is reset to "0", namely until the AIDC operation is completed If the before-copy voltage control flag BVCF is judged to be reset to zero, then subsequently it is judged whether or not it is set to the full-color mode or the mono-color mode at step S454. If it is set to the full-color mode, the state number is set to "1" at step S455. Then, the ViC detection flag ViCDF is set to "1" at step S456, and then a sum voltage of the predetermined grid voltage $V_G$ No. 21 (−800 V) and the correction amount data 3 ($\Delta V_G$) is set as the grid voltage $V_G$ at step S457, thereby applying the set grid voltage $V_G$ to the grid of the corona charger 43. Then the program flow goes to step S460. On the other hand, if it is set to the mono-color mode at step S454, the state number is set to "4" at step S458, and then a cyan development permission flag CDPF is set to "1" at step S459. Then the program flow goes to step S460.

Finally, at steps S460 and S461, the photoconductive drum 41, the main motor, the main eraser lamp 42 and the before-transfer eraser lamp 55 are turned ON, and then the program flow returns to the main routine.

In the state number of "1", it is checked whether or not a T base signal outputted from the above-mentioned T base detector, which serves as the reference for the transfer drum 51 or representing the rotational position of the photoconductive drum 41 for the transfer drum 51, has been turned ON at step S471. If the T base signal has been turned ON (YES at step S471), a detection permission timer T6 is set at step S472 thereby starting counting of the detection permission timer T6, and then the state number is set to "2" at step S473. Thereafter, the program flow returns to the main routine.

On the other hand, if the T base signal has not turned on (NO at step S471), the program flow returns to the main routine.

The above-mentioned detection permission timer T6 is set in a similar manner to that of the timer T3 for the $V_B$ detection process at step S304 of FIG. 37, because the ViC voltage pattern and ViB voltage pattern need to be prepared and formed at the same position on the photoconductive drum 41.

Figure 44:
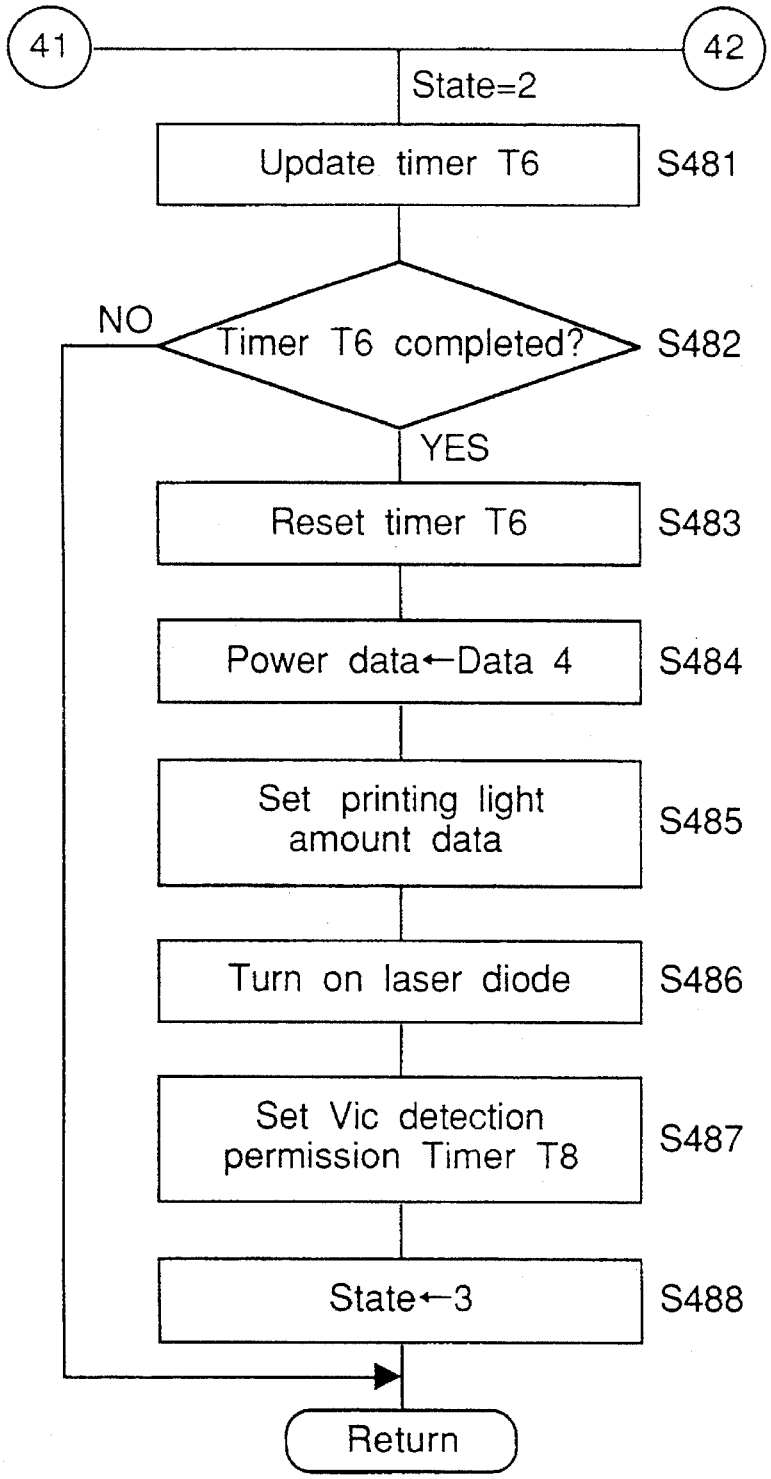
FIG. 44 is a flowchart of a second part of the copying process shown in FIG. 30.

Referring to FIG. 44, in the state number of "2", the timer T6 is updated at step S481, and then it is checked whether or not counting of the timer T6 has been completed. If counting of the timer T6 has been completed (YES at step S482), the timer T6 is reset at step S483, and then the program flow goes to step S484. Otherwise (NO at step S482), the program flow returns to the main routine.

At step S484, the data 4 are stored as a power data for the laser diode 264 at step S484, and then the printing light amount data for printing is set at step S485. Thereafter, the laser diode 264 is turned ON with the maximum light amount data having been determined at step S486, and then the ViC detection permission timer T8 is set at step S487, thereby starting counting of the ViC detection permission timer T8. Then the state number is set to "3" at step S488, and then the program flow returns to the main routine.

The ViC detection permission timer T8 is set in a manner similar to not only that of the timer T5 for the ViB detection process at step S317 of FIG. 37, but also that of the timer T6.

Figure 45:
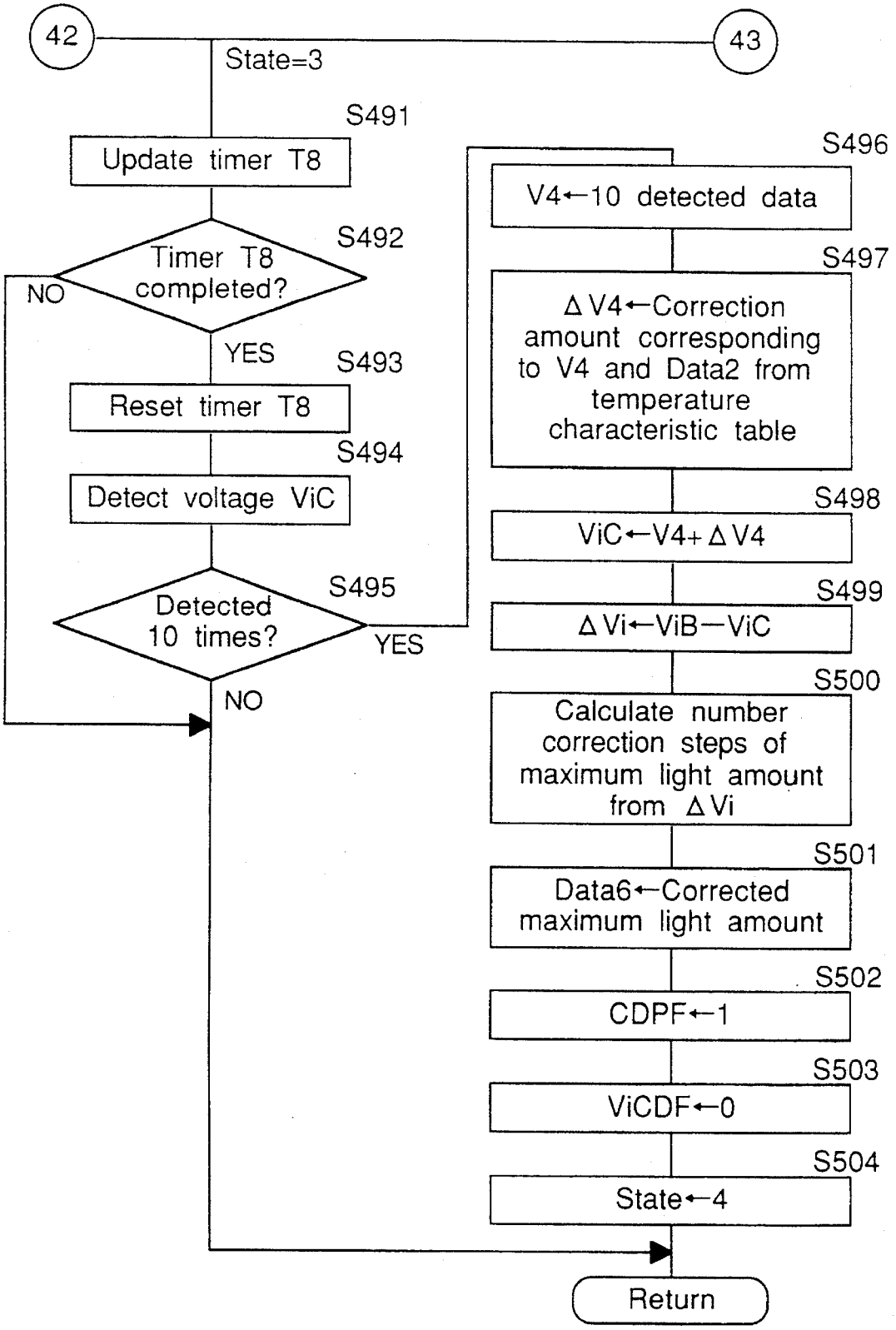
FIG. 45 is a flowchart of a third part of the copying process shown in FIG. 30

Referring to FIG. 45, in the state of "3", the timer T8 is updated at step S491, and then it is judged whether or not the timer T8 has been completed at step S492. If the timer T8 has been completed (YES at step S492), the timer T8 is reset at step S493, and then the program flow goes to step S494. Otherwise (NO at step S492), the program flow returns to the main routine.

At step S494, the voltage ViC of the electrostatic latent image pattern formed on the photoconductive drum 41 under the same conditions as those of the voltage ViB pattern is detected. Thereafter, it is judged whether or not the number of times of detecting the voltage ViC of the ViC voltage pattern has reached 10. If the number of times of ViC detection has reached 10 (YES at step S495), the average value of respective ones of the detected voltage ViC is calculated, and then the resulting value is assumed as voltage data V4 at step S496. Otherwise (NO at step S495), the program flow returns to the main routine.

The reason why respective 10 ones of the voltage ViC are detected is the same as that of detecting the voltage ViB.

Further, based on the voltage data V4 and the voltage sensor temperature correction table of Table 8, the correction amount corresponding to the voltage data V4 and the temperature data 2 (TH1) is obtained, and then the resulting correction amount being assumed as a correction amount ΔV4 at step S497. Subsequently, data of a sum of the voltage data V4 and the correction amount ΔV4 is assumed as a voltage ViC data, which represents data after correcting the voltage sensor temperature characteristics at step S498, at step S498. Then the subtraction data of (the ViB voltage data which are stored as data 5)–(the voltage data ViC) is assumed as an correction amount ΔVi at step S499. Thereafter, the number of steps for the maximum light amount correction of the laser diode 264 corresponding to the difference ΔVi is obtained from the light amount correction table of Table 9 at step S500, and then data of the corrected maximum light amount data are stored as data 6 in the internal RAM at step S501. Thereafter, the cyan development permission flag CDPF is set to "1" at step S502, and the ViC detection flag ViCDF is reset to "0" at step S503. Finally, the state number is set to "4" at step S504, and then the program flow returns to the main routine.

Figure 46:
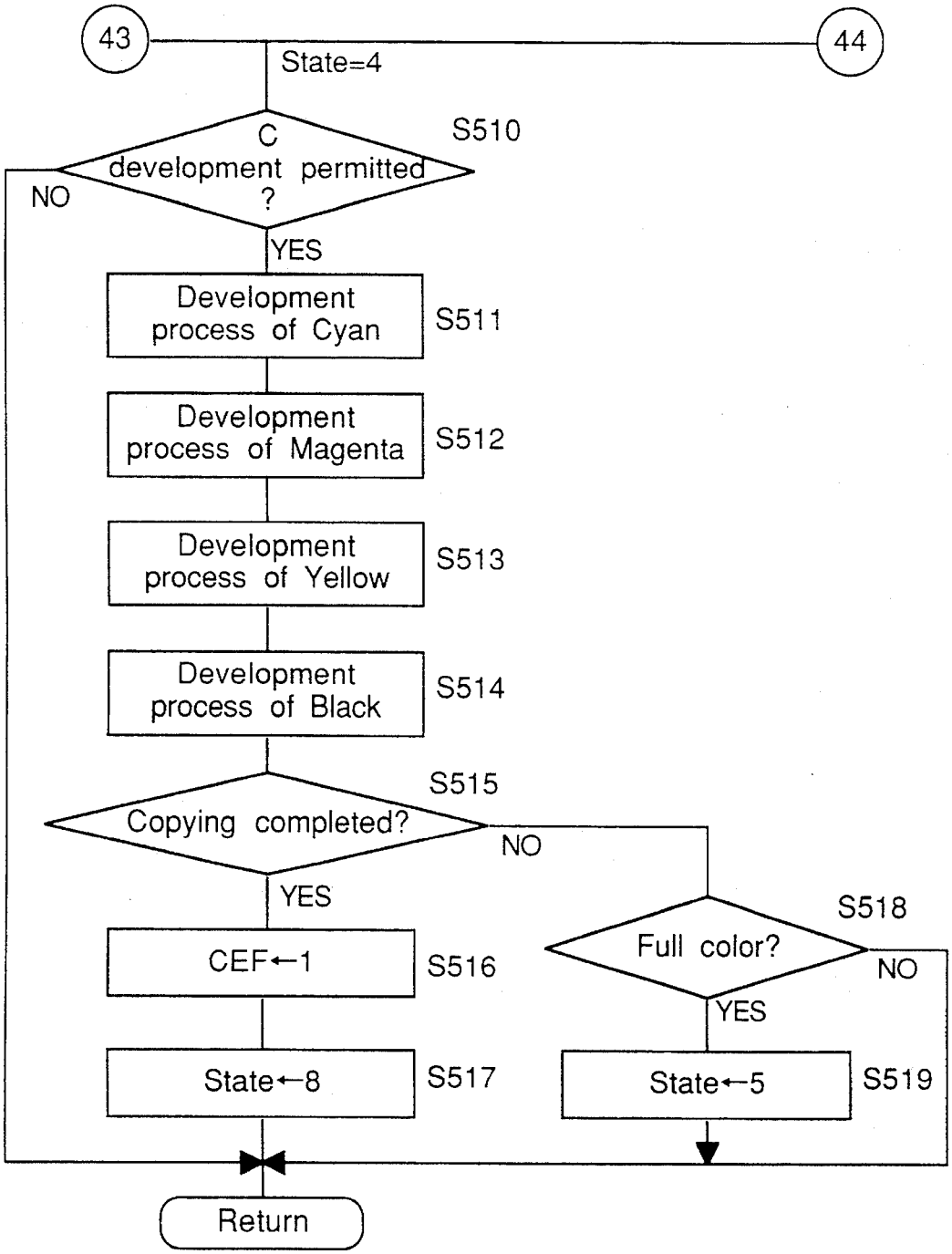
FIG. 46 is a flowchart of a fourth part of the copying process shown in FIG. 30.

Referring to FIG. 46, in the state number of "4", first of all, it is checked whether or not the cyan development permission flag CDPF is set to "1" at step S510. If the cyan development permission flag CDPF is set to "1", the developing unit is put into pressure contact with the photoconductive drum 41, and then an image of cyan is formed.

As is understood from the above descriptions, all the developing units are not in pressure contact with the photoconductive drum 41 for all the time intervals in the processes for correcting the voltages ViA, ViB, ViC and $V_G$. This is to prevent any wasteful toner from adhering onto the photoconductive drum 41.

Accordingly, if the cyan development permission flag CDPF is set to one, the processes of steps S511 to S514 are performed. That is, after forming the ViC voltage pattern and detecting the voltage ViC, the ViC voltage pattern has been passed through the developing unit, and then the developing unit is put in pressure contact with the photoconductive drum 41. Then the development processes of cyan, magenta, yellow and Black are performed, respectively, at steps S511 to S514.

Subsequently, at step S515, it is checked whether or not the request for the next copying process has been set. If the request for the next copying process has not set (YES at step S515), it is decided that copying process has been completed, where the copy end flag CEF is set to "1" at step S516, and then, the state number is set to "8" at step S517. Thereafter, the program flow returns to the main routine.

On the other hand, if the request for the next copy has been set (NO at step S515), it is again decided whether or not it is set to the full-color mode or the mono-color mode at step S518. If it is set to the full-color mode, the state number is set to "5" at step S519, and then the program flow returns to the main routine. On the other hand, if it is set to the mono-color mode, the processes of the state number 4 number are repeated performed as a loop process. In this process, where each of the development of each color at steps S511 to S514 involves the process of not only permitting the development but also not permitting the same.

Figure 47:
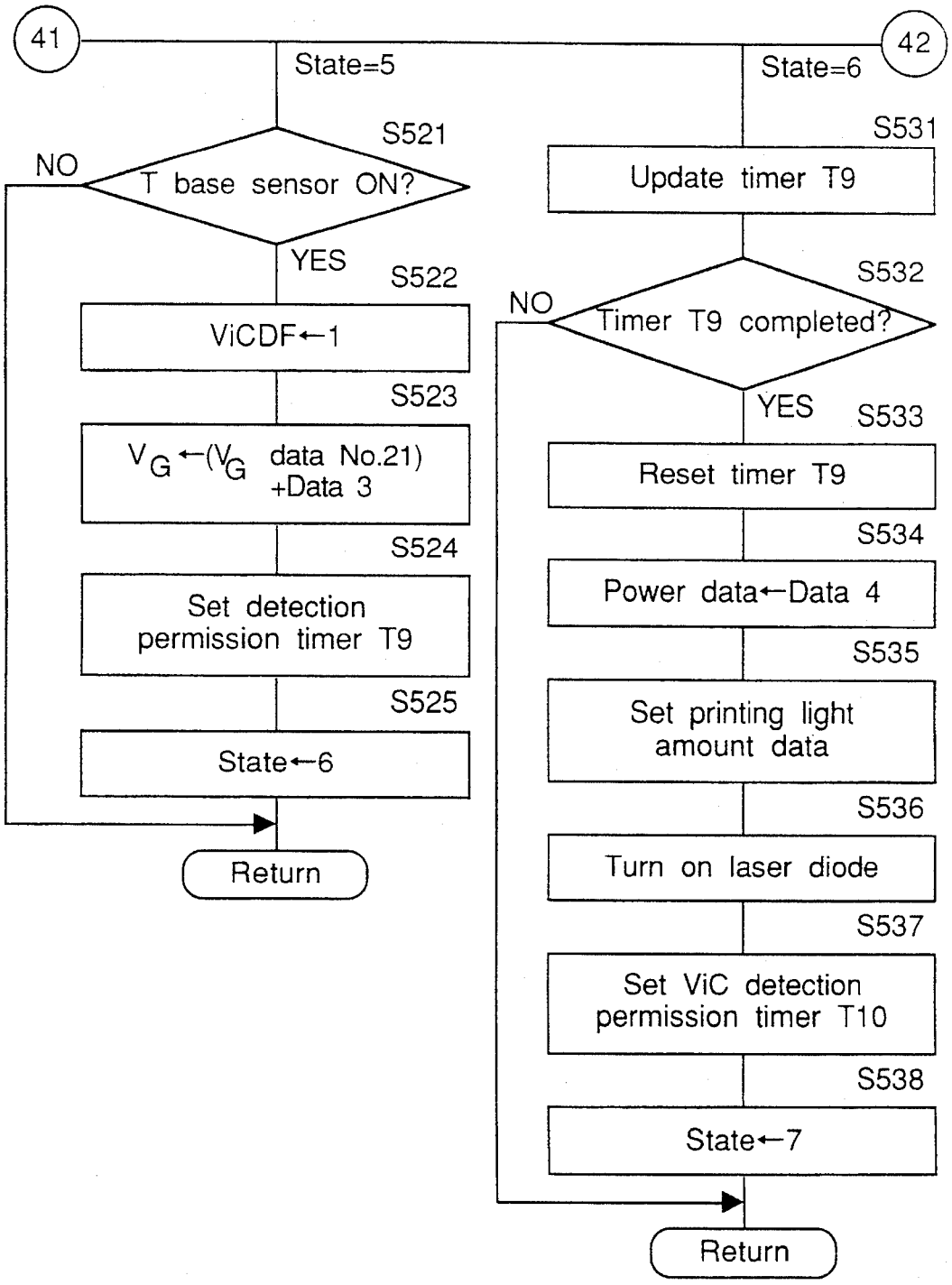
FIG. 47 is a flowchart of a fifth part of the copying process shown in FIG. 30.

Referring to FIG. 47, the processes of the state numbers 5 and 6 are performed in manners similar to those of the state numbers 1 and 2, respectively, and so their explanations being omitted. However, a detection permission timer T9 at step S524 and a ViC permission timer T10 at step S537 used in the processes of the state numbers 5 and 6, respectively, are set equal to the counting times of the timers T6 and T8 of the state numbers 1 and 2.

Figure 48:
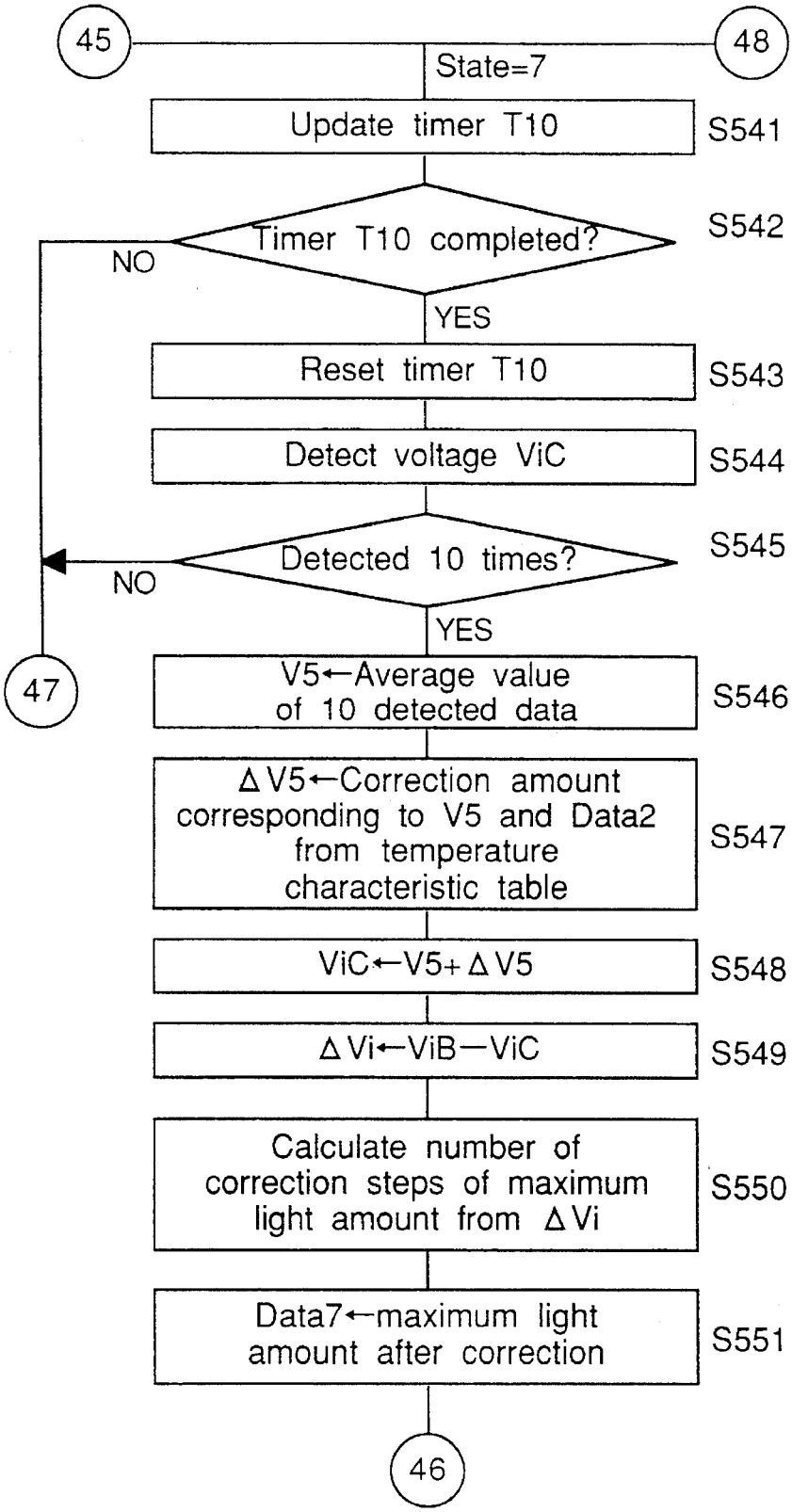
FIG. 48 is a flowchart of a sixth part of the copying process shown in FIG. 30.

Referring to FIG. 48, in the state number of 7, the timer T10 is updated at step S541, and then it is checked whether or not counting of the timer T10 is completed at step S542. If counting of the timer (YES at step S542), the program flow goes to step S543. Otherwise (NO at step S542), the program flow returns to the main routine. At step S543, the timer T10 is reset at step S543. Thereafter, the electrostatic latent image pattern ViC formed on the photoconductive drum 41 under the same conditions as those of the image pattern ViB is again detected at step S544, and then the program flow returns to the main routine through step S545.

If the number of times of detecting the respective ones of the voltage ViC has reached 10 (YES at step S545), the average value of the detected voltages ViC iS calculated, the resulting average value being assumed as data V5 at step S546. Subsequently, the correction amount for correcting the output voltage of the voltage sensor depending on the voltage sensor 44 is obtained from the temperature characteristic table, the resulting correction amount being assumed as a correction amount ΔV5 at step S547. Thereafter, a sum of the voltage V5 and the correction amount ΔV5 is set as the voltage ViC at step S548, and then a subtraction result of (ViB−ViC) is set as the correction amount ΔVi at step S549. Further, the number of steps for correcting the maximum light amount is obtained from the correction amount ΔVi according to the light amount correction table of Table 9 at step S550, and then data of the corrected maximum light amount are stored as data 7 in the internal RAM at step S551. Then the program flow goes to step 552 of FIG. 49.

Figure 49:
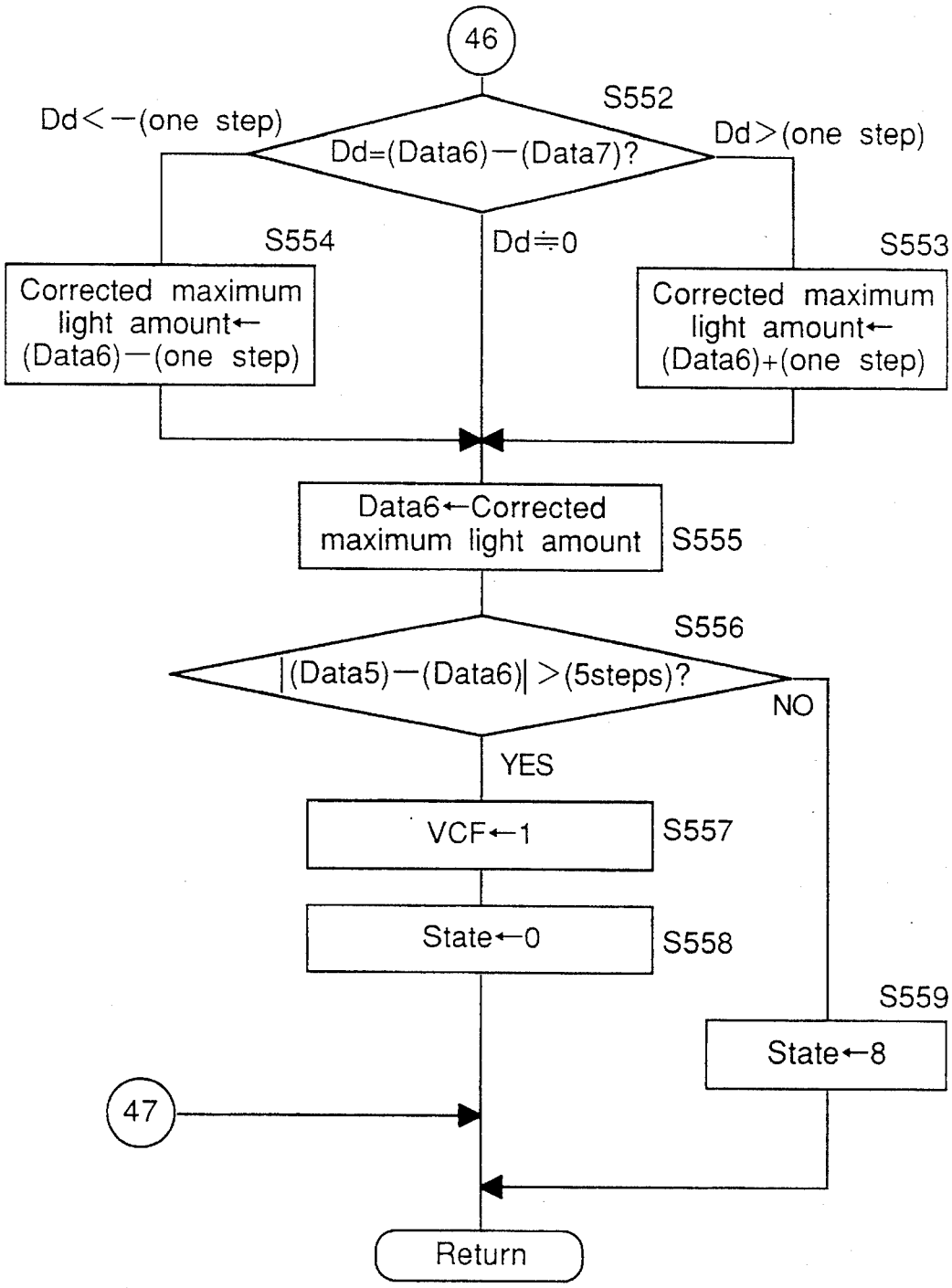
FIG. 49 is a flowchart of a seventh part of the copying process shown in FIG. 30.
Figure 50:
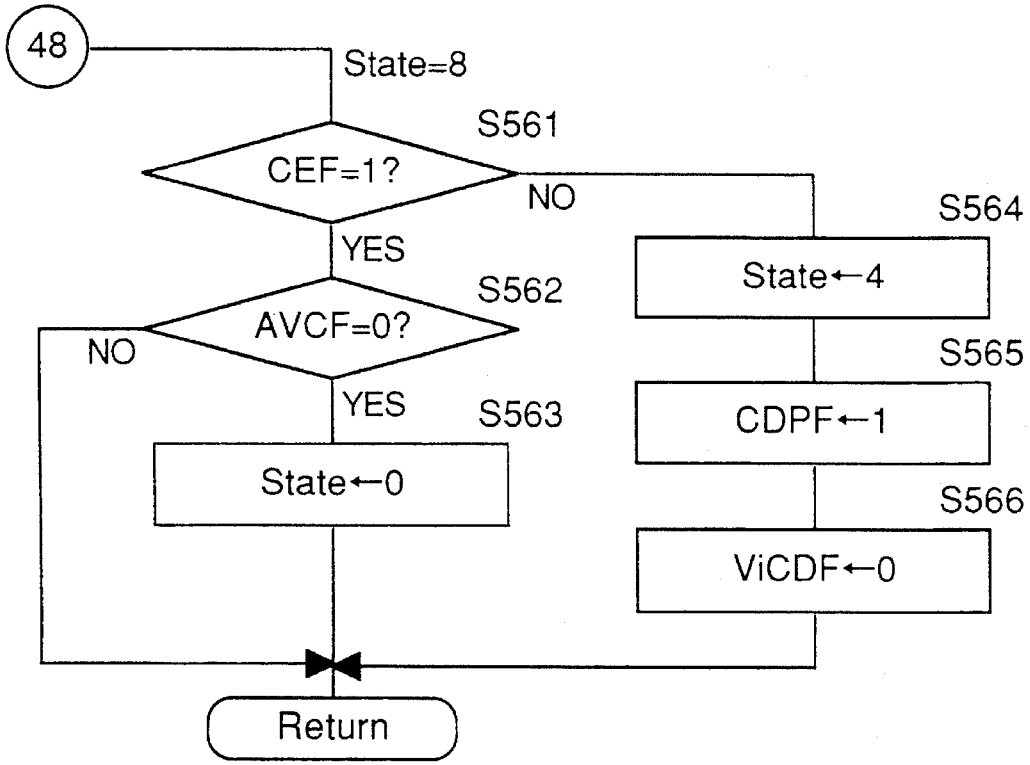
FIG. 50 is a flowchart of an eighth part of the copying process shown in FIG. 30.

Referring to FIG. 49, at step S552, the subtraction of (the data 6 (which is the maximum light amount obtained based on the first time ViC voltage pattern)–the data 7) is calculated, and then resulting difference Dd being a difference of the maximum light amount. If the difference Dd is larger than −1 step, the maximum light amount is decreased by one step from the maximum light amount data 6 at step S554, and then the program flow goes to step S555. On the other hand, if the difference Dd is smaller than +1 step, the maximum light. amount is increased by one step from the maximum light amount data 6 at step S553, and then the program flow goes to step S555. At step S555, the maximum amount data corrected at step S554 or S553 are stored and updated as data 6 in the internal RAM, namely, the maximum light amount data (data 6) of the preceding time is replaced.

By the arrangement that the number of steps for correcting the maximum light amount in the copying process at steps S553 and S554 is set up to one step, when any irregular value has been detected upon detecting the voltage ViC, the maximum light amount are prevented from being selected shifting from that of the copying process of the preceding time, so that the difference between the currently set image density and the image density set in the previous copying process does not becomes a large amount.

Then, at step S556, if it is decided that the difference of (data 5 (ViB)–data 6 (ViC)) has become 5 steps or more in the step unit of the maximum light amount, the voltage control flag VCF is set to "1" at step S557, and then the state number is set to "0". Thereafter, the program flow returns to the main routine. The process of step S557 where the voltage control flag VDF is set to one means a process of performing the AIDC operation again. On the other hand, if the maximum light amount during the copying process has 5 steps or more shifted from that of the voltage ViB, the AIDC process is effected again. The reason is as follows. If the pattern voltages of ViB and ViC are shifted by a larger amount, there is a possibility that the correction amount of the grid voltage $V_G$ for correcting the initial dark-part surface voltage. Accordingly, in order to these amounts, the AIDC process is performed again so as to stably reproduce an image.

If it is decided at step S556 that the difference is less than 5 steps, the state number is set to "8" at step S559, and then the program flow returns to the main routine.

Through this control process, the change in the image density caused due to the change in the sensitivity of the photoconductive drum 41 during the copying process is corrected by correcting the maximum light amount of the laser diode 264, thereby obtaining a stable reproduced stable image.

Referring to FIG. 8, in the state number of "8", first of all, it is decided whether or not the copy end flag CEF is set to "1" at step S561. With the copying over, or the flag CEF being set to one, then it is decided whether or not the after-copy voltage control flag AVCF is set to "1" at step S562. If the after-copy voltage control flag AVCF is reset to "0" (YES at step S562), the state number is set to "0" at step S563, and then the program flow returns to the main routine. Otherwise (NO at step S562), the program flow returns to the main routine.

If it is decided at step S561 that the copying is continued, or the flag CEF being set to zero (NO at step S561), the state number is set to "4" at step S564, and then the cyan development permission flag CDPF is set to "1" at step S565. Further, the ViC detection flag ViCDF is reset to "0" at step S566, and then the program flow returns to the main routine.

(k-11) Trouble process such as process for paper jam

If there has occurred a trouble such as a paper jam or the like, there is a possibility that a piece of copying papers remains on the transfer drum 51. In order to remove the paper from the transfer drum 51, the transfer drum 51 is released from pressure contact with the photoconductive drum 41 for removal of the paper, the positional relation between the photoconductive drum 41 and the transfer drum 51 may change after the releasing the same.

After resetting of the copying machine in this state, if the image formation is started and the correction process for the multi-copying is effected, the surface voltage may be detected at a different position from the circumferential position of the photoconductive drum 41 when detecting the same before the trouble such as a paper jam or other trouble, this leads to a difference in the voltage due to nonuniformity of the surface voltage to be detected in addition to the practical voltage change, resulting in the corrected surface voltage becoming an improper value.

In view of the above fact, it is arranged that after the trouble process, the voltage detection and the toner adhesion amount detection, which are normally performed before the copying process, are effected once again, and then the initial surface voltage value ViB for the multi-copying is newly updated.

FIG. 51 shows the flow of the trouble process at step S12 of FIG. 30.

If a trouble such as a paper jam or the like has taken place after detecting the ViB voltage pattern (after reading the reference pattern) with a piece of paper remaining on the transfer drum 51, it is necessary to once release the photoconductive drum 41 and the transfer drum 51 for removal of the paper. In this case, there is a possibility that the position at which the photoconductive drum 41 and the transfer drum 51 are in contact with each other may be shifted. If the copying process is performed with this shifted positional relationship between the photoconductive drum 41 and the transfer drum 51, it may be impossible to form the ViB pattern and ViC pattern at the same portion on the photoconductive drum 41. As a result, it is difficult to achieve the accurate voltage correction. In order to correct the above-mentioned state, in the trouble process of the present preferred embodiment, there is effected the AIDC operation including the voltage control prior to the copying process, in the case of the copying process after occurrence of a trouble such as a paper jam or the like.

Referring to FIG. 51, first of all, at step S651, it is decided whether or not a trouble such as a paper jam or the like has occurred. If any trouble has not occurred (NO at step S651), the program flow returns to the main routine. If a trouble has occurred (YES at step S651), the machine operation of the copying machine is stopped at step S652, and further the ViA permission flag ViAPF, the ViB permission flag ViBPF and the ViC permission flag ViCPF are reset to "0", respectively, at steps S653 to S655.

Thereafter, it is judged whether or not the trouble is completed at step S656, and then it is checked whether or not the print switch has been turned at step S657. If the trouble is completed (YES at step S656) and the print SW is pressed (YES at step S657), the voltage control flag VCF is set to "1" at step S658, and the AIDC operation is updated. Furthermore, the program flow returns to the main routine. Otherwise (NO at step S656 or NO at step S657), the program flow returns to the main routine, directly.

(k-12) $V_G$ correction during multi-copying

In the flows shown in FIGS. 52 and 53, instead of correcting the light amount during the process of the multi-copying, the dark-part voltage Vo on the photoconductive drum 41 electrically charged with a predetermined output voltage of the corona charger 43 during the process of multi-copying is detected, and then the grid voltage $V_G$ is corrected so that the dark-part voltage Vo is held constant, resulting in that the correction amount of the grid voltage $V_G$ for the period during which the copying process is continuously effected is made less than a predetermined threshold amount.

At steps S2001 and S2002, a predetermined grid voltage $V_G$ is applied to the grid, so that a dark-part surface voltage VoA is detected, and the grid voltage $V_G$ is corrected. By applying a predetermined laser light amount under s condition of using the corrected surface voltage VoA, the surface voltage ViA is detected, and then the light amount of the laser light is corrected according to the detected surface voltage ViA.

Further, at step S2003, the AIDC process is executed using the corrected grid voltage $V_G$ and the light amount of the laser light, and then the grid voltage $V_G$, the development bias voltage $V_B$, and the γ correction table for forming an image of each color are selected.

Thereafter, at step S2004, the dark-part voltage VoB is detected using the corrected data. This detected dark-part voltage VoB is the same as the desired voltage for detecting the voltage VoA, and therefore, the corrected voltage VoA can be the above-mentioned voltage VoB. However, whereas the voltages VoA and ViA are determined based on the averaged voltage corresponding to one rotation of the photoconductive drum 41, the voltages VoB and ViB are determined by detecting the respective voltages corresponding to a part of the photoconductive drum 41 located at a predetermined position. The voltage VoB detected at step S2004 is used as a reference voltage for correcting the grid voltage $V_G$ used in the copying process. Accordingly, the detected voltage VoB is stored as the data D1 in the internal RAM at step S2005.

Subsequently, at step S2005, there is detected the dark-part voltage VoC of the pattern formed under the same conditions as those of the voltage VoB, the resulting dark-part voltage VoC being assumed as data D2.

Then, the correction value of an equation D1–D2 (VoB–VoC)=$\Delta V_G$ is calculated at step S2006, and then the number of steps for correcting the grid voltage $V_G$ is determined from the correction amount $\Delta V_G$ according to the $V_G$ correction table for multi-copying of Table 10.

Further subsequently, at step S2007, the grid voltage $V_G$ resulting from correcting the number of steps for the correction amount $\Delta V_G$ of the grid voltage $V_G$ determined at step S2006 is determined based on the grid voltage $V_G$ table of each color selected by the AIDC operation, and then at step S2008, the resulting number of steps for correcting the grid voltage $V_G$ is stored as data D3 in the internal RAM. Then the program flow goes to step S2009 of FIG. 53.

Referring to FIG. 53, at step S2009, there are formed on the photoconductive drum 41 the images of cyan (C), magenta (M), yellow (Y) and black (K), sequentially, using the corrected the grid voltage $V_G$. Further, at step S2010, it is decided whether or not the copying process is further continued.

If the copying process is continued, the VoC voltage pattern is formed on the photoconductive drum 41 once again at step S2011, and the voltage VoC is detected, then the resulting voltage VoC being assumed as data D4 in the internal RAM. Further, at step S2012, the correction value of an equation of D1–D4 (VoB–VoC)=$\Delta V_G$ is calculated, and then the number of steps corresponding to the correction value $\Delta V_G$ for correcting the grid voltage $V_G$ correction is obtained, the resulting number data being assumed as data D5 in the internal RAM.

Thereafter, at step S2013, a difference Dd=(data D5–data D3) between the number D5 of steps for correcting the grid voltage $V_G$ for the next copying process and the number D3 of steps of the preceding correction is calculated, and then the calculated difference Dd is checked. If the difference Dd is one step or more, the number of steps is determined as (D3+1) steps at step S2014. On the other hand, if the difference Dd is minus one step or less, the number of steps is determined as (D3–1) steps at step S2015. Then the corrected number of steps is stored and updated as the data D3 in the internal RAM at step S2016, and then the program flow returns to step S2009. Then the processes of forming the images of cyan, magenta, yellow and black is repeated.

By effecting such a sequence of the above-mentioned processes, the correction amount of the grid voltage $V_G$ in the process of the multi-copying process is limited up to 10 V or one step, thus giving a limitation in the process of correcting the surface voltage Vo.

(k-13) Modification example of prevention of overcorrection

FIG. 54 shows the process in which the charging process and the laser light amount setting process including the AIDC operation are performed once again when the correction amount of the grid voltage $V_G$ has become larger than a predetermined threshold amount.

Referring to FIG. 54, first of all, at step S1001, a predetermined grid voltage $V_G$ is applied to the grid of the corona charger 43 and the dark-part voltage VoA is detected, and then the correction amount of the grid voltage $V_G$ is determined from the above-mentioned table so that the surface voltage Vo becomes a desired surface voltage Vo.

At step S1002, the bright-part voltage ViA is detected using the corrected grid voltage $V_G$, thereby determining the maximum light amount of the laser diode 264, and then at step S1003, the AIDC operation is executed with the corrected grid voltage $V_G$ and the above maximum light amount. Then the development bias voltages $V_B$, the grid voltages $V_G$ and γ correction tables are selected for respective colors of the image to be reproduced.

At step S1004, the dark-part voltage is detected under the condition of the corrected grid voltage $V_G$, and then the resulting dark-part voltage data are stored.

The process of step S1005 and the following steps are provided for correcting the surface voltage for the copying process. First of all, at step S1005, the dark-part voltage VoC is detected under the same conditions as those of detecting the voltage VoB prior to the copying process. Then, at step S1006, based on the difference (VoB–VoC), the correction amount $\Delta V_G$ of the grid voltage upon the image formation is calculated.

Then it is checked whether or not the correction amount $\Delta V_G$ is less than 50 V at step S1007. If the calculated correction amount $\Delta V_G$ is less than 50 V (YES at step S1007), the grid voltage $V_G$ data selected by the AIDC process is corrected based on the correction amount $\Delta V_G$ at step S1008, followed by the image formation of images of cyan, magenta, yellow and black at step S1009. Then the above-mentioned process is continued until the copying process is completed at step S1010.

If the correction amount $\Delta V_G$ is equal to or larger than 50 V at step S1007, the program flow returns to step S1001 again, where the charging process and the exposure control process including the AIDC operation is performed, thus copying being continued.

In this way, by effecting the AIDC operation once again when the correction amount becomes larger than a predetermined threshold amount (for example, 50 V), the shift amount of the bright-part voltage caused due to the change in the dark-part voltage can be reduced as shown in FIG. 26.

The average value of the surface voltage of an electrostatic latent image is detected corresponding to one rotation of the photoconductive drum 41 prior to the image formation, thereby allowing the possible best voltage controlled conditions to be provided. Upon forming an image, the light amount, the charging amount, or the development bias voltage $V_B$ are controlled in accordance with the difference between the set or detected surface voltage and the average value of the respective surface voltages of the electrostatic latent image formed on a part of the photoconductive drum 41. As a result, it becomes possible to provide stable images with a higher accuracy or preciseness.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An electrophotographic image forming apparatus comprising:

a photoconductor;

charging means for electrically charging said photoconductor;

exposure means for projecting light corresponding to an image onto said photoconductor and forming an electrostatic latent image on said photoconductor;

developing means for developing the electrostatic latent image formed on said photoconductor with toner and forming a toner image on said photoconductor;

transfer means for transferring the toner image formed on said photoconductor onto a sheet of paper;

control means for controlling said charging means, said exposure means, said developing means and said transfer means to form the toner image on a sheet of paper;

detecting means for detecting a surface voltage of at least one position on said photoconductor;

first adjusting means for adjusting an operation value of at least one of said charging means, said exposure means and said developing means based on the surface voltage detected by said detecting means at a timing between respective image forming processes when an image forming process is continuously repeated a plurality of times; and second adjusting means for adjusting the operation value of at least one of said charging means, said exposure means and said developing means with a preciseness higher than that of said first adjusting means, based on the surface voltage detected by said detecting means, prior to a start timing when an image forming process is continuously repeated a plurality of times.

2. The apparatus as claimed in claim 1, wherein said first adjusting means adjusts the operation value of one of said charging means, said exposure means and said developing means, and said second adjusting means adjusts the operation values of a plurality of ones of said charging means, said exposure means and said developing means.

3. The apparatus as claimed in claim 1, wherein said detecting means detects surface voltages at a plurality of positions of said photoconductor, said first adjusting means adjusts the operation value based on the surface voltage at one position of said photoconductor detected by said detecting means; and said second adjusting means adjusts the operation value based on the surface voltages at a plurality of positions of said photoconductor detected by said detecting means.

4. The apparatus as claimed in claim 1, wherein said first adjusting means makes the operation value change by an amount smaller than a predetermined amount depending on the surface voltage, every time when said detecting means detects the surface voltage of said photoconductor.

5. The apparatus as claimed in claim 1, further comprising:

judgment means for judging whether or not the operation value adjusted by said first adjusting means is larger than a predetermined threshold operation value; and stop means for stopping the image forming process when said judgment means judges that the operation value adjusted by said first adjusting means is larger than the predetermined threshold operation value.

6. An electrophotographic image forming apparatus comprising:

a photoconductor;

charging means for electrically charging said photoconductor with a charging amount;

exposure means for projecting light corresponding to an image onto said photoconductor with an exposure amount and forming an electrostatic latent image on said photoconductor;

developing means for developing the electrostatic latent image formed on said photoconductor with toner with a development bias voltage and forming a toner image on said photoconductor;

transfer means for transferring the toner image formed on said photoconductor onto a sheet of paper;

control means for controlling said charging means, said exposure means, said developing means and said transfer means to form the toner image on a sheet of paper;

detecting means for detecting a surface voltage of at least one position on said photoconductor;

storage means for controlling said detecting means to detect a surface voltage of a specific position of an electrostatic latent image formed on said photoconductor under predetermined image forming conditions and storing the detected surface voltage as a reference surface voltage; and correcting means for controlling said detecting means to detect a surface voltage of said specific position of an electrostatic latent image formed on said photoconductor under the same predetermined image forming conditions and correcting at least one of the exposure amount of said exposure means, the charging amount of said charging means and the development bias voltage of said developing means based on the detected surface voltage and the reference surface voltage stored in said storage means.

7. The apparatus as claimed in claim 6, further comprising control means, when a trouble is caused, for controlling said correcting means to operate again, thereby updating the reference surface voltage stored in said storage means.

8. The apparatus as claimed in claim 6, further comprising temperature detecting means for detecting a temperature of said photoconductor, wherein said detecting means corrects the detected surface voltage based on the temperature detected by said temperature detecting means.

9. The apparatus as claimed in claim 6, further comprising temperature detecting means for detecting a temperature of said photoconductor, wherein said detecting means corrects the surface voltage decreasing from a timing when forming the electrostatic latent image to a timing when detecting the surface voltage, based on the temperature detected by said temperature detecting means.

10. An electrophotographic image forming apparatus for forming an image using a plurality of light emitting methods including a first light emitting method, comprising:

selecting means for selecting one of the plurality of light emitting methods;

emitting control means for projecting light corresponding to an image to be formed onto a photoconductor using the light emitting method selected by said selecting means;

first storage means for storing gradation correction table used when using said first light emitting method;

second storage means for storing differences between said gradation correction table stored in said first storage means and gradation correction tables used when using the light emitting method other than said first light emitting means; and gradation correcting means for performing a gradation correction process using said gradation correction table stored in said first storage means when said first light emitting method is selected, and for performing a gradation correction process using addition results of said gradation correction table stored in said first storage means and said differences stored in said second storage means.

11. An electrophotographic image forming apparatus for forming an image using a plurality of light emitting methods including a first light emitting method, comprising:

a photoconductor;

charging means for electrically charging said photoconductor;

exposure means for projecting light corresponding to an image onto said photoconductor and forming an electrostatic latent image on said photoconductor;

developing means for developing the electrostatic latent image formed on said photoconductor with toner and forming a toner image on said photoconductor;

detecting means for detecting a surface voltage of said photoconductor;

condition determining means for determining an image forming condition using the electrostatic latent image formed using said first light emitting method prior to forming an image;

selecting means for selecting one of the plurality of light emitting methods; and exposure control means for controlling said exposure means to project light using the light emitting method selected by said selecting means, upon forming an image.

12. An image forming apparatus comprising:

a photoconductive member;

a charger which electrically charges said photoconductive member;

an exposer which projects light corresponding to an image onto said photoconductive member and forms an electrostatic latent image on said photoconductive member;

a developing device which develops said electrostatic latent image;

a sensor which detects a surface potential of said photoconductive member; and a controller which adjusts only a single operational condition of said exposer based on said surface potential detected by said sensor so as to be close to a predetermined reference value if an image formation is executed and adjusts a plurality of operational conditions of said exposer and said charger based on said surface potential detected by said sensor so as to be close to a plurality of predetermined reference values if the image formation is not executed.

13. The apparatus as claimed in claim 12, wherein said controller adjusts the operational condition of said exposer by a first amount if the image formation is executed and adjusts the operational condition of said exposer by a second amount if the image formation is not executed, said first amount being smaller than said second amount.

14. The apparatus as claimed in claim 12, wherein said sensor detects one portion on said photoconductive member in the case where the image formation is executed while said sensor detects a plurality of portions on said photoconductive member in the case where the image formation is not executed.

15. The apparatus as claimed in claim 12, wherein said controller terminates the image formation if the adjusted value of said exposer becomes a predetermined threshold value.

16. An electrophotographic image forming apparatus, comprising:

a photoconductive member;

a charger which electrically charges said photoconductive member;

an exposer which projects light corresponding to an image onto said charged photoconductive member and forms an electrostatic latent image thereon;

a developing device which develops said electrostatic latent image;

a sensor which detects a surface voltage of a specific position of said photoconductive member;

a memory which stores a surface voltage detected by said sensor as a reference voltage, the stored surface voltage being detected when an electrostatic latent image is formed under predetermined image forming conditions; and correcting means for sampling a surface voltage of said same specific position of said photoconductive member on which an electrostatic latent image is formed under the same predetermined image forming conditions and correcting the exposure amount of said exposer based on the sampled surface voltage and the stored reference voltage.

17. The apparatus as claimed in claim 16, further comprising control means for controlling said correcting means to operate after an error occurs, wherein the reference surface voltage stored in said memory is updated.

18. The apparatus as claimed in claim 16, wherein said correcting means further corrects the charge amount of said charger based on the detected surface voltage and the stored reference voltage.

19. The apparatus as claimed in claim 16, further comprising:

judgment means for judging whether the corrected exposure amount of said exposer exceeds a predetermined threshold amount, wherein said correcting means corrects the charge amount of said charger when said judgment means judges that the corrected exposure amount of the exposer is larger than the predetermined threshold amount.

* * * * *